US007592116B2

(12) United States Patent
Suzuki et al.

(10) Patent No.: US 7,592,116 B2
(45) Date of Patent: Sep. 22, 2009

(54) INDIUM-CONTAINING CARRIER FOR ELECTROPHOTOGRAPHY, DEVELOPER USING THE SAME, AND DEVELOPER CONTAINER

(75) Inventors: Kousuke Suzuki, Numazu (JP); Tomio Kondou, Numazu (JP); Shinichiro Yagi, Numazu (JP); Hitoshi Iwatsuki, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 272 days.

(21) Appl. No.: 11/270,731

(22) Filed: Nov. 10, 2005

(65) Prior Publication Data

US 2007/0015078 A1 Jan. 18, 2007

(30) Foreign Application Priority Data

Nov. 12, 2004 (JP) ..... 2004-328639
Nov. 26, 2004 (JP) ..... 2004-341560
Nov. 30, 2004 (JP) ..... 2004-346980

(51) Int. Cl.
*G03G 9/113* (2006.01)

(52) U.S. Cl. ..... 430/111.35; 430/111.31; 430/111.41

(58) Field of Classification Search ..... 430/111.35, 430/111.31, 111.41
See application file for complete search history.

(56) References Cited

U.S. PATENT DOCUMENTS 6,083,652 A * 7/2000 Duggan et al. ..... 430/111.35
7,381,513 B2 * 6/2008 Suzuki et al. ..... 430/111.35
2003/0219279 A1 11/2003 Nohsho et al.
2004/0234876 A1 11/2004 Suzuki et al.
2005/0238980 A1 10/2005 Yamashita et al.
2006/0099009 A1 * 5/2006 Miyamoto et al. ..... 430/111.3
2006/0120767 A1 * 6/2006 Miyamoto et al. ..... 430/111.35

FOREIGN PATENT DOCUMENTS

EP 0 492 665 A1 7/1992
EP 1 621 935 A2 2/2006
JP 54-155048 12/1979
JP 57-40267 3/1982
JP 58-108548 6/1983
JP 58-108549 6/1983
JP 59-166968 9/1984
JP 1-19584 4/1989
JP 3-628 1/1991

(Continued)

OTHER PUBLICATIONS

U.S. Appl. No. 11/449,808, filed Jun. 9, 2006, Suzuki et al.

(Continued)

*Primary Examiner*—Christopher RoDee
(74) *Attorney, Agent, or Firm*—Oblon, Spivak, McClelland, Maier & Neustadt, P.C.

(57) ABSTRACT

The object of the present invention is to provide a carrier for electrophotography which includes a core material and a coating layer comprising particles on a surface of the core material, in which the carrier for electrophotography comprises indium (In) in an amount of 0.0001% by mass to 0.5% by mass. The present invention also provides a developer using the carrier, a developer container, an image forming method, an image forming apparatus, and a process cartridge in each of which the carrier is used.

16 Claims, 8 Drawing Sheets

FOREIGN PATENT DOCUMENTS

| | | |
|---|---|---|
| JP | 5-273789 | 10/1993 |
| JP | 6-202381 | 7/1994 |
| JP | 7-140723 | 6/1995 |
| JP | 8-6307 | 1/1996 |
| JP | 8-179570 | 7/1996 |
| JP | 8-286429 | 11/1996 |
| JP | 9-54461 | 2/1997 |
| JP | 9-160304 | 6/1997 |
| JP | 2683624 | 8/1997 |
| JP | 2959927 | 7/1999 |
| JP | 2959928 | 7/1999 |
| JP | 2002-229325 | 8/2002 |
| JP | 2003-345070 | 12/2003 |
| JP | 2004-341560 | 12/2004 |
| JP | 2004-346580 | 12/2004 |

OTHER PUBLICATIONS

U.S. Appl. No. 11/870,613, filed Oct. 11, 2007, Iwatsuki et al.
U.S. Appl. No. 11/378,424, filed Mar. 20, 2006, Suzuki et al.
U.S. Appl. No. 12/013,108, filed Jan. 11, 2008, Yagi et al.
U.S. Appl. No. 11/958,728, filed Dec. 18, 2007, Nagayama et al.
U.S. Appl. No. 12/040,451, filed Feb. 29, 2008, Saitoh et al.
U.S. Appl. No. 12/209,607, filed Sep. 12, 2008, Nagayama et al.
U.S. Appl. No. 11/608,521, filed Dec. 8, 2006, Satoru et al.

* cited by examiner

INDIUM-CONTAINING CARRIER FOR ELECTROPHOTOGRAPHY, DEVELOPER USING THE SAME, AND DEVELOPER CONTAINER

BACKGROUND OF THE INVENTION

1. Field of the Invention

The present invention relates to a carrier for electrophotography used for developing latent electrostatic images in electrophotographic process, electrostatic recording, electrostatic printing, or the like. The present invention further relates to a developer, a developer container, an image forming method, an image forming apparatus, and a process cartridge in each of which the carrier for electrophotography is used.

2. Description of the Related Art

In image formation according to an electrophotographic process, a latent electrostatic image is formed on an image bearing member which comprises a photoconductive substance, and the like (an image bearing member may be hereinafter referred to as latent electrostatic image bearing member, electrophotographic photoconductor, or photoconductor); a charged toner is made to adhere on the latent electrostatic image to form a visible image (a toner image), and the visible image is transferred onto a recording medium such as paper and fixed to thereby output an image.

In recent years, the developments of technologies for copiers and printers based on electrophotography are rapidly turning from monochrome systems to full-color systems, and the market of full-color systems tends to expand. In color image formation according to a full-color electrophotographic process, typically, three color toners of yellow, magenta, and cyan, or four color toners having a black toner in addition to theses three color toners are superimposed to thereby reproduce all colors. Thus, in order to obtain a brilliantly-colored full-color image having excellence in color reproductivity, the amount of light scattering should be reduced by smoothing the surface of a toner image to some extent. For this reason, most of the images formed by conventional full-color copiers fall in the range of moderate to high glossiness of 10% to 50%.

Generally, for a method for fixing a toner image on a recording medium, a contact heat fixing method is frequently used, in which a toner image is fixed by heating a roller and/or a belt having a smooth surface, pressurizing and contacting a toner with the roller and/or the belt. The method has advantages in that high thermal efficiency is obtained, high-speed fixing is possible, and it is possible to provide with glossiness and transparency in color toners, at the same time, the method causes a so-called offset phenomenon in which a part of a toner image adheres on the surface of a fixing roller and transfers onto another image, because the surface of a heat-fixing member such as a fixing roller is made to contact with a molten toner under increased pressure, and then the fixing member is isolated from the toner.

Aiming at prevention of the offset phenomenon, a method has been employed in which a surface of a fixing roller is formed with a silicone rubber or a fluorine resin which excels in releasing property, and is further coated with a releasing oil such as a silicone oil on the surface of the fixing roller. According to the method, it is extremely effective in preventing offset of toner, however, the method needs a device for supplying a releasing oil, and the fixing unit inevitably needs to grow in size, and the method is unfit for down-sizing. For this reason, in monochrome toners, another method tends to be increasingly employed in which no releasing oil is coated on a fixing roller (oil-less) or only a small amount of releasing oil is used by controlling the molecular mass distribution of a binder resin not so as to internally rupture a molten toner to increase viscoelesticity of the molten toner and further using a releasing agent such as wax to be included in the toner.

Also, in color toners, as is the case with monochrome toners, there are tendencies of employing oil-less process for the purposes of downsizing of machine and simplification of toner material composition. However, as mentioned above, with color toners, the surface of a fixed image needs to be smoothed to increase color reproductivity and thus viscoelasticity of a molten toner must be reduced. Therefore, color toners may more easily cause offset phenomena than in monochrome toners which have less glossiness, and it is more difficult to employ an oil-less process in fixing units as well as to coat a small amount of a releasing oil on fixing rollers or the like. In addition, when a releasing agent is included in a toner, transferring property of the toner to recording media is reduced due to increased adherence of the toner. Further, there is a problem that the releasing agent in the toner contaminates frictional charge members such as carrier, resulting in degradation of durability of the toner due to reduced charge property of the toner.

On the other hand, with respect to carriers, there has been a method in which a hard and high-strength coating layer is formed on a carrier for the purposes of preventing toner component-filming on a surface of carrier, uniformly forming a surface of carrier, preventing oxidation of a surface of carrier, preventing reduction in moisture sensitivity, prolonging developer life, preventing a carrier from adhering on surfaces of photoconductors, protecting photoconductors from flaws and frictions which are caused by a carrier, controlling charge polarity, and adjusting the charged amount or the like. There have been carriers proposed so far, for example, a carrier which is coated with a specific resin material (see Japanese Patent Application Laid-Open (JP-A) No. 58-108548); a carrier in which various additives are added to a coating layer (see Japanese Patent Application Laid-Open (JP-A) Nos. 54-155048, 57-40267, 58-108549, 59-166968, and 06-202381, and Japanese Patent Application Publication (JP-B) Nos. 01-019584, and 03-000628); a carrier having additives adhered on the surface thereof (see Japanese Patent Application Laid-Open (JP-A) No. 05-273789); a carrier in which conductive particles each having a diameter greater than the thickness of a coating layer are included in the coating layer (see Japanese Patent Application Laid-Open (JP-A) No. 09-160304), and the like. In addition, Japanese Patent Application Laid-Open No. 08-006307 proposes to use a carrier-coating material which comprises a primary component of a benzoguanamine-n-butyl alcohol-formaldehyde copolymer. Japanese Patent (JP-B) No. 2683624 proposes to use a cross-linking product of a melamine resin and acrylic resin as a carrier coating material.

However, with these related art approaches, there are still problems with carrier adhesion in half-tone image parts where a number of dots are formed in early stage of image formation, carrier adhesion in solid image parts with the lapse of running time, and durability of carrier. With respect to early-stage carrier adhesion, it is problematic because the carrier adhesion is easily liable to arise half-tone image parts formed with dots at the early stage of using a developer. With respect to carrier adhesion in solid image parts with the lapse of running time, it is problematic because a film-exfoliation of the used resin coating layer causes reduction in resistance associated with the reduced amount of the resin coating layer, and the reduced resistance causes carrier adhesion in solid image parts. Further, with respect to durability, there are problems with the amount of toner spent on the surface of carrier, destabilization of the charged amount associated with the toner spent, reduction in the amount of the coating layer caused by exfoliation of resin coating film, and reduction in resistance associated with the reduced amount of the coating layer. Therefore, with a carrier according to these related arts, there still remain problems that quality of copied images is degraded as the number of copied sheets increases, although excellent images can be formed in early stage of image formation.

In response to demands for being faster and more beautiful, high-quality of image and speeding-up are remarkably progressing in the area of image forming apparatus. In accordance with the movements, the amount of stress that a developer should go through has increased dramatically, and carriers that have been said to be long-lived are unable to have a sufficient operating life. In addition, conventionally, carbon black is frequently used as a resistance controlling agent of carrier, however, there is a fear of smearing a color image with carbon black, and such a smear is caused by exfoliated film of the used resin coating and/or desorption of carbon black. Therefore, various methods are proposed as a measure to counter the problem. For example, a carrier is proposed. The carrier is formed by making a conductive material (carbon black) reside on the surface of a core material, and the conductive material does not reside in a coating layer (see Japanese Patent Application Laid-Open (JP-A) No. 07-140723). In addition, a carrier is proposed. The carrier has a concentration gradient of carbon black in the direction of the thickness of a coating layer, the concentration of the carbon black is gradually lowered toward the surface of the coating layer, and the carbon black does not reside on the surface of the coating layer (see Japanese Patent Application Laid-Open (JP-A) No. 08-179570). A two-layered coating type carrier is proposed, the carrier comprises an inside coating layer and a surface coverage layer, the inside coating layer comprises a conductive carbon on surfaces of core material particles, and the surface coating layer comprises a white conductive material on the inside coating layer (see Japanese Patent Application Laid-Open (JP-A) No. 08-286429). However, these proposals cannot respond to the highly-stressful movements in recent years, and toner smears on images become more and more problematic, and production of carrier leaves room for improvement.

As a drastic measure against such smears on images, it is obvious that non-usage of carbon black which may cause smears on images is the most effective measure. However, when carbon black alone is not used in a carrier, as mentioned above, resistance of the carrier is increased, because carbon black is characterized in its low resistance. Generally, when a carrier having high resistance is used as a developer, with an image having a large surface area of copied image, the image density in the center portion is very low, only edge portions of the copied image are represented with thick density, and it is a so-called image that the edge effect is sharply represented. When an image is represented with letters and thin lines, a brilliant image is formed because of the edge effect, however, when an image is represented in neutral color tone, such a carrier has an disadvantage in that images having very poor reproductivity are formed.

For resistance controlling agents other than carbon black, for example, titanium oxides, zinc oxides or the like are known in the art, however, as to an effect of reducing the resistance, titanium oxides and zinc oxides do not have effect enough to replace carbon black. Accordingly, such resistance controlling agents do not lead to a solution of the problem, and there are still demands for further improvements and developments in carrier.

SUMMARY OF THE INVENTION

It is therefore an object of the present invention to provide a carrier for electrophotography which excels in durability without substantially causing carrier adhesion, is capable of forming finely-textured images without causing edge effect for a long time and exhibiting high-performance of image formation without causing smears on images as well as to provide a developer using the carrier. The present invention further provides a developer container, an image forming method, an image forming apparatus, and a process cartridge.

The carrier for electrophotography of the present invention comprises a core material, and a coating layer containing particles on a surface of the core material, and the carrier comprises indium (In) in an amount of 0.0001% by mass to 0.5% by mass.

The carrier for electrophotography of the present invention can exert resistance controlling effect by making indium (In) reside in the carrier as an oxide or a compound other than the oxide.

Specifically, resistance controlling effect of the carrier is improved by making indium (In) included in the carrier in an amount of 0.0001% by mass to 0.5% by mass, and the carrier has excellence in durability without substantially causing carrier adhesion and is capable of forming finely-textured images without causing edge effect for a long period of time and exhibiting high-performance of image formation without causing smears on images. The developer of the present invention comprises a toner comprising a binder resin and a colorant, and the carrier for electrophotography of the present invention.

In the developer container of the present invention, the developer of the present invention is filled.

The process cartridge of the present invention comprises an image bearing member, and a developing unit configured to develop a latent electrostatic image formed on the image bearing member using the developer of the present invention to form a visible image.

The image forming apparatus of the present invention comprises an image bearing member, a latent electrostatic image forming unit configured to form a latent electrostatic image on the image bearing member, a developing unit configured to develop the latent electrostatic image using the developer of the present invention to form a visible image, a transferring unit configured to transfer the visible image onto a recording medium, and a fixing unit to fix the transferred image on the recording medium.

The image forming method of the present invention comprises forming a latent electrostatic image on an image bearing member, developing the latent electrostatic image using the developer of the present invention to form a visible image, transferring the visible image onto a recording medium, and fixing the transferred image on the recording medium.

Figure 1:
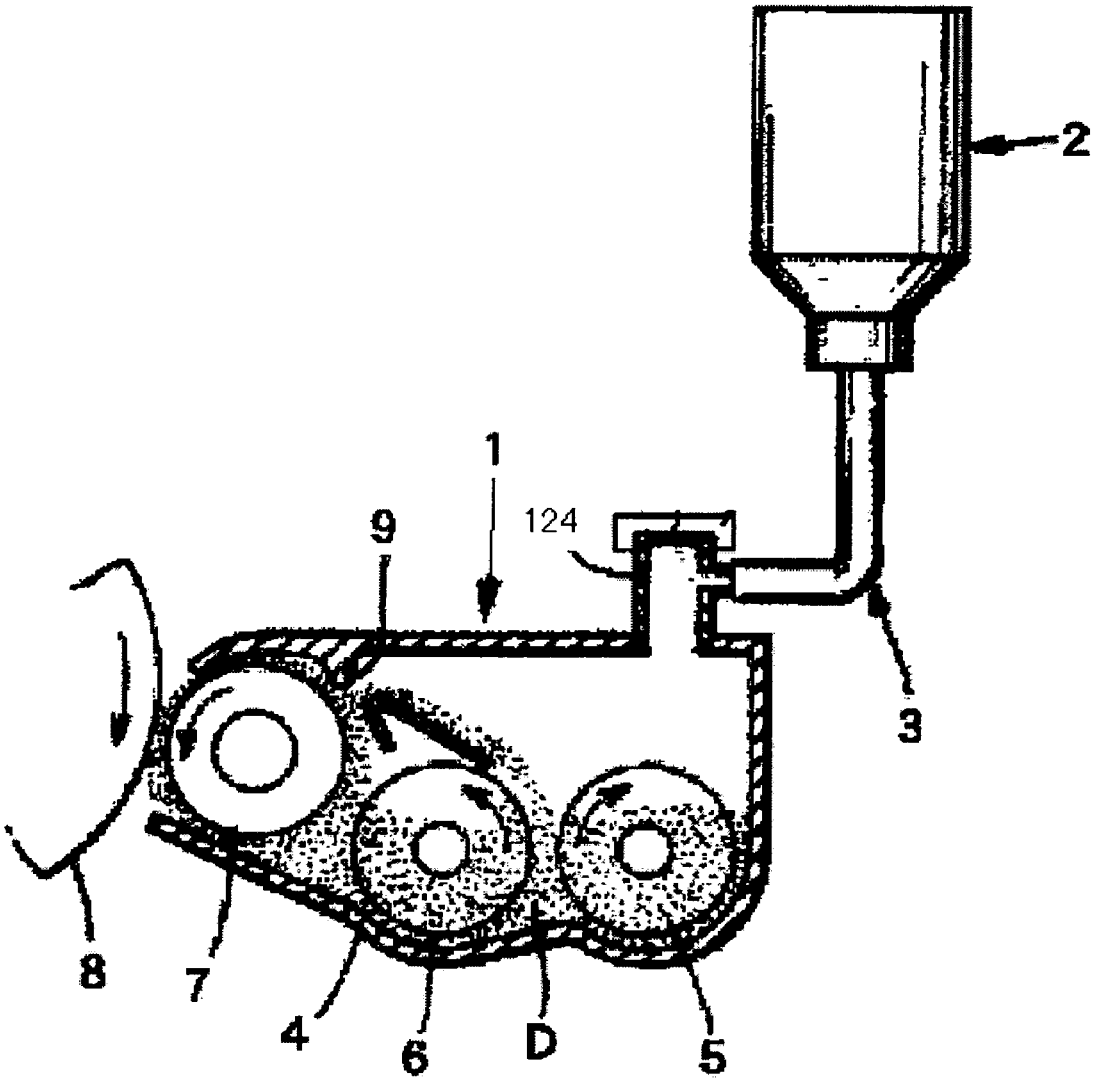
FIG. 1 is a schematic view exemplarily showing an example of the image forming apparatus of the present invention with the developer container of the present invention mounted thereon.

DESCRIPTION OF THE PREFERRED EMBODIMENTS (Carrier for Electrophotography)

The carrier for electrophotography of the present invention comprises a core material, a coating layer comprising particles on the surface of the core material, and further comprises other components in accordance with the necessity.

The carrier preferably comprises indium (In) in an amount of 0.0001% by mass to 0.5% by mass, and more preferably in an amount of 0.001% by mass to 0.2% by mass. When the content of the indium is less than 0.0001% by mass, formation of a conductive path which exerts a resistance controlling function is less formed, and resistance controlling effect may not be sufficiently obtained. When the content of the indium is more than 0.5% by mass, formation of the conductive path is excessively formed, and resistance of the carrier is excessively lowered, therefore, the quality of the carrier may degrade to a level where the carrier cannot be used in practical applications due to occurrence of carrier adhesion.

Here, the indium content in the carrier can be measured by means of, for example, a fluorescent X-ray analyzer ZSX100e (manufactured by Rigaku Corporation) using EZ scan which is a function of scanning contained elements. Specifically, first, a measurement sample of carrier is made to uniformly adhere on a seal with a pressure sensitive adhesive coated thereon. Then, the seal is set on a measurement sample stand, and the following conditions are selected to measure the content of the indium in the carrier.

| (Measurement Conditions) | |
|---|---|
| Measurement Range: | B–U |
| Measurement Diameter: | 30 mm |
| Form of Sample: | Metal |
| Measurement Time: | Long time |
| Atmosphere: | In vacuum |

<Coating Layer>

The coating layer contains at least particles, contains a binder resin and further contains other components in accordance with the necessity.

Particles

The particles comprise conductive particles, and the conductive particles preferably comprise an indium oxide. Further, the conductive particles preferably comprise a coating layer comprising a tin dioxide layer, and an indium oxide layer comprising a tin dioxide formed on the tin dioxide layer on the surfaces of the base particles.

It is conceivable that this is because resistance controlling effect can be sufficiently exerted with the structure, because the conductive particles are formed in a structure in which a tin dioxide layer is formed as an under-coating layer of the surfaces of the base particles by means of a proper method, an indium oxide layer containing a tin dioxide being a conductive layer is formed as an upper coating layer on the tin dioxide layer, and therefore the conductive layer being an upper coating layer can be uniformly and solidly immobilized on the surfaces of the base particles.

The material used for the base material of the conductive particles is not particularly limited, may be suitably selected in accordance with the intended use, and example thereof include aluminum oxides, titanium dioxides, zinc oxides, silicon dioxides, barium sulfates, and zirconium oxides. The resistance controlling effect is remarkably improved by using a material selected from these materials alone or a combination with two or more. It is conceivable that these materials are compatible with the electrically conductive treatment provided with the surfaces of particles, and the effect of the electrically conductive treatment is excellently exerted.

The powder specific resistance of the conductive particles is preferably 200 Ω·cm or less, more preferably 0.1 Ω·cm to 100 Ω·cm, still more preferably 0.1 Ω·cm to 15 Ω·cm, and particularly preferably 0.1 Ω·cm to 5.0 Ω·cm. This is because it is necessary to obtain an effect of effectively reducing the resistance of the carrier, and the conductive particles are included in the carrier for the purpose of controlling the resistance of the carrier.

When the powder specific resistance is less than 1.0 Ω·cm, the ability of reducing the resistance is exceedingly high. Therefore, to make the carrier have an appropriate resistance value, the conductive fine particles should be included in an extremely small amount. At this time, since the proportion of the particles is excessively small compared to the amount of a binder resin residing on surfaces of the carrier particles, the effect of mitigating the contact which is associated with a high impulsive force to the binder resin is small, and it is unfavorable because sufficient durability of the carrier cannot be obtained. This phenomenon occurs especially when the content of the conductive fine particles in the resin coating layer is less than 10% by mass. On the other hand, when the powder specific resistance is more than 200 Ω·cm, the ability of the conductive fine particles of reducing resistance is low. Therefore, to make the carrier have an appropriate resistance value, a large amount of the conductive fine particles is required. At this time, since the proportion of the particles is excessively large compared to the amount of a binder resin residing on surfaces of the carrier particles, the proportion of the binder resin from which charge is generated is insufficient. Therefore, the carrier cannot exert sufficient charge ability. In addition to that, since the amount of the particles is excessively large compared to the amount of the binder resin, the ability of the binder resin to hold the particles therein is insufficient, and the particles are easily liable to be exfoliated from the binder resin. Therefore, it is unfavorable because variances in the charged amount, the resistivity value or the like are increased, and sufficient durability cannot be obtained. This phenomenon occurs especially when the content of the conductive fine particles in the resin coating layer is more than 70% by mass.

Figure 8:
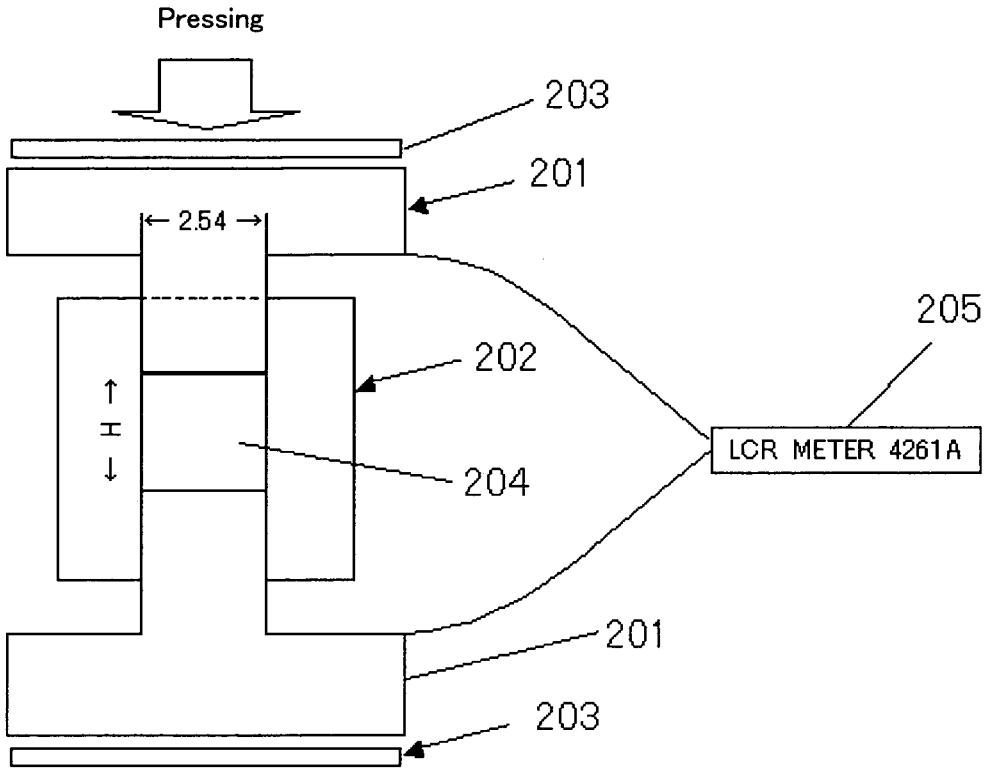
FIG. 8 is an illustration of the measurement method of the compressed powder specific resistance of the conductive particles used in the present invention.

Here, the powder specific resistance of the conductive particles is calculated, for example, by the following procedure. As shown in FIG. 8, 5 g of powder sample 204 is placed in a cylindrical tube made of vinyl chloride 202 having an inner diameter of 1 cm. A pair of electrodes 201 are held to the vinyl chloride tube 202 at the upper portion and the lower portion thereof. Two Teflon (registered trademark) plates 203 each having a thickness of 2 mm are individually laid on the electrodes 201 such that the electrodes are sandwiched in between the two Teflon plates 203. Then, load of 10 kg/cm$^2$ is applied to the electrodes 201 through the Teflon plates 203 using a pressing machine (not shown). Next, LCR (inductance-capacitance-resistance) meter 205 (4261A, manufactured by YOKOGAWA HEWLETT PACKARD Inc.) is connected to the electrodes 201 under a pressure of 10 kg/cm$^2$ to measure the resistance value (r) (Ω). Then, the powder specific resistance of the conductive particles can be calculated by using the obtained resistance value based on the following equation.

$$\text{Powder Specific Resistance } (\Omega\cdot\text{cm})=(2.54/2)^2\times(\pi/H\times r)$$

In the above equation, H represents the thickness of the powder sample, and r represents the resistance value.

The amount of the oil absorption in the conductive particles is preferably 10 mL/100 g to 300 mL/100 g. By defining the amount of oil absorption, the compatibility between the conductive particles and the coated resin is sufficiently obtained, the adherence between the conductive particles and the coated resin is also sufficiently obtained, and the dispersibility of the conductive particles is improved, and thus the carrier can maintain the resistance controlling effect for a long time.

In the measurement of the oil absorption, the amount of oil absorption is measured in compliance with the amount of oil absorption 21. of JIS K 5101 Pigment Test Method. The oil absorption can be controlled by changing the average primary particle diameter of the base particles, the specific surface area of the base particles based on the BET method, and the thickness of the conductive layer to be coated on the carrier particles.

It is preferred that the carrier of the present invention be a carrier having a coating layer on the surface of a core material thereof, white conductive particles be contained in the coating layer, and the white conductive particles has a value L* being 70 or more, a value b* being −10 to 10 in the color specification system of the CIE L*a*b*, from the perspective of preventing smears on images for a long time.

The value L* of the white conductive particles in the color specification system of the CIE L*a*b* is preferably 70 or more, more preferably 80 to 98, and still more preferably 85 to 95. The value b* of the white conductive particles in the color specification system of the CIE L*a*b* is preferably −10 to 10, more preferably −5 to 5, and still more preferably −1 to 3. By making such white conductive particles included in the carrier, the carrier can exert resistance controlling effect, and the problem with smears on images that are problematic in the long term use can be drastically resolved. When the color tone value L* of the powder is less than 70, the white conductive particles are deviated from the carrier because of its insufficient degree of whiteness, resulting in an impure color toner when the carrier is fixed together with a toner. When the value b* is less than −10 or more than 10, the chroma saturation of the carrier is excessively large, and the white conductive particles are deviated from the carrier, resulting in contamination of toner color when the carrier is fixed together with a toner.

The values L* and b* can be measured by the following method. The white conductive particles are weighed and taken in an amount of 6 g using an even balance. A white sheet of paper is laid on a die, a stainless ring is placed on the white paper, the weighed powder sample was placed in the stainless ring, and then a holding-clasp is placed on the stainless ring. The powder sample is pressed using a compact size automatic presser, and the values L* and b* of the powder sample are read using a differential calorimeter which has been gauged to the standard color specification.

Differential calorimeter: (Z-10018P, manufactured by Nippon Denshoku Kogyo KK, or a calorimeter exhibiting its performance as much as or more than Z-10018P)

Stainless ring: (Inner diameter: 40 mm, height: 18 mm)

As a production method of the conductive particles, it is preferred, for example, that a tin dioxide hydrate is coated on surfaces of the base particles, thereafter, an indium oxide hydrate containing the tin oxide dioxide is coated thereon, and the coated particles are heated at a temperature of 350° C. to 750° C. in the presence of inert gas, however, the method is not particularly limited to the above method.

As a more specific example of the production method of the conductive particles, there is a method as stated below.

There are various methods of forming an under coating layer of a tin dioxide hydrate, for example, a method in which a solution of a tin salt or a stannate is added to a water suspension base of a white inorganic pigment, and then an alkali or an acid is added thereto; a method in which a tin salt or a stannate, and an alkali or an acid are added individually to the water suspension at the same time. To uniformly coat the hydrous reaction product of the tin oxide on the surfaces of the white inorganic pigment particles, the latter method, namely, the method of individually adding a tin salt or a stannate, and an alkali or an acid at the same time is more appropriate than the former method. In this case, it is preferred to heat the water suspension at 50° C. to 100° C. and keep the temperature. The pH of the water suspension when individually adding a tin salt or a stannate, and an alkali or an acid at the same time is 2 to 9. Preferably, since the isoelectric point of a tin dioxide hydrate is pH 5.5, it is important to keep the water suspension to have a pH of 2 to 5 or 6 to 9. This allows the tine hydrous product to be uniformly precipitated on the surfaces of the white inorganic pigment particles.

For the tin salt, it is possible to use a tin chloride, a tin sulfate, a tin nitrate, and the like. Examples of the stannate include sodium stannate and potassium stannate.

Examples of the alkali include sodium hydroxide, potassium hydroxides, sodium carbonates, potassium carbonates, ammonium carbonates, ammonia water and ammonia gas.

Examples of the acid include hydrochloric acids, sulfuric acids, nitric acids, and acetic acids.

The coating amount of the tin dioxide hydrate, $SnO_2$, relative to the base of the white inorganic pigment is preferably 0.5% by mass to 50% by mass, and more preferably 1.5% by mass to 40% by mass. When the coating amount of the tin dioxide hydrate is too small, the layer of the indium oxide hydrate containing a tin oxide to be coated thereon is unevenly coated and adversely affected by the white inorganic pigment base, which causes a high volume resistivity value of the powder. When the coating amount of the tin dioxide hydrate is too large, the amount of the tin oxide hydrate that is not precipitated on the surfaces of the inorganic pigment base is excessively large, and consequently, the coating is easily liable to be formed unevenly.

Next, there are various methods for forming a coating layer of the indium oxide hydrate containing tine dioxide, which is to be coated as the upper coating layer. To prevent dissolution of the coating layer of the tin dioxide hydrate that has been coated in first, it is preferred to employ a method in which a mixture solution of a tin salt and an indium salt, and an alkali are individually added to the water suspension in parallel to form the upper layer. In this case, it is preferred to heat the water suspension at 50° C. to 100° C. The pH of the water suspension when adding the mixture solution and the alkali in parallel is preferably 2 to 9, and it is important to keep the pH at 2 to 5 or 6 to 9. By doing so, the hydrous reaction product between tin and indium can be uniformly precipitated on surfaces of the inorganic pigment particles.

For raw materials of the tin, it is possible to use, for example, tin chloride, tin sulfate, tin nitrate, and the like. For raw materials of the indium, it is possible to use, for example, indium chloride, indium sulfate, and the like.

The added amount of the tin dioxide, $SnO_2$, relative to $In_2O_3$ is preferably 0.1% by mass to 20% by mass, and more preferably 2.5% by mass to 15% by mass. When the added amount of the tine dioxide is too small or too large, desired conductivity cannot be obtained.

The usage of the indium oxide, $In_2O_3$, relative to 100 parts by mass of the base of the inorganic pigment is preferably 5 parts by mass to 200 parts by mass, and more preferably 8 parts by mass to 150 parts by mass. When the usage of the indium oxide is too small or too large, the conductivity of the carrier is hardly improved, and it is unfavorable from the perspective of cost performance because it costs more in the long run.

In the present invention, it should be noted that the conductive powder means a powder which has a volume resistivity value of 1 Ω·cm to 500 Ω·cm. As shown in the Examples described hereinafter, according to the present invention, it is possible to obtain a white conductive powder which is extremely excellent in conductivity and has a volume resistivity value equivalent of that of an antimony-contained product being 100 Ω·cm or less or possibly being 10 Ω·cm or less.

In the heating treatment of the conductive powder, it is preferred to heat the conductive powder at 350° C. to 750° C. in non-oxidizing atmosphere, and such a powder can reduce a few digits of the volume resistivity value of the powder, compared to the conductive powder heated in the air.

To obtain the non-oxidizing atmosphere, an inert gas can be used. For the inert gas, it is possible to use nitrogen gas, helium gas, argon gas, carbon-rich gas, and the like. Industrially, it is advantageous to perform the heat treatment while inflowing a nitrogen gas from the perspective of cost performance, and it is possible to obtain an atmosphere having stable properties.

The temperature used in the heat treatment is preferably 350° C. to 750° C., and more preferably 400° C. to 700° C. When the temperature is too low or too high, the desired conductivity is hardly obtained. When the heating time is too short, there is no effect of heating, and when the heating time is too long, any further effect cannot be expected. Thus, the heating time is preferably 15 minutes to 4 hours, and more preferably 1 hour to 2 hours.

It is preferred that the particles in the coating layer comprise non-conductive particles. This allows assuring flexibility of components of the coating layer, and the surface shape of the carrier, and physical properties of the coating layer are easily and arbitrarily controlled. In other words, by using conductive particles in combination with non-conductive particles in a well-balanced manner, it is possible to control the resistance while keeping the film strength of the coating layer and the surface shape of the carrier.

Examples of the non-conductive particles include inorganic oxide particles, resin fine particles, and the particles used as the base of the conductive particles, however, they are not particularly limited to the stated above. In addition, from the perspective of further uniformization of the components used in the coated resin, it is preferred that the same particles as those used for the base of the conductive particles be used in the coating layer.

The non-conductive particles mean particles having a volume resistivity value greater than that of the conductive particles described above, namely, those having a volume resistivity value greater than 500 Ω·cm, and the definition of the non-conductive particles in the present invention differs from the definition of generally used non-conductive particles.

Particles included in the coating layer having a relation between an average primary particle diameter (D) and a thickness of the coating layer (h) being $1<[D/h]<10$ enables improving the following effects remarkably. Since the particles included in the coating layer having a relation between an average primary particle diameter (D) and a thickness of the coating layer (h) being $1<[D/h]<10$ are more convex compared to the coating layer, it is possible to mitigate the contact associated with a high impulsive force to the binder resin in friction with toner particles and in friction among carrier particles at the time of agitating the developer to generate frictional electrification thereof. This enables preventing exfoliation of the film of the binder resin from which charge is generated.

Further, in the particles having a relation between an average primary particle diameter (D) and a thickness of the coating layer (h) being $1<[D/h]<10$, a number of particles being more convex than the coating layer reside on the surface of the carrier. Therefore, a cleaning effect of effectively removing components of toner-spent adhered on the carrier surface in frictional contact among carrier particles can also be exerted, and toner-spent can be prevented. When the value of [D/h] is 1 or less, it is unfavorable because the particles are embedded in the binder resin, and the effect is significantly reduced. When the value of [D/h] is more than 10, it is unfavorable because the contact surface area between the particles and the binder resin is small and a sufficient binding force cannot be obtained, and thus the particles are easily exfoliated from the coating layer.

The content of the particles is preferably 10% by mass to 70% by mass. When the content is less than 10% by mass, it is unfavorable because the proportion of the particles on the surfaces of the carrier particles is excessively low compared to the proportion of the binder resin, and the effect of mitigating the contact associated with a high impulsive force to the binder resin is small, and thus sufficient durability cannot be obtained. On the other hand, when the content of the particles is more than 70% by mass, it is impossible to exert a sufficient charge ability, because the proportion of the particles on the surface of the carrier is excessively large compared to the proportion of the binder resin, and the proportion of the binder resin from which charge is generated is insufficient. Besides, the ability of the binder resin of holding the particles is insufficient because the amount of the particles is excessively large compared to the amount of the binder resin. In addition, it is unfavorable because the particles are easily liable to be exfoliated from the binder resin, and the variances in charged amount and resistance or the like are increased, and thus sufficient durability cannot be obtained.

Here, the content of the particles means a content of the summation of the conductive particles and the non-conductive particles, which is represented by the following Equation 1.

$$\text{Content of Particles (\% by mass)}=[\text{Amount of particles}\div(\text{Amount of particles}+\text{Total amount of solids of coated resin})]\times 100 \quad \text{Equation 1}$$

The surface coverage of the particles to the core material is preferably 30% to 90%, more preferably 40% to 80%, and more preferably 45% to 75%.

When the surface coverage is less than 30%, a sufficient effect of removing components of toner-spent cannot be obtained, causing a reduction in the charged amount, because the amount of concavoconvex formed on the surface of the carrier is small. In addition, there is a large amount of resin portions on the surface of the carrier, and thus a large amount of exfoliated film, which is also attributable to a reduction in the charged amount. On the other hand, when the surface coverage is more than 90%, the particles almost fully cover the surface of the core material, and the carrier has many parts being under a condition where the conductive fine particles and the inorganic fine particles are formed in a laminar structure. There is no problem with it in the early stage of image formation, however, with increased in number of copied sheets, the amount of exfoliation of the coated conductive fine particles and the inorganic fine particles is increased, and then the variance in resistance is increased, and it is impossible to adequately exert resistance controlling effect. In addition, the coating layer is exfoliated together with the fine particles, a reduction in the charged amount may arise.

Here, the surface coverage means a surface coverage of the particles in the coating layer relative to the core material, which is represented by the following Equation 1.

$$\text{Surface Coverage}=(Ds*\rho s*W)/(4*Df*\rho f)*100 \quad \text{Equation 1}$$

In Equation 1, Ds represents a particle diameter of the carrier core material, ρs represents an absolute specific gravity of the carrier core material, W represents a percentage of the added amount of material of the particles in the coating layer relative to the amount of the carrier core material (conductive particles and inorganic oxide particles said in the present invention and does not include materials of particles having an average particle diameter smaller than the thickness of the resin used in the coating layer), Df represents a particle diameter of the material of the particles, and ρf represents an absolute specific gravity of the material of the particles.

Binder Resin

For the binder resin, at least one selected from silicone resins and acrylic resins is preferably used.

When the binder resin is a silicone resin, it is possible to obtain an effect of hardly promoting the accumulation of components of toner-spent caused due to occurrence of the film-exfoliation, because a silicone resin generally has a low surface energy, and thus it is hard to cause a toner-spent.

When the binder resin is an acrylic resin, it is possible to keep the coating layer in a stable condition as well as to solidly hold the particles included in the coating layer such as the conductive particles by effect of its strong adherence, because an acrylic resin generally has a strong adherence, a low brittleness, and a very excellent abrasion-resistant property, and thus deteriorations such as exfoliation of the coating layer, and film-exfoliation are hardly occur. Particularly, it is possible to strongly exert an effect of holding the particles having a diameter greater than the thickness of the coating layer.

By using an acrylic resin and/or a silicone resin for the binder resin, effects of improving the carrier are remarkably exerted. As described above, an acrylic resin generally has a strong adherence and a low brittleness, and thus it has excellence in abrasion-resistant property, however, at the same time, it has a high surface energy, and thus it may cause problems such as a reduction in charge which is caused by accumulation of components of toner-spent when used in combination with a toner which is easily liable to cause a toner-spent. In this case, the problem can be resolved by using an acrylic resin in combination with a silicone resin of which the toner components are hardly spent because of its low surface energy, and accumulation of components of toner-spent caused due to exfoliation of film is hardly promoted. However, a silicone resin has a disadvantage that abrasion-resistant property is poor because of its high adherence and low brittleness. Therefore, it is important to obtain these two types of resin properties in a well-balanced manner, and this makes it possible to obtain a coating layer that hardly cause a toner-spent, however, has abrasion-resistant property.

The silicone resin is not particularly limited, and may be suitably selected from those known in the art in accordance with the intended use. Examples thereof include straight silicone resins comprising only an organosiloxane bond, and silicone resins which are modified with alkyd resins, polyester resins, epoxy resins, acrylic resins, and urethane resins.

For the silicone resin, commercially available ones can be used. Examples of the straight silicone resins include KR271, KR255, and KR152 manufactured by Shin-Etsu Chemical Co., Ltd.; and SR2400, SR2406, and SR2410 manufactured by TORAY DOW CORNING CO., LTD.

Examples of the modified silicone resins include KR206 which is modified with an alkyd resin, KR5208 which is modified with an acrylic resin, ES1001N which is modified with an epoxy resin, KR305 which is modified with a urethane resin, manufactured by Shin-Etsu Chemical Co., Ltd.; and SR2115 which is modified with an epoxy resin, and SR2110 which is modified with an alkyd resin, manufactured by TORAY DOW CORNING CO., LTD.

Each of these silicone resins may be used alone or may be used in combination with a component capable of cross-linking reaction, a component capable of controlling the charged amount or the like.

The acrylic resin is not particularly limited, and may be suitably selected from all the resins which comprise an acrylic component in accordance with the intended use. Each of the acrylic resins may be used alone, and one or more of the other components capable of cross-linking reaction may also be used at the same time. Examples of the other components capable of cross-linking reaction include amino resins, acid catalysts, however, they are not limited to the stated above. The amino resins mean guanamine resins and melamine resins, however, they are not limited to the above stated. For the acid catalyst said in the present invention, all the acid catalysts having catalytic influence may be used. Examples of the acid catalysts include completely alkylated catalysts, and acid catalysts having a reactive group such as methylol group type, imino group type, and methylol and imino group type.

For the binder resin, besides the above-mentioned resins, resins which are typically used as a coated resin for carrier may be used in accordance with the necessity. Examples thereof include polyvinyl resins, polystyrene resins, halogenated olefin resins, polyester resins, polycarbonate reins, polyethylene resins, polyvinyl fluoride resins, polyvinylidene fluoride resins, polytrifluoroethylene resins, polyhexafluoropropylene resins, copolymers of vinylidene fluoride and vinyl fluoride, fluoroterpolymers such as terpolymer of tetrafluoroethylene, vinylidene fluoride and nonfluoride monomer. Each of these resins may be used alone or in combination with two or more.

The content of the binder resin is preferably 0.1% by mass to 1.5% by mass. When the content is less than 0.1% by mass, there is almost no coating layer on the carrier surface. It is unfavorable because the effect of the coating layer cannot be exerted sufficiently. On the other hand, when the content is more than 1.5% by mass, the amount of film exfoliation tends to increase with increased thickness thereof, however, the reason is not limited to the stated above.

Here, the content of the binder resin is represented by the following Equation 2.

$$\text{Content of Binder Resin (\% by mass)}=[\text{Total amounts of solids of coated resin}\div(\text{Total amount of solids of coated resin}+\text{Amount of core material})]\times 100 \quad \text{Equation 2}$$

In Equation 2, the total amount of solids of coated resin means the total amount of the resin (binder resin) alone in the coating layer.

<Core Material>

The core material is not particularly limited, may be suitably selected from those known as a two component carrier for electrophotography in the art in accordance with the intended use, and examples thereof include ferrite, magnetite, iron, and nickel. Among them, ferrite particles are particularly preferable in that high-effect is easily obtained. Ferrite particles have a large variation in shape, however, by restraining the variation in shape, it is possible to control the shape within the above-noted range.

The ferrite particles are not particularly limited, may be suitably selected from those used as a two-component carrier for electrophotography in accordance with the intended use, however, in consideration of remarkably evolving environmental aspect of recent years, for example, Mn ferrite particles, Mn—Mg ferrite particles, and Mn—Mg—Sr ferrite particles are preferably used, not conventionally used copper-zinc ferrites.

The volume resistivity value of the carrier is preferably 10[Log(Ω·cm)] to 16 [Log(Ω·cm)]. When the volume resistivity value is less than 10 [Log(Ω·cm)], the carrier may adhere on non-image part, and when the volume resistivity value is more than 16[Log(Ω·cm)], the edge effect may degrade to an unacceptable level. It should be noted that when the volume resistivity value falls below the measurable lower limit value of a high-resist meter, the volume resistivity value of the carrier cannot be obtained, and therefore, the high-resist meter is regarded as being virtually broken down.

Figure 9:
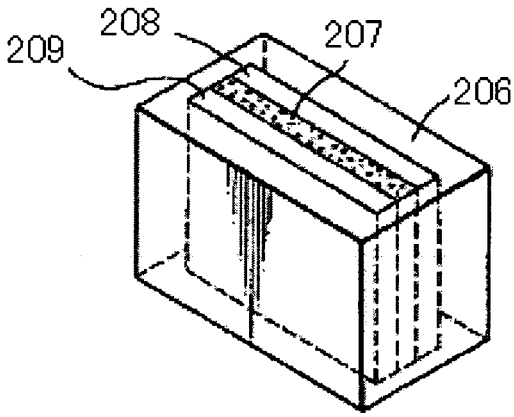
FIG. 9 is an illustration of the measurement method of the volume resistivity value of the carrier used in the present invention.

Here, the volume resistivity value of the carrier was measured as shown in FIG. 9. First, carrier 207 was filled in cell 206 comprising a fluorine resin container in which electrodes 208 and 209 having a surface area of 2.5 cm×4 cm were set inside thereof with a distance between the electrodes of 0.2 cm, and the cell was tapped under the conditions of height of fall: 1 cm, tapping speed: 30 times/minute, and taping times: 10 times. Next, a direct current voltage of 1,000 V was applied to between the electrodes, the resistivity value 30 seconds later of the application was measured by High-Resistance Meter 4329 A (manufactured by YOKOGAWA HEWLETT PACKARD Inc.), the obtained resistivity value (r) was calculated by using the following equation, and the calculated value was taken as volume resistivity value (R).

$$R=\text{Log}[r\times(2.5\text{ cm}\times 4\text{ cm})\div 0.2\text{ cm}][\text{Log}(\Omega\cdot\text{cm})]$$

The volume average particle diameter of the carrier is preferably 20 μm to 65 μm. When the volume average particle diameter is less than 20 μm, uniformity of the particles may degrades, and problems with carrier adhesion or the like may arise, because technologies that can make full use of such particles have not been achieved yet. When the volume average particle diameter is more than 65 μm, reproductivity in details of image parts is poor, and fine images may not be obtained.

By defining the magnetic moment at 1,000 ($10^3/4\pi\cdot A/m$) (1 KOe) of the carrier in the range from 40 ($Am^2/kg$) to 90 ($Am^2/kg$), the dispersion of toner into carrier or developer is quickly and excellently done because a holding force among carrier particles is properly maintained, and thus the effect of the carrier is remarkably improved. However, when the magnetic moment at 1 KOe is less than 40 $Am^2/kg$, it is unfavorable because carrier adhesions arise due to lack of magnetic moment. When the magnetic moment at 1 KOe is more than 90 $Am^2/kg$, standing magnet brush of the developer formed in developing process are exceedingly stiff, and it is unfavorable because the reproductivity in details of image parts is poor, and fine images cannot be obtained.

(Developer)

The developer of the present invention comprises the carrier of the present invention and a toner which contains at least a binder resin and a colorant.

The mixture ratio and the toner to the carrier in the developer is preferably 1 part by mass to 10.0 parts by mass of the toner relative to 100 parts by mass of the carrier.

In the toner, the surfaces of the toner base particles are fluoridated, and the content of the fluorine atoms which are detected by X-ray photoelectron spectroscopy (XPS) and are dependant on the fluorine-containing compound is preferably 2 atomic % to 10 atomic %, more preferably 3 atomic % to 8 atomic %, and still more preferably 4 atomic % to 6 atomic %. The flowability and charge property of the toner base particles can be improved because the toner has been subjected to a surface treatment with the fluorine-containing compound, and it is possible to prevent transition of additives onto the carrier surface. By providing with a treatment with a fluorine-containing compound on the surfaces of the toner base particles, an extremely small amount of fluorine is spent on the carrier surface, and then it is possible to prevent the toner additives from adhering on the carrier surface. Particularly when a titanium oxide is spent on the carrier surface, it degrades the charge ability of the carrier. Further, it is important to control the content of fluorine atoms being dependant on the fluorine-containing compound within the above-mentioned range.

When the content of the fluorine atoms is less than 2 atomic %, the effect of preventing the spent additives cannot be sufficiently obtained, a reduction in the charged amount may arise. When the content of the fluorine atoms is more than 10 atomic %, adhesion of toner additives can be prevented, however, the spent amount of the fluorine-containing compound to the carrier surface increases, and this may also lead to a reduction in the charged amount.

Here, for the measurement method of the amount of fluorine, for example, X-ray photoelectron spectroscopy (XPS) is used. Especially, the closest area of several nanometers of the toner surface is measured. The measurement method based on the photoelectron spectroscopy (XPS), measurement unit type, and measurement conditions are not particularly limited, provided that similar results can be obtained, however, the following conditions are preferable.

[Measurement Conditions]

Measuring apparatus: X-ray photoelectron spectrometer 1600S, manufactured by Philips Electronics N.V.

X-ray source: MgKα (400 W)

Analyzed area: 0.8 mm×2.0 mm

Pretreatment: The sample was placed on an aluminum tray, and the tray was bonded to the sample holder with a carbon sheet to thereby measure the amount of fluorine atoms of toner.

Calculation of Surface Atomic Percentage: Relative sensitivity factor provided by Philips Electronics N.V. was used.

It is noted that the result was represented by atomic %.

For the fluorine compound, any of organic compounds and inorganic compounds can be used as long as the compound comprises fluorine atom, and there is no other limitation except for the stated above. Among the fluorine compounds, the compounds represented by Formula (I) are more preferably used.

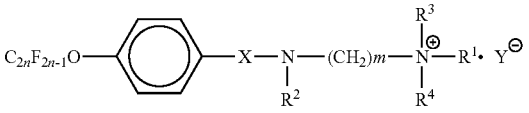

In Formula (I), X represents —$SO_2$— or —CO—, $R^1$, $R^2$, $R^3$, and $R^4$ individually represent a group selected from hydrogen atoms, alkyl groups having 1 to 10 carbon atoms, and allyl groups. Y represents an iodine atom, a bromine atom, or a chlorine atom, m represents a number from 1 to 10, and n represents an integral number of 1 to 10.

When a quaternary ammonium salt represented by Formula (I) is used in combination with an azo dye containing metal, it is preferable in terms of controllability of charge.

Typically used specific examples of compounds represented by Formula (I) include fluorine-containing compounds (1) to (27) as shown below, and all of the compounds are whitish or light yellow in color. In addition, it is preferred that Y be iodine atom.

(1)

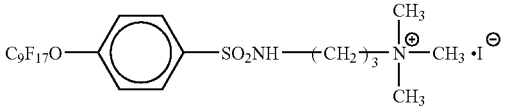

(2)

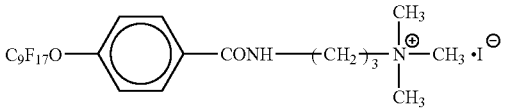

(3)

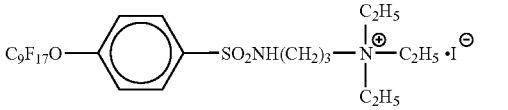

(4)

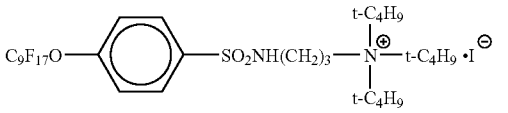

-continued (5)

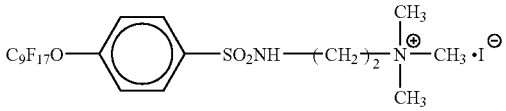

(6)

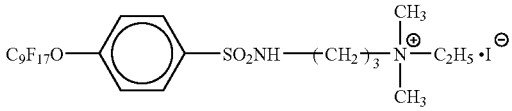

(7)

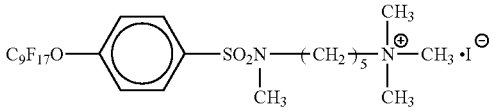

(8)

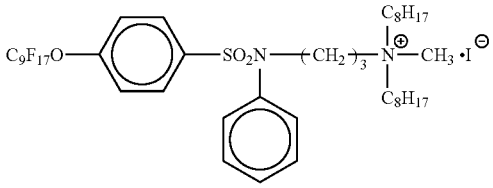

(9)

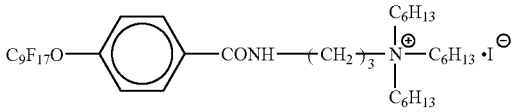

(10)

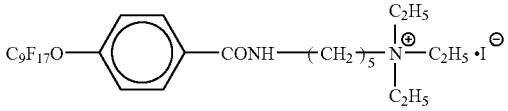

(11)

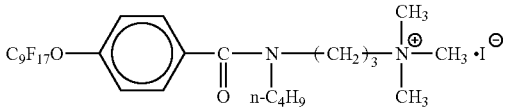

(12)

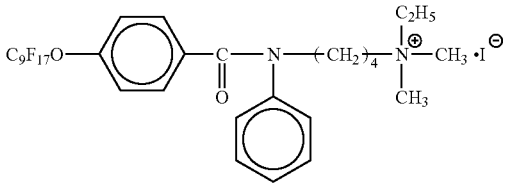

(13)

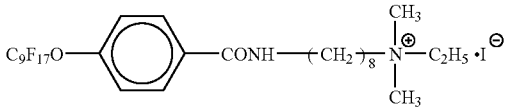

(14)

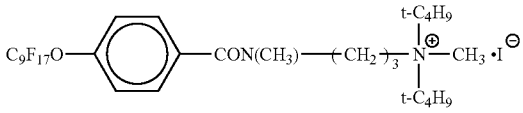

-continued (15)

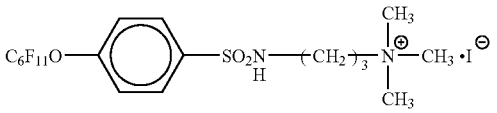

(16)

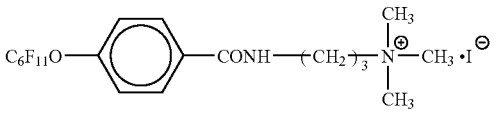

(17)

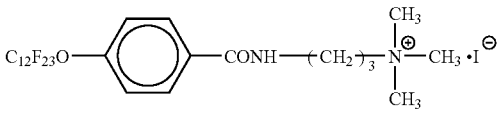

(18)

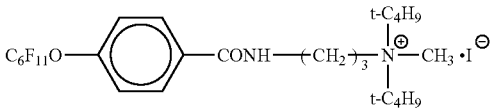

(19)

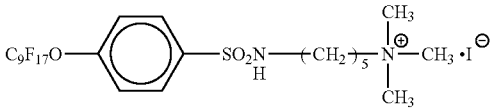

(20)

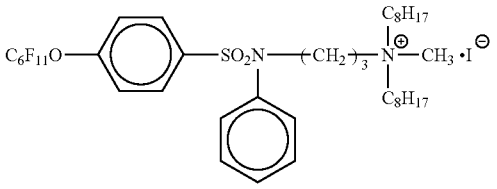

(21)

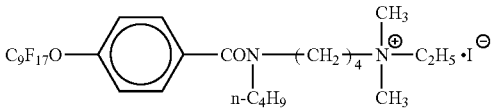

(22)

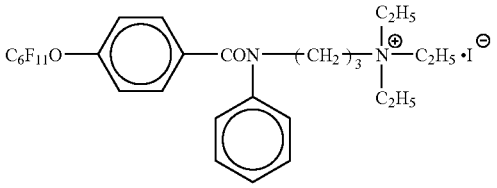

(23)

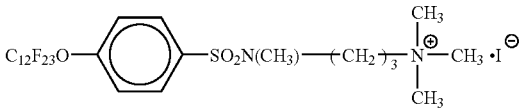

(24)

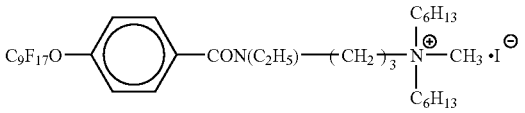

-continued (25)

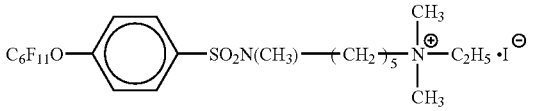

(26)

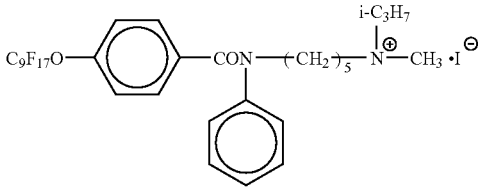

(27)

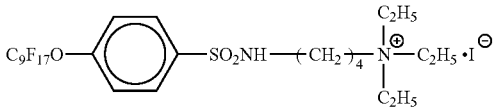

Among the above compounds, N,N,N,-trimethyl-[3-(4-perfluorononenyl oxybenzamide)propyl]ammonium=iodide is more preferably used in terms of capability of providing charges. In addition, mixtures of the compounds and other fluorine-containing compounds are more preferably used.

As a method for subjecting a toner to a surface treatment with a fluorine-containing compound, there is a method in which toner base particles before adding inorganic fine particles are dispersed in an aqueous solvent in which a fluorine-containing compound is dispersed (water containing surfactant is also preferably used), the fluorine-containing compound is made to adhere on the toner surface, the solvent is removed, and then the solution is dried to thereby obtain toner base particles. However, the method is not limited to the stated above.

The toner is preferably a color toner. This is because the carrier of the present invention does not contain carbon black in the coating layer, and smears of images caused by carbon black associated with film-exfoliation do not occur. Thus, the carrier is extremely suitable to a color developer of which color reproductivity is emphasized. The color toner said herein means not only color toners which are typically used in monochrome color but also color toners which are used as a full-color toner such as yellow toner, magenta toner, cyan toner, red toner, green toner, and blue toner.

The toner includes all the generally used toners, regardless of the type of monochrome toner, color toner, or full-color toner. For example, it includes kneaded and crushed type toners which are conventionally used, and a variety of polymerized toners which have been increasingly used in recent years. Further, so-called oil-less toners in which a releasing agent is included can also be used. Since an oil-less toner typically contains a releasing agent, a so-called spent, which is a phenomenon that the releasing agent transfers to the carrier surface, easily occur, however, the carrier of the present invention can keep the excellent quality for a long period of time because it excels in anti-spent property. Particularly, in an oil-less full-color toner, it is generally said that it is easily liable to go through a spent, because a binder resin used therein is soft, however, it can be said that the carrier of the present invention is extremely suitable for oil-less full-color toners.

The binder resin used in the toner is not particularly limited and may be suitably selected from those known in the art in accordance with the intended use. Examples of the binder resin include styrenes such as polystyrenes, poly-p-chlorostyrenes, and polyvinyl toluenes or monopolymers of derivative substitution thereof; styrene copolymers such as styrene-p-chlorostyrene copolymers, styrene-propylene copolymers, styrene-vinyltoluene copolymers, styrene-methyl acrylate copolymers, styrene-ethyl acrylate copolymers, styrene-methyl methacrylate copolymers, styrene-ethyl methacrylate copolymers, styrene-butyl methacrylate copolymers, styrene-α-methyl chloromethacrylate copolymer, styrene-acrylonitrile copolymers, styrene-vinylmethyl-ether copolymers, styrene-vinylmethyl-keton copolymers, styrene-butadiene copolymers, styrene-isopropyl copolymers, and styrene-maleic acid ester copolymers; polymethyl methacrylates, polybutyl methacrylates, polyvinyl chlorides, polyvinyl acetates, polyethylenes, polyesters, polyurethanes, epoxy resins, polyvinyl butyrals, polyacrylic resins, rosins, modified rosins, terpene resins, phenol resins, aliphatic hydrocarbon resins, aromatic hydrocarbon resins, and aromatic petroleum resins.

The binder resin for pressure-fixing is not particularly limited and may be suitably selected from those known in the art. Examples thereof include polyolefins such as low-molecular mass polyethylenes, and low-molecular mass polypropylenes; olefin copolymers such as copolymers of ethylene-acrylic acid ester, copolymers of styrene-methacrylic acid, copolymers of ethylene-methacrylic acid ester, ethylene-vinyl chloride, ethylene-vinyl acetate, ionomer resins; epoxy resins, polyester resins, styrene-butadiene copolymers, polyvinyl pyrolidones, vinylmethyl ether-maleic anhydride, maleic acid-modified phenol resins, and phenol-modified terpene resins.

For colorants used in the toners such as color toners, it is possible to use all the pigments and dyes known in the art by which individual color toners of yellow, magenta, cyan, and black can be obtained, the colorants are not limited to those described in the present invention. Each of these colorants may be used alone or in combination with two or more.

Examples of yellow pigments or dyes include cadmium yellow, mineral fast yellow, nickel titanium yellow, navels yellow, polyazo yellow, oil yellow, Hansa yellow (GR, A, RN, R), pigment yellow L, benzidine yellow (G, GR), permanent yellow (NCG), vulcan fast yellow (5G, R), tartrazinelake yellow, quinoline yellow lake, anthrasan yellow BGL, isoindolinon yellow, naphthol yellow S, Hanza yellow G, Hanza yellow G, Hanza yellow 10G, benzidine yellow GR, quinoline yellow lake, permanent yellow NCG, and Tartradine lake.

Examples of orange color pigments and dyes include molybdenum orange, permanent orange GTR, pyrazolone orange, vulcan orange, indanthrene brilliant orange RK, benzidine orange G, and indanthrene brilliant orange GK.

Examples of red pigments and dyes include colcothar, cadmium red, permanent red 4R, lithol red, pyrazolone red, washing red calcium salt, lake red D, brilliant carmine 6B, eosin lake, rhodamine lake B, alizarin lake, and brilliant carmine 3B.

Examples of violet pigments and dyes include fast violet B, and methyl violet lake.

Examples of blue pigments and dyes include cobalt blue, alkali blue lake, Victoria blue lake, phthalocyanine blue, metal-free phthalocyanine blue, phthalocyanine blue part-chlorinated pigments, fast sky blue, and indanthrene blue BC.

Examples of green pigments and dyes include chrome green, chromium oxide, pigment green B, naphthol green B, and malachite green lake.

Examples of black pigments and dyes include azine pigments and dyes such as carbon black, oil farness black, channel black, lamp black, acetylene black, aniline black; metal salt azo dyes, metal oxides, and composite metal oxides.

Further, besides the binder resins and the colorants, a fixing auxiliary agent can be included in the toner used in the present invention. By including a fixing auxiliary agent, it is also possible to use the toner in fixing systems, so-called oil-less system in which oil for preventing toner fixation is not applied to a fixing roll. For example, it is possible to use polyolefins such as polyethylenes, and polypropylenes; fatty acids of metal salts, fatty acid esters, paraffin waxes, amide waxes, polyvalent alcohol waxes, silicone varnishes, carnauba waxes, and ester waxes, and the fixing auxiliary agents are not limited to the stated above.

In the toner of the present invention such as color toners, a charge controlling agent can be included in accordance with the intended use. Examples of the charge controlling agent include nigrosine, azine pigments and dyes containing an alkyl group having carbon atoms of 2 to 16 (Japanese Patent Application Publication (JP-B) No. 42-1627), basic pigments and dyes such as C. I. Basic Yellow 2 (C. I. 41000), C. I. Basic Yellow 3, C. I. Basic Red 1 (C. I. 45160), C. I. Basic Red 9 (C. I. 42500), C. I. Basic Violet 1 (C. I. 42535), C. I. Basic Violet 3 (C. I. 42555), C. I. Basic Violet 10 (C. I. 45170), C. I. Basic Violet 14 (C. I. 42510), C. I. Basic Blue 1 (C. I. 42025), C. I. Basic Blue 3 (C. I. 51005), C. I. Basic Blue 5 (C. I. 42140), C. I. Basic Blue 7 (C. I. 42595), C. I. Basic Blue 9 (C. I. 52015), C. I. Basic Blue 24 (C. I. 52030), C. I. Basic Blue 25 (C. I. 52025), C. I. Basic Blue 26 (C. I. 44045), C. I. Basic Green 1 (C. I. 42040), and C. I. Basic Green 4 (C. I. 42000), lake pigments of basic dyes thereof, C. I. Solvent Black 8 (C. I. 26150); quaternary ammonium salts such as benzoilmethylhexadecyl ammonium chloride, decyltrimethyl chloride; or dialkyltin compounds such as dibutyl or dioctyl; dialkyltin borate compounds; guanidine derivatives; vinylpolymers containing an amino group; polyamine resins such as condensation polymers containing an amino group; metallic complex salts of monoazo dyes disclosed in Japanese Patent Application Publication (JP-B) Nos. 41-20153, 43-27596, 44-6397, and 45-26478; metallic complexes of salicylic acids, dialkyl salicylic acids, naphthoic acids, dicarboxylic acids with Zn, Al, Co, Cr, Fe, or the like which are disclosed in Japanese Patent Application Publication (JP-B) Nos. 55-42752, and 59-7385; sulfonated copper phthalocyanine pigments; organic boron salts; quaternary fluorine-containing ammonium salts; and calyx allene compounds. In color toners other than black toner, a charge controlling agent that impairs the intended colors should not be used, and white-color metallic salts of salicylic acid derivatives or the like are preferably used.

With respect to external additives used in the toner, the transferring property and durability of the toner are further improved by externally adding inorganic fine particles and resin fine particles of silicas, titanium oxides, aluminas, silicon carbides, silicon nitrides, boron nitrides or the like in the toner base particles. The effect of further improving the transferring property and durability of toner can be obtained by covering over a wax or waxes which may degrade the transferring property and durability of the toner with these external additives and by making the toner surface covered with fine particles to reduce the contact surface area of the toner. It is preferred that these inorganic fine particles have their surfaces hydrophobized, and metal oxide fine particles such as silicas and titanium oxides having their surfaces hydrophobized are preferably used.

For the resin fine particles, polymethyl methacrylate fine particles and/or polystyrene fine particles having an average particle diameter 0.05 μm to 1 μm which are obtained by a soap-free emulsion polymerization are preferably used.

Further, it is possible to obtain a toner which excels also in stability of charge relative to humidity by using a hydrophobized silica and a hydrophobized titanium oxide in combination with the above resin fine particles and making the externally added amount of the hydrophobized titanium oxide greater than that of the hydrophobized silica.

The durability of toner can be improved by adding an external additive having a particle diameter greater than those of the conventionally used external additives, like a silica having a specific surface area of 20 $m^2/g$ to $50^2/g$, and resin fine particles having an average particle diameter of 1/100 to 1/8 of that of a toner, in combination with the inorganic fine particles. This is because of the following reason. An external additive such as metal oxide fine particles which are externally added to a toner tends to be embedded in the toner base particles in the course where the toner is mixed with a carrier in a developing unit, stirred, charged, and then used for developing, however, by externally adding an external additive having a particle greater than those of these metal oxide fine particles to the toner, it is possible to prevent the metal oxide fine particles from being embedded to the toner base particles. With a toner that the inorganic fine particles and the resin fine particles are internally added therein, the effect of preventing the embedding of the metal oxide fine particles in the toner base particles are more reduced than a toner in which these fine particles are externally added to the toner, however, internally adding these fine particles to a toner enables improving transferring property and durability of the toner as well as its crushability. In addition, by externally adding the inorganic fine particles and the resin fine particles and internally adding these fine particles to a toner at the same time, it is possible to obtain a toner having excellent transferring property with stability, and the durability of the toner can be improved.

Examples of hydrophobizing agent include dimethyldichlorosilane, trimethyldichlorosilane, methyltrichlorosilane, allyldimethyldichlorosilane, allylphenyldichlorosilane, benzyldimethyldichlorosilane, brommethyldimethyldichlorosilane, α-chloroethyltrichlorosilane, p-chloroethyltrichlorosilane, chloromethyldimethyldichlorosilane, chloromethyltrichlorosilane, p-chlorophenyltrichlorosilane, 3-chloropropyltrichlorosilane, 3-chloropropyltrimethoxysilane, vinyltriethoxysilane, vinylmethoxysilane, vinyl-tris(β-methoxyethoxy)silane, γ-methacryloxypropyltrimethoxysilane, vinyltriacetoxysilane, divinyldichlorosilane, dimethylvinylchlorosilane, octyltrichlorosilane, decyltrichlorosilane, nonyl-trichlorosilane, (5-t-propylphenyl)-trichlorosilane, (4-t-butylphenyl)-trichlorosilane, dibentyl-dichlorosilane, dihexyl-dichlorosilane, dioctyldichlorosilane, dinonyl-dichlorosilane, didecyldichlorosilane, didodecyldichlorosilane, dihexadecyl-dichlorosilane, (4-t-butylphenyl)-octyldichlorosilane, dioctyldichlorosilane, didecenyl-dichlorosilane, dinonenyl-dichlorosilane, di-2-ethylhexyldichlorosilane, di-3, 3-dimethylbentyl-dichlorosilane, trihexyl-chlorosilane, trioctylchlorosilane, tridecylchlorosilane, dioctylmethyldichlorosilane, octyldimethyldichlorosilane, (4-t-propylphenyl)-diethyl-chlorosilane, octyltrimethoxysilane, hexamethyldisilasan, hexamethyldisilasan, diethyltetramethyldisilasan, hexaphenyldisilasan, and hexatolyldisilasan. Besides, titanate coupling agents, aluminum coupling agents can also be used. In addition, as external additives for the purpose of improving cleaning ability, lubricants such as fine particles made from fatty acid metal salts and polyvinylidene fluoride are also usable at the same time.

For the toner production method, all the conventionally used methods known in the art such as crushing method, and polymerization method can be employed. For example, for the kneader of toner using a crushing method, batch-type two rollers, Banbury Mixer, continuous two-axis extruders, for example, KTK type two-axis extruder manufactured by KOBE STEEL, LTD.; TEM type two-axis extruder manufactured by TOSHIBA MACHINE CO., LTD.; two-axis extruder manufactured by KCK; PCM type two-axis extruder manufactured by IKEGAI, LTD.; KEX type two-axis extruder manufactured by KURIMOTO, LTD.; and continuous type uniaxis extruder such as Co-kneader manufactured by BUSS are preferably used. The thus obtained molten and kneaded material is cooled and crushed. The obtained material is coarsely crushed by using, for example, a hummer mill and Rotoplex. Further, pulverizers using a jet stream, mechanical pulverizers or the like can also be used for the crushing.

Preferably, the toner material is crushed so as to have an average particle diameter of 3 μm to 15 μm. Further, the crushed material is preferably classified by a wind-force type classifier so as to have a grain size of 5 μm to 20 μm. Next, in the process of externally adding external additives to the toner base, the external additives are coated on the toner surface while being fused and broken by mixing the toner base and the additives using a mixer and the like and agitating them. At that time, it is important in terms of durability to make the additives such as inorganic fine particles and the resin fine particles uniformly and solidly adhered on the surface of the toner base. It should be understood that the above-mentioned is not construed as being limited thereto.

Examples of the polymerization include suspension polymerization method, emulsion polymerization method, and dissolved suspension elongation method.

In the suspension polymerization, colorants, releasing agents or the like are dispersed in an oil-soluble polymerization initiator and a polymerizable monopolymer, and then the mixture are emulsified and dispersed in an aqueous medium containing surfactants, and solid dispersing agents or the like by the emulsification method that will be described hereinafter. Thereafter, the emulsion is subjected to a polymerization reaction to granulate it, and then the polymerized emulsion is to be subjected to a wet treatment to have the inorganic fine particles adhered on the surfaces of the toner particles of the present invention. Here, it is preferred that the toner particles of which an excessive amount of surfactants or the like have been washed and removed be subjected to the wet treatment.

Examples of the polymerizable monopolymer include acids such as acrylic acids, methacrylic acids, α-cyanoacrylic acids, α-cyanomethacrylic acids, itaconic acids, crotonic acids, fumaric acids, maleic acids, and maleic anhydrides; acryl amides, methacryl amides, diacetone acrylic amide acids, or methylol compounds thereof; vinyl pyridines, vinyl pyrrolidone, vinyl imidazole, and ethylene imine, and acrylates or methacrylates having an amino group such as dimethylaminoethyl methacrylate. By using the polymerizable monomer in part, a functional group can be introduced to the surfaces of the toner particles.

For the dispersing agent for use, by selecting a dispersing agent having an acid group and/or a basic group, the dispersing agent can be absorbed in and reside on the surfaces of the particles to thereby introduce a functional group.

For the emulsion polymerization method, a water-soluble polymerization initiator and a polymerizable monopolymer are emulsified in water using a surfactant to synthesize a latex by means of a typically used emulsion polymerization method. Separately, a dispersion of which colorants, releasing agents or the like are dispersed in an aqueous medium is prepared. The emulsion and the aqueous medium are mixed, and then flocculated to the extent where the particles have a particle size as much as toner particles, thereafter, by heating the mixture to make it fused to thereby obtain a toner. Thereafter, the obtained toner is subjected to a wet treatment, which will be described hereinafter. For the latex, by using the one that is similar to a monomer usable in a suspension polymerization method, the functional group can be introduced to the surfaces of the toner particles.

When using the dissolved suspension elongation method, for example, a toner material which contains an active hydrogen group-containing compound and a polymer capable of reacting with the active hydrogen group-containing compound, colorants, and releasing agents was dissolved and dispersed in an organic solvent to prepare a toner solution. Then, the toner solution is emulsified and dispersed in an aqueous medium to prepare a dispersion liquid so that the active hydrogen group-containing compound is reacted with the polymer capable of reacting with the active hydrogen group-containing compound in the aqueous medium to form the adhesive base material into particles, and then the organic solvent is removed to thereby obtain a toner. The toner material comprises an adhesive base material which can be obtained by reacting an active hydrogen group-containing compound, a polymer capable of reacting with the active hydrogen group-containing compound, a binder resin, a releasing agent, and colorants, and further comprises other components such as resin fine particles, and charge controlling agents in accordance with the necessity.

(Developer Container)

The developer container of the present invention houses the developer of the present invention.

The developer container of the present invention is not particularly limited, may be suitably selected from those known in the art, and preferred examples thereof include the one having a developer container main body and a cap thereof.

The developer container main body is not particularly limited as to the size, shape, structure, material or the like and may be suitably selected in accordance with the intended use. For example, with respect to the shape, cylindrical form is preferably used. A container main body is particularly preferable in which spiral concavoconvexes are formed on the inner circumference surface such that the contents of toner can be moved to the side of a toner-discharge aperture by rotating the developer container main body, and a part of the spiral portion or the whole thereof have an accordion function.

The material of the developer container main body is not particularly limited, may be suitably selected in accordance with the intended use, however, the one having excellent dimensional accuracy is preferable. Examples of the material of the developer container include polyester resins, polyethylene resins, polypropylene resins, polystyrene resins, polyvinyl chloride resins, polyacrylic resins, polycarbonate resins, ABS resins, and polyacetal resins.

The developer container of the present invention is easily stored and transported, excels in handleability, and can be detachably mounted to the process cartridge, the image forming apparatus of the present invention or the like, which will be described hereinafter, to be suitably used for toner supplying.

Here, FIG. 1 is a schematic view exemplarily showing an example of the image forming apparatus of the present invention on which a developer container being filled with the developer of the present invention is mounted.

Developing section 1 mounted into the main body of the image forming apparatus is collected to developer container 2 in which the developer of the present invention to be supplied to the developer section 1 through developer send flow-unit 3 and connecting member 124. In FIG. 1, developing housing 4, stirring screws 5 and 6, developing roller 7, photoconductor 8, and doctor blade 9 are shown.

(Process Cartridge)

A process cartridge according to the present invention comprises an image bearing member configured to carry a latent electrostatic image, a developing unit configured to develop the latent electrostatic image carried on the image bearing member using a developer to form a visible image, and further comprises other units which are suitably selected in accordance with the necessity such as a charging unit, a transferring unit, a cleaning unit, and a charge elimination unit.

The developing unit comprises a developer container to house the toner and the developer; and a developer carrier configured to carry and transport the developer housed in the developer container and may further comprise a layer thickness controlling member or the like for controlling the thickness of the toner layer to be carried thereon.

The process cartridge of the present invention is preferably capable of being detachably mounted on various types of image forming apparatuses, and it is particularly preferable that the process cartridge is detachably mounted on an image forming apparatus of the present invention which will be described hereinafter.

Figure 2:
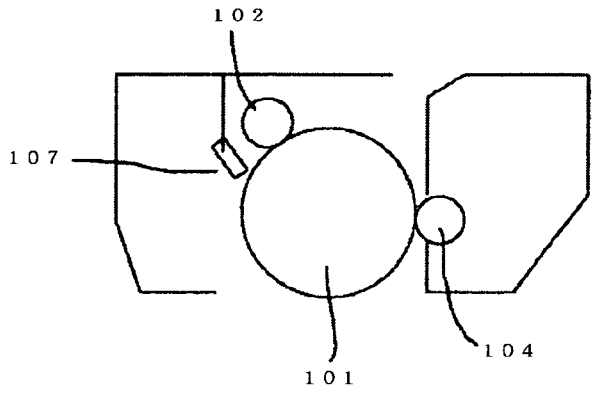
FIG. 2 is a schematic view exemplarily showing an example of the process cartridge of the present invention in which the developer of the present invention is used.
Figure 3:
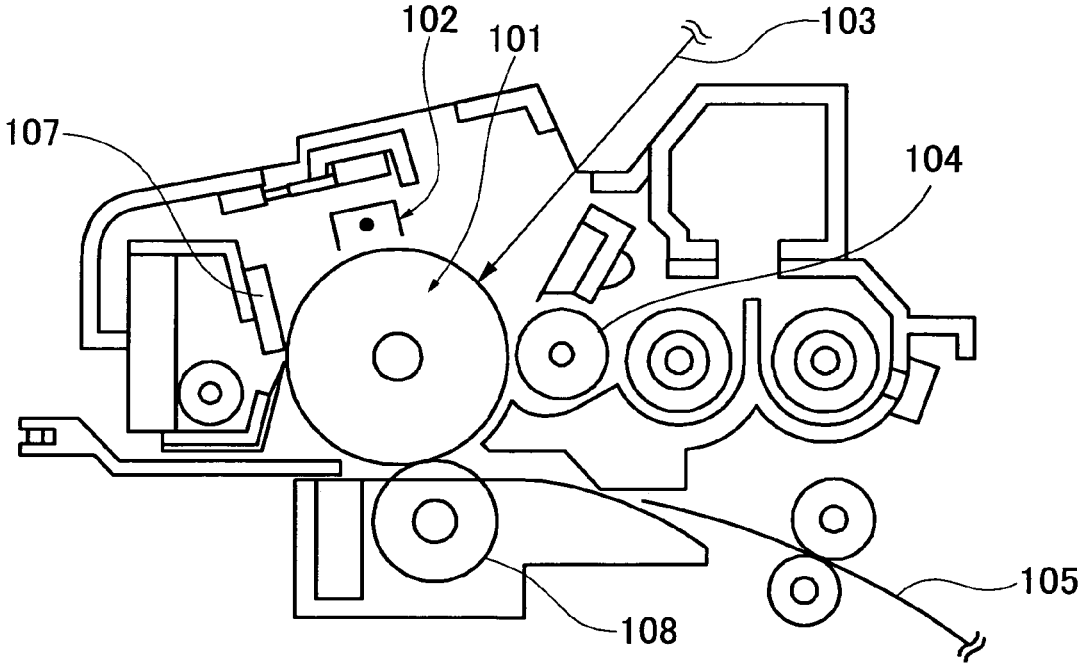
FIG. 3 is an illustration exemplarily showing an example of the process cartridge of the present invention.

Here, as shown in FIGS. 2 and 3, the process cartridge comprises photoconductor 101, charging unit 102, developing unit 104, and cleaning unit 107.

In addition, as shown in FIG. 3, the process cartridge incorporates photoconductor 101, comprises charging unit 102, developing unit 104, transferring unit 108, and cleaning unit 107, and further comprises other units in accordance with the intended use. In FIG. 2, the reference numeral 103 represents an exposure through an exposing unit, and 105 represents a recording medium.

For the photoconductor 101, the one same as used in the image forming apparatus can be used.

For the charging unit 102, an arbitrarily selected charge member is used.

Next, the image forming process using the process cartridge shown in FIGS. 2 and 3 will be described below. While the photoconductor 101 rotates in the direction indicated by the arrow, a latent electrostatic image corresponding to an exposed image is formed on the photoconductor 101 by a charge through the charging unit 102 and by exposure 103 through the exposing unit (not shown). The latent electrostatic image is developed to a toner image by the developing image 104, the developed toner image is transferred onto recording medium 105 by transferring unit 108 and then printed out. Next, the surface of the photoconductor after the image transfer is cleaned by cleaning unit 107 and then electric charge remaining on the surface of the photoconductor is eliminated by charge-eliminating unit (not shown). Thereafter, the above-noted operation is repeatedly performed again.

The image forming apparatus of the present invention may integrally comprise components such as the image bearing member, an image developer and a cleaner to constitute a process cartridge, and this unit may be detachably mounted to the main body of the image forming apparatus. Further, the image forming apparatus may integrally comprises an image bearing member together with at least one selected from a charger, an exposer, a developer, a transferer or a separator, and a cleaner to constitute a process cartridge which is formed in an integral unit to detachably mounted to the main body of the image forming apparatus using a guiding unit such as a rail laid in the main body.

(Image Forming Apparatus and Image Forming Method)

The image forming apparatus of the present invention comprises an image bearing member, a latent electrostatic image forming unit, a developing unit, a transferring unit, and a fixing unit and further comprises other units which are suitably selected in accordance with the necessity such as a charge elimination unit, a cleaning unit, a recycling unit, and a controlling unit.

The image forming method of the present invention comprises latent electrostatic image forming, developing, transferring, and fixing and further comprises other steps which are suitably selected in accordance with the necessity such as a charge elimination step, a cleaning step, a recycling step, and a controlling step.

The image forming method of the present invention can be suitably carried out by using the image forming apparatus of the present invention, and the latent electrostatic image forming can be performed by the latent electrostatic image forming unit, the developing can be performed by the developing unit, the transferring can be performed by the transferring unit, the fixing can be performed by the fixing unit, and other steps stated above can be performed by other units stated above.

Latent Electrostatic Image Forming and Latent Electrostatic Image Forming Unit

In the latent electrostatic image forming, a latent electrostatic image is formed on an image bearing member.

The latent image bearing (photoconductor) is not particularly limited as to the material, shape, structure, size, or the like, and may be suitably selected from those known in the art in accordance with the intended use. With respect to the shape, drum-shaped one is preferably used. Preferred examples of the material used for the latent image bearing member include inorganic photoconductors made from amorphous silicon, selenium, or the like, and organic photoconductors made from polysilane, phthalopolymethine, or the like. Among these materials, amorphous silicons or the like are preferably used in terms of longer operating life.

The latent electrostatic image can be formed, for example, by charging the surface of the image bearing member uniformly and then exposing the surface thereof imagewisely by means of the latent electrostatic image forming unit.

The latent electrostatic image forming unit includes, for example, at least a charger configured to uniformly charge the surface of the image bearing member, and an exposer configured to expose the surface of the image bearing member imagewisely.

The charging can be performed by applying a voltage to the surface of the image bearing member through the use of, for example, the charger.

The charger is not particularly limited, may be suitably selected in accordance with the intended use, and examples thereof include contact chargers known in the art, for example, which are equipped with a conductive or semi-conductive roller, a brush, a film, a rubber blade or the like, and non-contact chargers utilizing corona discharge such as corotoron and scorotoron.

The exposing can be performed by exposing the surface of the image bearing member imagewisely through the use of, for example, the exposer.

The exposer is not particularly limited, provided that the surface of the image bearing member which has been charged by the charger can be exposed imagewisely, may be suitably selected in accordance with the intended use, and examples thereof include various types of exposers such as reproducing optical systems, rod lens array systems, laser optical systems, and liquid crystal shutter optical systems.

In the present invention, the back light method may be employed in which exposing is performed imagewisely from the back side of the image bearing member.

Developing and Developing Unit

In the developing, the latent electrostatic image is developed using the developer to form a visible image.

The visible image can be formed by developing the latent electrostatic image using, for example, the developer by means of the developing unit.

The developing unit is not particularly limited, provided that latent electrostatic images can be developed using the developer of the present invention, may be suitably selected from those known in the art, and preferred examples thereof include the one having at least an image developing apparatus which houses the developer therein and enables supplying the developer to the latent electrostatic image in contact or in non-contact. An image developing apparatus which comprises the developer container of the present invention is more preferably used.

The image developing apparatus may employ a dry-developing process or a wet-developing process. It may be an image developing apparatus for monochrome color or multicolors. Preferred examples thereof include the one having a stirrer by which the developer is frictionally stirred to be charged, and a rotatable magnet roller.

In the image developing apparatus, for example, the toner and the carrier are mixed and stirred, the toner is charged by frictional force at that time to be held in a state where the toner is standing on the surface of the rotating magnet roller to thereby form a magnetic brush. Since the magnet roller is arranged near the image bearing member, a part of the toner constituting the magnetic brush formed on the surface of the magnet roller moves to the surface of the image bearing member (photoconductor) by electric attraction force. As a result, the latent electrostatic image is developed using the toner to form a visible toner image on the surface of the image bearing member (photoconductor).

Transferring and Transferring Unit

In the transferring, the visible image is transferred onto a recording medium, and it is preferably an aspect in which an intermediate transfer member is used, the visible image is primarily transferred to the intermediate transfer member and then the visible image is secondarily transferred onto the recording medium. An aspect of the transferring is more preferably in which two or more color toners are used, still more preferably a full-color toner is used, and the aspect comprises a primary transferring in which the visible image is transferred to an intermediate transfer member to form a composite transfer image, and a secondary transferring in which the composite transfer image is transferred onto a recording medium.

The transferring can be performed, for example, by charging the surface of the image bearing member (photoconductor) using a transfer-charger to transfer the visible image, and it is possible by means of the transferring unit. For the transferring unit, it is preferably an aspect which comprises a primary transferring unit configured to transfer the visible image to an intermediate transfer member to form to a composite transfer image, and a secondary transferring unit configured to transfer the composite transfer image onto a recording medium.

The intermediate transfer member is not particularly limited, may be suitably selected from those known in the art in accordance with the intended use, and preferred examples thereof include transferring belts.

The transferring unit comprising the primary transferring unit and the secondary transferring unit preferably includes at least an image-transferer configured to exfoliate the visible image formed on the image bearing member and transfer the visible image to the recording medium to be charged. For the transferring unit, there may be one transferring unit or two or more transferring units.

Examples of the image transferer include corona image transferers using corona discharge, transferring belts, transfer rollers, pressure transfer rollers, and adhesion image transfer units.

For the recording medium, regular paper is typically used, however, it is not particularly limited, provided that unfixed image after developing can be transferred thereto, may be suitably selected in accordance with the intended use, and recoding media such as PET base for OHP can also be used.

Fixing and Fixing Unit

In the fixing, a visible image which has been transferred onto a recording medium is fixed using an fixing unit, and the image fixing may be performed every time each color toner is transferred onto the recording medium or at a time so that each of individual color toners are superimposed at the same time.

The fixing unit is not particularly limited, may be suitably selected in accordance with the intended use, and heat and pressure units known in the art are preferably used. Examples of the heat and pressure units include a combination of a heat roller and a pressure roller, and a combination of a heat roller, a pressure roller, and an endless belt.

The heating temperature in the heat and pressure unit is preferably 80° C. to 200° C.

In the present invention, for example, an optical fixing unit known in the art may be used along with or instead of the fixing and the fixing unit.

Charge-Eliminating and Charge Elimination Unit

In the charge-eliminating, charge eliminated is performed by applying a charge-eliminating bias to the image bearing member, and it can be suitably performed by means of a charge-eliminating unit.

The charge-eliminating unit is not particularly limited and may be required only to have the ability for applying a charge-eliminating bias to the image bearing member, and may be suitably selected from charge-eliminating units known in the art. For example, a charge-eliminating lamp or the like is preferably used.

Cleaning and Cleaning Unit

In the cleaning, a residual toner remaining on the image bearing member is removed, and the cleaning is performed using a cleaning unit.

The cleaning unit is not particularly limited, provided that the residual toner remaining on the image bearing member can be removed and may be suitably selected from those known in the art. Examples of the cleaning unit include magnetic brush cleaners, electrostatic brush cleaners, magnetic roller cleaners, blade cleaners, brush cleaners, and web cleaners.

In the recycling, the developer that had been eliminated in the cleaning is recycled in the developing, and the recycling can be suitably performed by means of a recycling unit.

The recycling unit is not particularly limited, and examples thereof include carrying units known in the art.

In the controlling, the above-noted individual steps are controlled, and the controlling can be suitably performed by means of a controlling unit.

The controlling unit is not particularly limited, provided that it can control movements of the individual units, and may be suitably selected in accordance with the intended use. Examples thereof include equipment such as sequencers and computers.

An aspect of the image forming method of the present invention will be described with reference to FIG. 4 in which the image forming apparatus of the present invention is used.

Image forming apparatus 100 shown in FIG. 4 comprises photoconductor drum 10, hereinafter it may be referred to as photoconductor 10, serving as the image bearing member, charge roller 20 serving as the charging unit, exposer 30 serving as the exposing unit, image developing unit 40 serving as the developing unit, intermediate transfer member 50, cleaner 60 serving as the cleaning unit having a cleaning blade, and charge-eliminating lamp 70 serving as the charge-eliminating unit.

The intermediate transfer member 50 is an endless belt and is designed such that the endless belt is spanned over three rollers 51 which are disposed inside thereof and driven in the direction indicated by the arrow shown in the figure. A part of the three rollers 51 also serves as a bias roller capable of applying a given bias for image transfer (primary transfer bias) to the intermediate transfer member 50. Cleaner 90 having a cleaning blade is arranged near the intermediate transfer member 50. Transfer roller 80 serving as the transferring unit is arranged so as to face the intermediate transfer member 50 and is capable of applying a bias for image transfer (secondary transferring) for transferring a developed toner image to transferring sheet 95 serving as a final transferring member. Corona charger 58 for applying a charge to the toner image on the intermediate transfer member 50 is arranged around the intermediate transfer member 50. The corona charger 58 is disposed between a contact area of the photoconductor 10 and the intermediate transfer member 50 and another contact area of the intermediate transfer member 50 and the transferring sheet 95 in the direction of rotation of the intermediate transfer member 50.

The image developing unit 40 includes developing belt 41 as a developer carrier, black developing unit 45K, yellow developing unit 45Y, magenta developing unit 45M, and cyan developing unit 45C which are disposed around the developing belt 41. The black developing unit 45K includes developer holder 42K, developer feed roller 43K, and developing roller 44K. The yellow developing unit 45Y includes developer holder 42Y, developing feed roller 43Y, and developing roller 44Y. The magenta developing unit 45M includes developer holder 42M, developer feed roller 43M, and developing roller 44M. The cyan developing unit 45C includes developer holder 42C, developer feed roller 43C, and developing roller 44C. The developing belt 41 is formed in an endless belt and is rotatably spanned over plural belt rollers, a part of which is in contact with the photoconductor 10.

Figure 4:
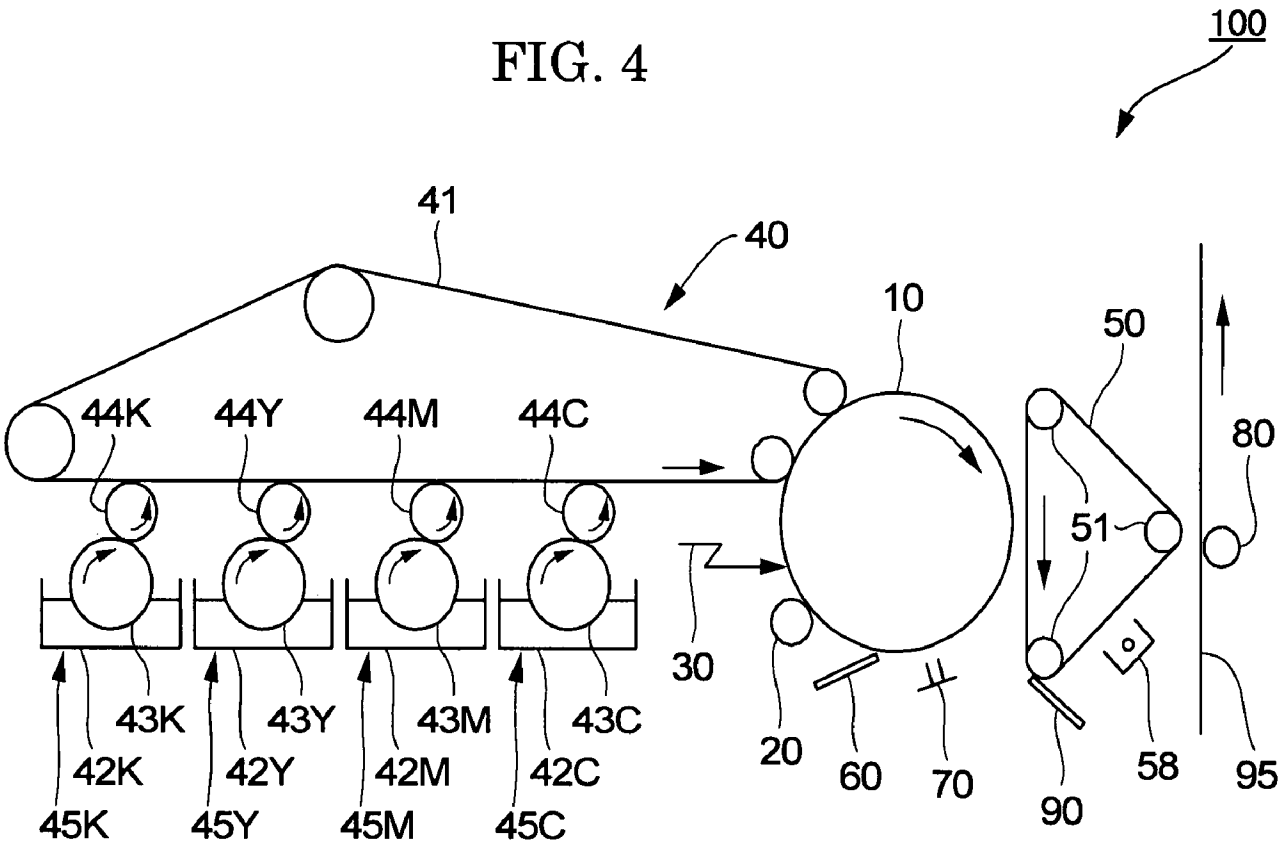
FIG. 4 is a schematic illustration exemplarily showing an example in which the image forming method of the present invention is performed using the image forming apparatus of the present invention.

In the image forming apparatus shown in FIG. 4, for example, the charge roller 20 uniformly charges the photoconductor drum 10. The exposer 30 exposes the photoconductor drum 10 imagewisely to form a latent electrostatic image thereon. The image developing unit 40 feeds the toner to the photoconductor drum 10 to develop the electrostatic latent image formed on the photoconductor drum 10 to thereby form a visible image i.e. a toner image. The visible image (toner image) is transferred to the intermediate transfer member 50 (primary transferring) and then transferred to the transferring sheet 95 (secondary transferring) by action of a voltage applied by the rollers 51, to thereby form a transferred image on the transferring sheet 95. Untransferred toner on the photoconductor 10 is removed by the cleaner 60, and the residual charge on the photoconductor 10 is removed once by means of the charge-eliminating lamp 70.

Figure 5:
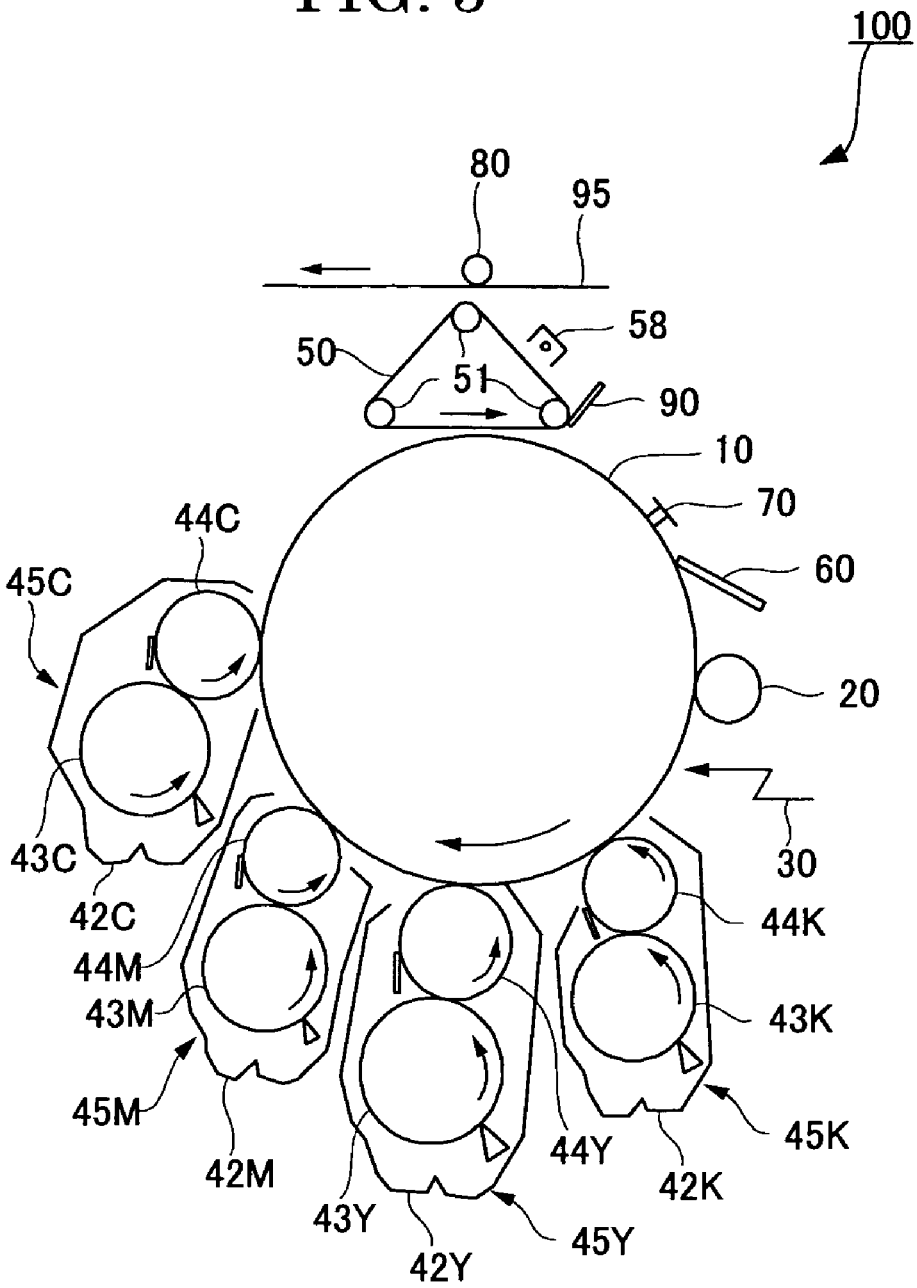
FIG. 5 is a schematic illustration exemplarily showing another example in which the image forming method of the present invention is performed using the image forming apparatus of the present invention.
Figure 7:
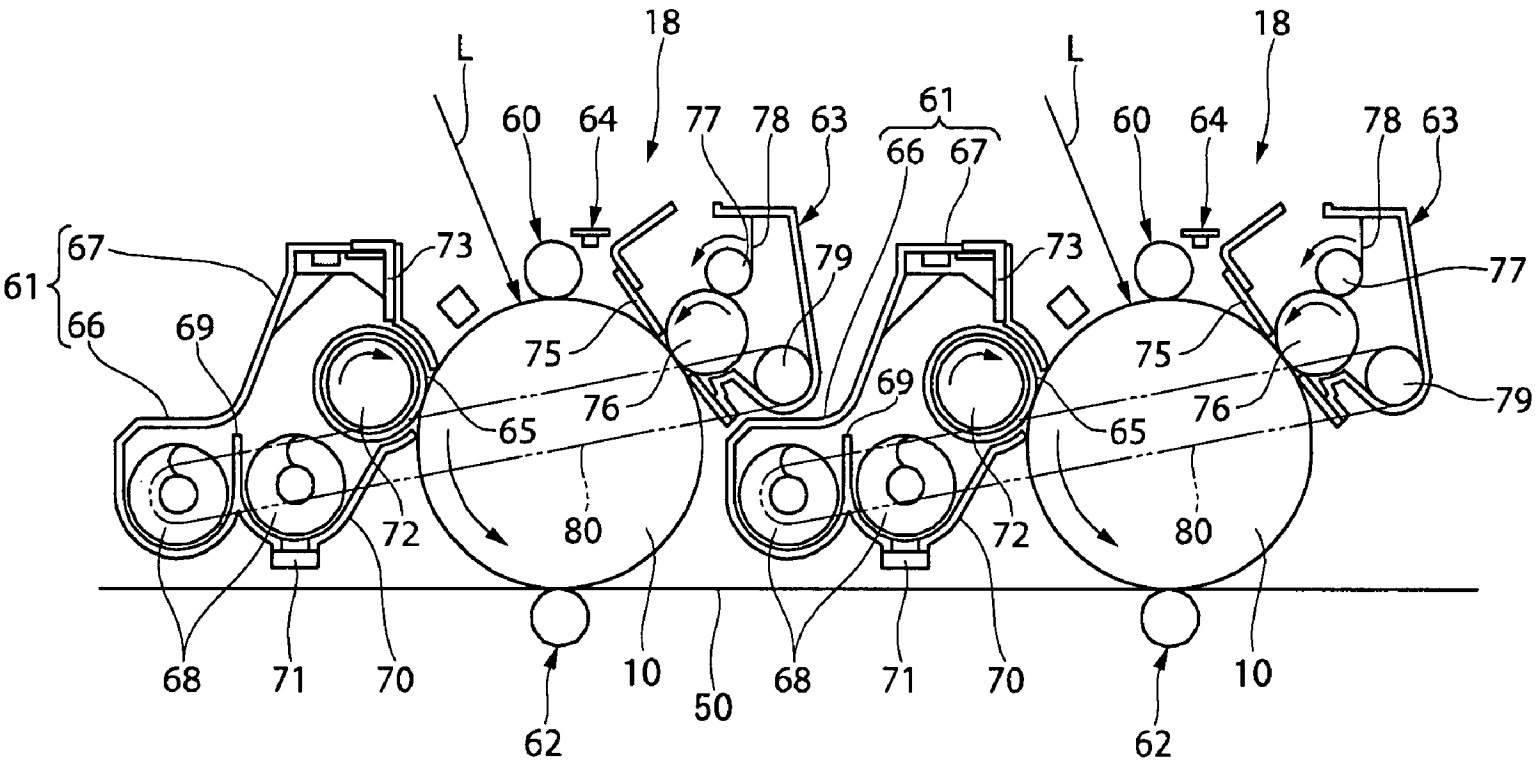
FIG. 7 is a partially enlarged schematic illustration of the image forming apparatus shown in FIG. 6.

Another aspect of the image forming method using the image forming apparatus will be described with reference to FIG. 5. The image forming apparatus 100 shown in FIG. 5 has the same configuration and the same operational effects as in the image forming apparatus 100 shown in FIG. 7 except that the image forming apparatus 100 shown in FIG. 8 does not include developing belt 41, and black developing unit 45K, yellow developing unit 45Y, magenta developing unit 45M, and cyan developing unit 45C are arranged so as to surround and face photoconductor 10. In FIG. 5, the same components used as in FIG. 4 are respectively represented with the same reference numerals.

Figure 6:
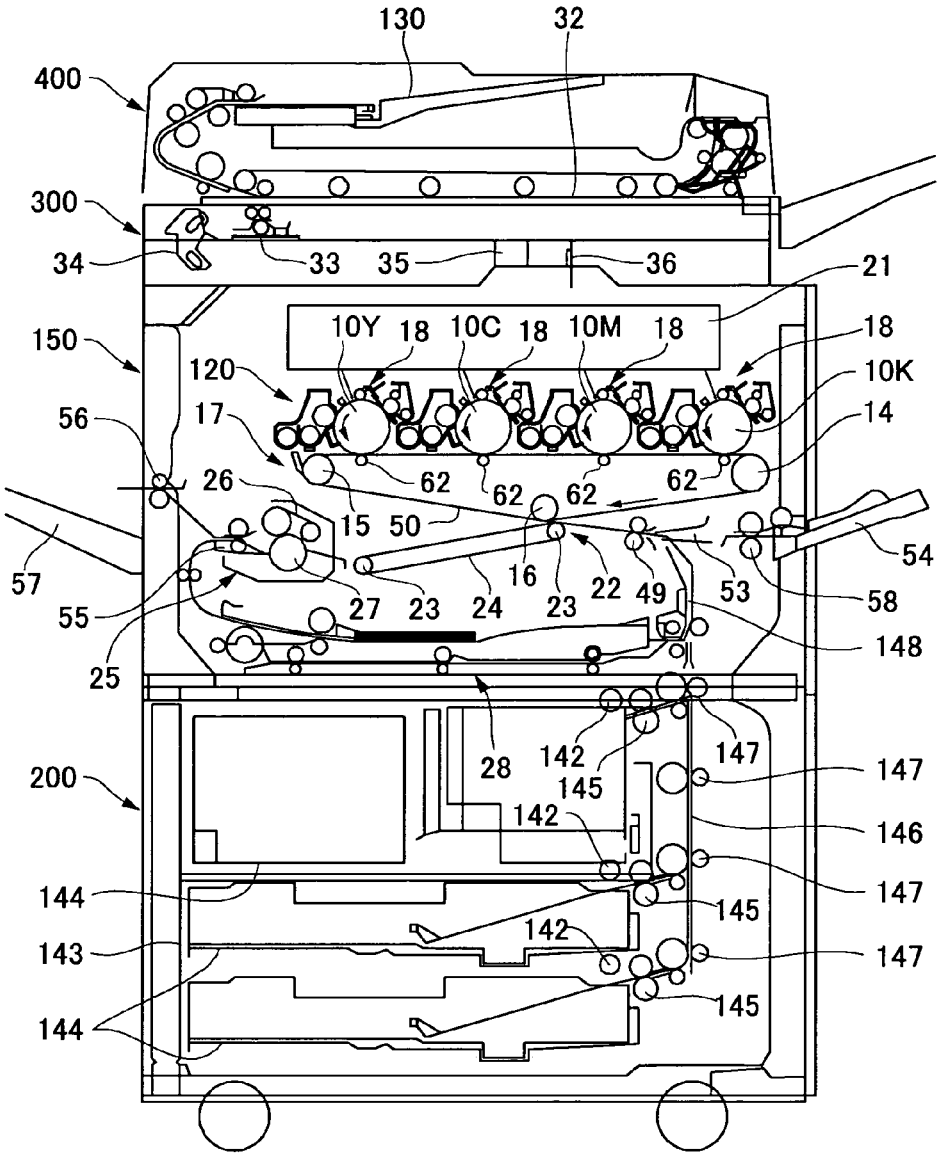
FIG. 6 is a schematic illustration exemplarity showing an example in which the image forming method of the present invention is performed using the image forming apparatus (a tandem color image forming apparatus) of the present invention.

Still another aspect of the image forming method using the image forming apparatus will be described with reference to FIG. 6. A tandem image forming apparatus shown in FIG. 6 is a tandem type color image forming apparatus. The tandem image forming apparatus comprises copier main body 150, sheet-feeder table 200, scanner 300, and automatic document feeder (ADF) 400.

The copier main body 150 includes intermediate transfer member formed in an endless belt 150 at its center part. The intermediate transfer member 50 is spanned over three support rollers 14, 15, and 16 and is capable of rotating and moving in a clockwise direction in FIG. 6. An intermediate transfer member cleaner 17 capable of removing a residual toner on the intermediate transfer member 50 is arranged near the support roller 15. Above the intermediate transfer member 50 spanned between the first and second support rollers 14 and 15, yellow, cyan, magenta, and black image forming units 18 are arrayed in parallel in a moving direction of the intermediate transfer member 50 to thereby constitute a tandem image forming apparatus 120. Exposer 21 is arranged near the tandem image forming unit 120. Secondary image transferer 22 faces the tandem image developing apparatus 120 with the interposition of the intermediate transfer member 50. The secondary transferer 22 comprises secondary transferring belt 24 serving as an endless belt spanned over a pair of rollers 23. The transferring sheet being transported on the secondary transferring belt 24 is capable of contact the intermediate transfer member 50. Image fixing apparatus 25 is arranged on the side of the secondary image-transferer 22. The fixing unit 25 comprises fixing belt 26 which is an endless belt, and pressure roller 27 which is arranged so as to be pressed by the fixing belt 26.

The tandem image forming apparatus further comprises a sheet reverser 28 in the vicinity of the secondary image-transferer 22 and the fixing unit 25. The sheet reverser 28 is capable of reversing the transferring sheet so as to form images on both sides of the transferring sheet.

Next, full-color image forming i.e. color copying using the tandem image forming apparatus will be described below. Initially, a document is placed on document platen 130 of automatic document feeder (ADF) 400. Alternatively, the automatic document feeder (ADF) 400 is opened, a document is placed on contact glass 32 of scanner 300, and the automatic document feeder (ADF) 400 is closed to press the document.

When pushing a start switch (not shown), the document placed on the automatic document feeder 400 is transported onto the contact glass 32. When the document is initially placed on the contact glass 32, by pushing the start switch (not shown), the scanner 300 is immediately driven to operate first carriage 33 and second carriage 34. Light is applied from a light source to the document by action of the first carriage 33, and reflected light from the document is further reflected toward the second carriage 34. The reflected light is further reflected by a mirror of the second carriage 34 and passes through image-forming lens 35 into read sensor 36 to thereby read the color image and to produce black, yellow, magenta, and cyan image information.

Each of the black, yellow, magenta, and cyan image information is transmitted to each of the image forming units 18 for black, yellow, magenta, and cyan image forming in the tandem image forming apparatus to thereby form black, yellow, magenta, and cyan toner image therein. Specifically, each of the image forming units 18 in the tandem image forming apparatus comprises, as shown FIG. 7, photoconductor 10 (black photoconductor 10K, yellow photoconductor 10Y, magenta photoconductor 10M, and cyan photoconductor 10C), charger 60 for charging the surface of the photoconductor 10 uniformly; exposer for exposing the photoconductor 110 in each color image imagewisely based on the each color image information to form latent electrostatic images corresponding to the each individual color image on the photoconductor 10, the exposer is indicated by L in FIG. 7; image developing unit 61 configured to develop the latent electrostatic images using respective color toners of black toner, yellow toner, magenta toner, and cyan toner to form toner images corresponding to each color toner; transfer charger 62 for transferring the latent electrostatic images onto intermediate transfer member 50; photoconductor cleaner 63; and charge-eliminator 64, and it is possible to form each of the monochrome images in black, yellow, magenta, and cyan based on each of the color image information. The black image formed on the respective photoconductors for black 10K, the yellow image formed on the photoconductor for yellow 10Y, the magenta image formed on the photoconductor for magenta 10M, and the cyan image formed on the photoconductor for cyan 10C are sequentially transferred onto the intermediate transfer member 50 which is rotatably moved by the support rollers 14, 15, and 16 in the primary transferring. Then, the black image, the yellow image, magenta image, and the cyan image are superimposed on the intermediate transfer member 50 to thereby form a composite color image i.e. a transferred color image.

One of feeder rollers 142 in the sheet-feeder table 200 is selectively rotated, recording paper sheets are ejected from one of multiple feeder cassettes 144 in paper bank 143, are separated by separation roller 145 one by one, one recording sheet is sent into feeder path 146, transported by a transport roller 147 into feeder path 148 in the copier main body 150 and is bumped against resist roller 49. Alternatively, feeder roller 142 is rotated to eject recording paper sheets on manual bypass tray 54, the recording sheets are separated one by one by separation roller 52, and one recording sheet is sent into manual bypass feeder path 53 and then similarly bumped against the resist roller 49. The resist roller 49 is typically grounded, however, it may be used under application of a bias to remove paper dust of the sheets.

The resist roller 49 is rotated in synchronization with the movement of the composite color image i.e. the transferred color image on the intermediate transfer member 50 to transport the sheet (recording paper) into between the intermediate transfer member 50 and the secondary image transferer 22, and the composite color image is transferred onto the recording sheet by action of the secondary image transferer 22 (secondary transferring) to thereby transfer the composite color image onto the recording sheet and form a color image thereon. Separately, the intermediate transfer member cleaner 17 removes a residual toner on the intermediate transfer member 50 after the image transfer.

The recording sheet bearing the color image is transported by the secondary transferer 22 into the fixing unit 25, applied with heat and pressure in the fixing unit 25, and the composite color image is fixed on the recording sheet. Thereafter, the recording sheet changes its direction by action of the switch blade 55, ejected by an ejecting roller 56 to be stacked on output tray 57.

Alternatively, the recording sheet changes its direction by action of the switch blade 55 into the sheet reverser 28, turns therein, is transported again to the transfer position, followed by image formation on the back surface of the recording sheet. The recording sheet bearing images on both sides thereof is ejected through the ejecting roller 56 to be stacked on the output tray 57.

According to the image forming apparatus and the image forming method of the present invention, it is possible to form finely textured images having excellence in durability for a long period of time without substantially causing carrier adhesion in solid image parts with running time. In the image forming according to the present invention, it is possible to form brilliant and high-quality images, because the developer of the present invention is used, which comprises a carrier having excellence in charge controlling property without causing smears of images.

EXAMPLES

Hereafter, the present invention will be further described in detail referring to specific examples and comparative examples, however, the present invention is not limited to the disclosed examples. It should be noted that the units represented by "part" or "parts" and "%" are based on mass.

In the examples and comparative examples stated below, volume resistivity of the carrier, volume average particle diameter of the core material and the carrier, thickness of the coating layer, magnetization of the carrier, content of indium (In), fluorine content of the toner surface, specific resistance of powder, oil-absorption amount of the conductive particles were respectively measured as follows.

<Volume Resistivity of Carrier>

Volume resistivity value of the carrier was measured as shown in FIG. 9. First, carrier 207 was filled in cell 206 made from a fluorine resin and having electrodes 208 and 209 each of which having a surface area of 2.5 cm×4 cm inside of the cell with a distance between the electrodes of 0.2 cm, and the cell was tapped under the conditions of a height of fall: 1 cm, a tapping speed: 30 times/minute, and taping times: 10 times. Next, a direct current voltage of 1,000 V was applied to between the electrodes, 30 seconds later of the application, the resistivity value was measured by a high resistance meter of 4,329 A (High Resistance Meter, manufactured by YOKOGAWA HEWLETT PACKARD Inc.), the obtained resistivity value r was calculated by the following equation, and the calculated value was taken as volume resistivity value R.

$$R=\mathrm{Log}[r\times(2.5\ \mathrm{cm}\times 4\ \mathrm{cm})\div 0.2\ \mathrm{cm}]\ [\mathrm{Log}(\Omega\cdot\mathrm{cm})]$$

<Volume Average Particle Diameter of Core Material and Carrier>

Volume average particle diameters of the core material and the carrier were respectively measured by using a laser diffraction particle distribution analyzer (SRA-type, manufactured by NIKKISO Co., Ltd.) and setting the measurement range of 0.7 μm to 125 μm.

<Thickness of Coating Layer>

For the thickness of the coating layer, the coating layer covering the carrier surface can be observed by observing the cross-sectional surface of carrier particles through the use of a transmission electron microscope, therefore, the average value of the thickness was taken as the thickness of the coating layer.

<Magnetization of Carrier>

Magnetization of the carrier was measured by the following method through the use of VSM-P7-15 manufactured by TOEI INDUSTRY CO., LTD.

The measurement sample was weighed in an amount of 0.15 g, and the sample was filled in a cell having an inner diameter of 2.4 mm and a height of 8.5 mm and measured under a magnetic field of 1,000 oersted (Oe).

<Indium Content>

The indium content in the carrier was measured using a fluorescent X-ray spectrometer based on EZ scanning serving to scan a contained element. Specifically, in the measurement of the sample, the carrier was made to uniformly adhere on a seal which was a polyester film with a pressure sensitive adhesive coated thereon, and the sample was set on a measurement sample stand, and the content of indium was measured under the conditions below.

[Measurement Conditions]

Measurement range: B-U
Measured diameter: 30 mm
Sample form: Metal
Measurement time: Long
Atmosphere: in vacuum <Measurement of Fluorine Content of Toner Surface>

The fluorine content was measured based on the X-ray photoelectron spectroscopy (XPS). Especially, the closest area of several nanometers of the toner surface was measured. The measurement method based on the photoelectron spectroscopy (XPS), measurement unit type, and measurement conditions or the like are described below.

[Measurement Conditions]

Spectrometer: X-ray photoelectron spectrometer 1600S manufactured by Philips Electronics N.V.
X-ray source: MgKα (400W)
Analyzed area: 0.8×2.0 mm
Pretreatment: A sample was placed in an aluminum tray, the aluminum tray was bonded to the sample holder with a carbon sheet to thereby measure the amount of fluorine.
Calculation of Surface Atomic Percentage: Relative sensitivity factor presented by Philips Electronics N.V. was used.

It is noted that the obtained result was represented by atomic %.

<Powder Specific Resistance of Conductive Particles>

Powder specific resistance of the conductive particles was measured as shown in FIG. 8. First, 5 g of powder sample 204 was placed in cylindrical tube 202 made of vinyl chloride having an inner diameter of 1 cm. A pair of electrodes 201 were held to the vinyl chloride tube 202 respectively at the upper portion and the lower portion thereof. Two Teflon (registered trademark) plates 203 each having a thickness of 2 mm were individually laid on the electrodes 201 such that the electrodes were sandwiched in between the two Teflon plates 203. Then, a pressure of 10 kg/cm$^2$ was applied to the electrodes 201 through the Teflon plates 203 using a pressing machine (not shown). Next, a LCR (inductance-capacitance-resistance) meter 205 (4261A, manufactured by YOKOGAWA HEWLETT PACKARD Inc.) was connected to the electrodes 201 under a pressure of 10 kg/cm$^2$ to measure the resistance value (r) (Ω). Then, the powder specific resistance of the conductive particles can be calculated by using the obtained resistance value based on the following equation.

$$\text{Powder Specific Resistance } (\Omega\cdot\text{cm})=(2.54/2)^2\times(\pi/H\times r)$$

In the above equation, H represents the thickness of the powder sample, and r represents the resistance value.

<Oil-Absorption Amount of Conductive Particles>

The amount of oil absorption was measured in compliance with the amount of oil absorption 21. of JIS K 5101 Pigment Test Method.

In the following examples and comparative examples, carrier adhesion, edge effect, image fineness, and carrier durability in image formation were evaluated as follows.

<Carrier Adhesion>

A developer was set in a remodeled machine of a commercially available digital full-color printer (IPSiO CX8200, manufactured by Ricoh Co., Ltd.). The number of carrier particles adhering on the surface of the photoconductor which had gone through a developing process of a non-surface area ratio chart was visually counted 5 times under a condition that the background potential was set at 150 V, and then the average number of carrier particles per 10 cm$^2$ was taken as the amount of carrier adhesion.

In the evaluation, a developer of which 20 pieces of carrier particles or less adhered on the photoconductor was evaluated as A; a developer of which 21 pieces to 60 pieces of carrier particles adhered thereon was evaluated as B; a developer of which 61 pieces to 80 pieces of carrier particles adhered thereon was evaluated as C; and a developer of which 81 pieces of carrier particles or more adhered thereon was evaluated as D. A developer evaluated as A, B, or C was acceptable, and a developer evaluated as D was rejected.

<Edge Effect>

A developer was set in a remodeled machine of a commercially available digital full-color printer (IPSiO CX8200, manufactured by Ricoh Co., Ltd.) to output a test pattern having a large image surface area.

Difference in thickness of the image density between the center part and the edge part of thus obtained image pattern was evaluated as follows.

A developer used to output an image pattern having no difference in thickness of the image density was evaluated as A; a developer used to output an image pattern having a little bit difference in thickness of the image density was evaluated as B; a developer used to output an image pattern having a difference in thickness of the image density, however, the difference being allowable was evaluated as C; and a developer used to output an image pattern having a difference in thickness of the image density to such a substantial level that the difference cannot be allowable was evaluated as D. A developer evaluated as A, B, or C was acceptable, and a developer evaluated as D was rejected.

<Image Fineness>

Image fineness was evaluated based on the reproductivity of letter-image parts. In the measurement, a developer was set in a remodeled machine of a commercially available digital full-color printer (IPSiO CX8200, manufactured by Ricoh Co., Ltd.). A letter chart having a 5% image area ratio (size of one letter: approx. 2 mm×2 mm) was output, and the reproductivity of the letter chart was visually evaluated based on the image. The image fineness was ranked as follows.

A developer used to output a letter chart which was printed very finely was evaluated as A; a developer used to output a letter chart which was printed finely was evaluated as B, a developer used to output a letter chart which was printed at an allowable level was evaluated as C; and a developer used to output a letter chart which was printed at a level that it cannot be practically used was evaluated as D. A carrier evaluated as A, B, or C was acceptable, and a developer evaluated as D was rejected.

<Durability>

A developer was set in a remodeled machine of a commercially available digital full-color printer (IPSiO CX8200, manufactured by Ricoh Co., Ltd.). After outputting 100,000 sheets of paper in monochrome color, a running evaluation was carried out. Then, the durability was determined based on the reduced amount of charge in carrier and the reduced amount of the resistance upon completion of the running.

The spent amount of additives into the carrier can be measured by the following method. A toner was ejected from the sampled developer, the developer was completely washed using a solvent incapable of solving the coating layer, and the obtained carrier was measured as to the spent amount of additives using ZSX-100E manufactured by Rigaku Corp.

Here, the reduced amount in charge of carrier is determined by the following procedure. The toner is mixed with the carrier at a mixture ratio of 7% of the toner to 93% of the primary carrier, the mixed sample is frictionally charged. The charged amount (Q1) of the frictionally charged sample is measured by means of a typically used blow-off unit (TB-200, manufactured by Toshiba Chemical Corp.). The toner in the developer that has gone through the running was removed using the blow-off unit to obtain a carrier, and the charged amount (Q2) of the carrier was measured in the same manner as in the charged amount (Q1). Then, the reduced amount in charge of carrier is calculated by deducting the charged amount (Q2) from the charged amount (Q1). The target value of the reduced amount in charge is within 10.0 μc/g. Since the reduction in charge is caused by a toner-spent into the carrier surface, the reduction in charge can be restrained by reducing the toner-spent.

The reduced amount of resistance is determined by the following procedure. The primary carrier was placed in between parallel electrodes for resistance measurement with a gap of 2 mm between the electrodes, a voltage of DC250 V is applied to the electrodes, 30 seconds later of the application, the resistivity value of the carrier is measured using a high-resist meter, and the resistivity value is then converted into a volume resistivity value (R1). The toner in the developer that has gone through the running is removed using the blow-off unit to obtain a carrier. The volume resistivity value (R2) of the carrier is measured by the same method, and the reduced amount of resistance is calculated by deducting the value (R2) from the volume resistivity value (1).

The target value of the reduced amount of resistance is within 3.0 [Log(Ω·cm)] in absolute value. The change in resistance is caused by exfoliation of the coating layer of carrier, spent of toner components, and exfoliation of large particles in the carrier coating layer, therefore, the amount of resistance change can be restrained by reducing them.

Production Example A-1

Production of Conductive Particles-1

To 2.5 L of water, 200 g of aluminum oxide (average primary particle diameter of 0.35 μm) was dispersed to prepare a water suspension. The suspension was heated and kept at a temperature of 80° C. To the suspension, a separately prepared solution in which 25 g of stannic chloride ($SnCl_4.5H_2O$) was dissolved in 200 mL of 2N hydrochloride, and a 12% ammonia water were added such that the pH of the suspension was kept at 7 to 8. Next, a separately prepared solution in which 75 g of indium chloride ($InCl_3$) and 10 g of stannic chloride ($SnCl_4.5H_2O$) were dissolved in 800 mL of 2N hydrochloride, and a 12% ammonia water were dropped to the suspension such that the pH of the suspension was kept at 7 to 8. Upon completion of the dropping, thus treated suspension was filtered, washed, and the obtained cake of pigment was dried at 120° C.

Next, the obtained dry powder was heat-treated at a temperature of 500° C. in a nitrogen gas stream (1 L/minute) for 1.5 hours to thereby obtain a targeted white conductive powder, i.e. conductive particles 1.

Production Example A-2

Production of Conductive Particles 2

To 7.3 L of water, 200 g of aluminum oxide (average primary particle diameter of 0.12 μm) was dispersed to prepare a water suspension. The suspension was heated and kept at a temperature of 80° C. To the suspension, a separately prepared solution in which 73 g of stannic chloride ($SnCl_4.5H_2O$) was dissolved in 587 mL of 2N hydrochloride, and a 12% ammonia water were added such that the pH of the suspension was kept at 7 to 8. Next, a separately prepared solution in which 220 g of indium chloride ($InCl_3$) and 29 g of stannic chloride ($SnCl_4.5H_2O$) were dissolved in 2,347 mL of 2N hydrochloride, and a 12% ammonia water were dropped to the suspension such that the pH of the suspension was kept at 7 to 8. Upon completion of the dropping, thus treated suspension was filtered, washed, and the obtained cake of pigment was dried at 120° C.

Next, the obtained dry powder was heat-treated at a temperature of 500° C. in a nitrogen gas stream (1 L/minute) for 1.5 hours to thereby obtain a targeted white conductive powder, i.e. conductive particles 2.

Production Example A-3

Production of Conductive Particles 3

To 0.18 L of water, 200 g of aluminum oxide (average primary particle diameter of 0.35 μm) was dispersed to prepare a water suspension. The suspension was heated and kept at a temperature of 80° C. To the suspension, a separately prepared solution in which 1.8 g of stannic chloride ($SnCl_4.5H_2O$) was dissolved in 15 mL of 2N hydrochloride, and a 12% ammonia water were added such that the pH of the suspension was kept at 7 to 8. Next, a separately prepared solution in which 5.5 g of indium chloride ($InCl_3$) and 0.73 g of stannic chloride ($SnCl_4.5H_2O$) were dissolved in 59 mL of 2N hydrochloride, and a 12% ammonia water were dropped to the suspension such that the pH of the suspension was kept at 7 to 8. Upon completion of the dropping, thus treated suspension was filtered, washed, and the obtained cake of pigment was dried at 120° C.

Next, the obtained dry powder was heat-treated at a temperature of 500° C. in a nitrogen gas stream (1 L/minute) for 1.5 hours to thereby obtain a targeted white conductive powder, i.e. conductive particles 3.

Production Example A-4

Production of Conductive Particles 4

To 14 L of water, 200 g of aluminum oxide (average primary particle diameter of 0.35 μm) was dispersed to prepare a water suspension. The suspension was heated and kept at a temperature of 80° C. To the suspension, a separately prepared solution in which 140 g of stannic chloride ($SnCl_4.5H_2O$) was dissolved in 1,120 mL of 2N hydrochloride, and a 12% ammonia water were added such that the pH of the suspension was kept at 7 to 8. Next, a separately prepared solution in which 420 g of indium chloride ($InCl_3$) and 56 g of stannic chloride ($SnCl_4.5H_2O$) were dissolved in 4,480 mL of 2N hydrochloride, and a 12% ammonia water were dropped to the suspension such that the pH of the suspension was kept at 7 to 8. Upon completion of the dropping, thus treated suspension was filtered, washed, and the obtained cake of pigment was dried at 120° C.

Next, the obtained dry powder was heat-treated at a temperature of 500° C. in a nitrogen gas stream (1 L/minute) for 1.5 hours to thereby obtain a targeted white conductive powder, i.e. conductive particles 4.

Example A-1

Production of Carrier

The following composition was dispersed in a homomixer for 10 minutes to prepare a solution for forming a silicone-containing coating layer.

| <Composition> | |
|---|---|
| Silicone resin solution [solid content of 23% (SR2410 manufactured by TORAY DOW CORNING CO., LTD.)] | 132.2 parts by mass |
| Aminosilane [solid content of 100% (SH6020 manufactured by TORAY DOW CORNING CO., LTD.)] | 0.66 parts by mass |
| Conductive particles 1 [having a base material comprising an alumina which had been subjected to a surface treatment, an under coating layer comprising tin dioxide; and an upper coating layer comprising indium oxide containing tin dioxide; particle diameter: 0.35 μm, and powder specific resistance: 3.5 Ω · cm] | 31 parts by mass |
| Toluene | 300 parts by mass |

Next, the solution for forming the coating layer was coated on the surface of the core material of a calcined ferrite powder having a volume average particle diameter of 35 μm so as to have a thickness of 0.15 μm using Spiracoater (manufactured by Okada Seiko K.K.) with an inside temperature of the coater of 40° C., and dried.

The obtained carrier was left in an electric furnace at 300° C. for 1 hour and calcined. After cooling down the calcined carrier, the ferrite bulk powder was sieved through a sieve of 63 μm mesh and grinded to thereby prepare carrier 1.

The obtained carrier 1 had a particle content of 50%, a 2.3 D/h, a volume resistivity value of 12.8 Log(Ω·cm), a magnetization of 68 $Am^2/kg$, an indium content of 0.0073% by mass, and a volume average particle diameter of 35.3 μm.

Production Example A-1

Production of Toner

The following materials were mixed in HENSCHEL MIXER, fused and kneaded using two-rollers at 120° C. for 40 minutes, cooled, coarsely crushed by a hammer mill, and then finely pulverized by an air-jet pulverizer. The obtained fine powder was classified to thereby prepare toner base particles having a mass average particle diameter of 5 μm.

| <Composition> | |
|---|---|
| Binder resin [polyester resin, number average molecular mass (Mn) = 3,800, mass average molecular mass (Mw) = 20,000, glass transition temperature (Tg) = 60° C., and softening point = 122° C.] | 100 parts by mass |
| Colorant [Azo yellow pigment, C.I. Pigment Yellow 180] | 5 parts by mass |
| Charge controlling agent (zinc salicylate) | 2 parts by mass |
| Releasing agent (carnauba wax, melting point = 82° C.) | 3 parts by mass |

Next, to 100 parts by mass of the obtained toner base particles, 1 part by mass of silica having a hydrophobized surface and 1 part by mass of titanium oxide having a hydrophobized surface were added and mixed to thereby prepare toner 1.

Preparation of Developer

Next, 7 parts by mass of toner 1 and 93 parts by mass of carrier 1 were mixed and stirred to prepare a developer having a toner concentration of 7%.

Image Formation

The obtained developer was evaluated as to image smear, carrier adhesion, edge effect, fineness of image, and durability (reduced amount of charge, and reduced amount of resistance).

Table 1 shows the results.

Example A-2

The following composition was dispersed in a homomixer for 10 minutes to prepare a solution for forming an acrylic resin-containing coating layer.

| <Composition> | |
|---|---|
| Acrylic resin solution (solid content of 50%) | 91.3 parts by mass |
| Guanamine solution (solid content of 70%) | 28.3 parts by mass |
| Acidic catalyst (solid content of 40%) | 0.52 parts by mass |
| Conductive particles 1 | 65.7 parts by mass |
| Toluene | 800 parts by mass |

Next, the solution for forming the coating layer was coated on the surface of the core material of a calcined ferrite powder having a volume average particle diameter of 35 μm so as to have a thickness of 0.15 μm using Spiracoater (manufactured by Okada Seiko K.K.) with an inside temperature of the coater of 40° C., and dried.

The obtained carrier was left in an electric furnace at 150° C. for 1 hour and calcined. After cooling down the calcined carrier, the ferrite bulk powder was sieved through a sieve of 63 μm mesh and grinded to thereby prepare carrier 2.

The obtained carrier 2 had a particle content of 50%, a 2.3 D/h, a volume resistivity value of 12.6 Log(Ω·cm), a magnetization of 68 $Am^2/kg$, an indium content of 0.0070% by mass, and a volume average particle diameter of 35.5 μm.

The obtained carrier 2 and toner 1 were used to prepare a developer in the same manner as in Example A-1, followed by evaluations of the developer. Table 1 shows the evaluation results.

Example A-3

Carrier 3 was prepared in the same manner as in Example A-2 except that a mixture of the acrylic resin solution and the silicone resin solution stated below was used in the formation of the coating layer.

The obtained carrier 3 had a particle content of 50%, a 2.3 D/h, a volume resistivity value of 12.7 Log(Ω·cm), a magnetization of 68 $Am^2/kg$, an indium content of 0.0071% by mass, and a volume average particle diameter of 35.1 μm.

| <Composition> | |
|---|---|
| Acrylic resin solution (solid content of 50%) | 39.7 parts by mass |
| Guanamine solution (solid content of 70%) | 12.4 parts by mass |
| Acidic catalyst (solid content of 40%) | 0.22 parts by mass |
| Silicone resin solution [solid content of 20% (SR2410 manufactured by TORAY DOW CORNING CO., LTD.)] | 185.8 parts by mass |
| Aminosilane [solid content of 100% (SH6020 manufactured by TORAY DOW CORNING CO., LTD.)] | 0.42 parts by mass |
| Conductive particles 1 | 66.2 parts by mass |
| Toluene | 800 parts by mass |

The obtained carrier 3 and toner 1 were used to prepare a developer in the same manner as in Example A-1, followed by evaluations of the developer. Table 1 shows the results.

Example A-4

Carrier 4 was prepared in the same manner as in Example A-3 except that the base material of conductive particles was changed to titanium oxide.

The obtained carrier 4 had a particle content of 50%, a 2.3 D/h, a volume resistivity value of 11.4 Log(Ω·cm), a magnetization of 68 $Am^2/kg$, an indium content of 0.0071% by mass, and a volume average particle diameter of 35.2 μm.

For physical properties of the conductive particles, the conductive particles had a powder specific resistance of 2.2 Ω·cm, and the base material used in Example A-1 was changed to a titanium oxide having an average primary particle diameter of 0.34 μm.

The obtained carrier 4 and toner 1 were used to prepare a developer in the same manner as in Example A-1, followed by evaluations of the developer. Table 1 shows the evaluation results.

Example A-5

Carrier 5 was prepared in the same manner as in Example A-3 except that the base material of the conductive particles was changed to zinc oxide.

The obtained carrier 5 had a particle content of 50%, a 2.1 D/h, a volume resistivity value of 11.8 Log(Ω·cm), a magnetization of 68 $Am^2/kg$, an indium content of 0.0069% by mass, and a volume average particle diameter of 35.6 μm.

For physical properties of the conductive particles, the conductive particles had a powder specific resistance of 2.3 Ω·cm, and the base material used in Example A-1 was changed to a zinc oxide having an average primary particle diameter of 0.32 μm.

The obtained carrier 5 and toner 1 were used to prepare a developer in the same manner as in Example A-1, followed by evaluations of the developer. Table 1 shows the evaluation results.

Example A-6

Carrier 6 was prepared in the same manner as in Example A-3 except that the base material of the conductive particles was changed to silicon dioxide.

The obtained carrier 6 had a particle content of 50%, a 2.1 D/h, a volume resistivity value of 12.6 Log(Ω·cm), a magnetization of 68 $Am^2/kg$, an indium content of 0.0072% by mass, and a volume average particle diameter of 35.8 μm.

For physical properties of the conductive particles, the conductive particles had a powder specific resistance of 4.1 Ω·cm, and the base material used in Example A-1 was changed to a silicon dioxide having an average primary particle diameter of 0.32 μm.

The obtained carrier 6 and toner 1 were used to prepare a developer in the same manner as in Example A-1, followed by evaluations of the developer. Table 1 shows the evaluation results.

Example A-7

Carrier 7 was prepared in the same manner as in Example A-3 except that the base material of the conductive particles was changed to barium sulfate.

The obtained carrier 7 had a particle content of 50%, a 2.1 D/h, a volume resistivity value of 12.5 Log(Ω·cm), a magnetization of 68 $Am^2/kg$, an indium content of 0.0070% by mass, and a volume average particle diameter of 35.2 μm.

For physical properties of the conductive particles, the conductive particles had a powder specific resistance of 3.6 Ω·cm, and the base material used in Example A-1 was changed to a silicon dioxide having an average primary particle diameter of 0.31 μm.

The obtained carrier 7 and toner 1 were used to prepare a developer in the same manner as in Example A-1, followed by evaluations of the developer. Table 1 shows the evaluation results.

Example A-8

Carrier 8 was prepared in the same manner as in Example A-3 except that the base material of the conductive particles was changed to zirconium oxide.

The obtained carrier 8 had a particle content of 50%, a 2.4 D/h, a volume resistivity value of 12.3 Log(Ω·cm), a magnetization of 68 $Am^2/kg$, an indium content of 0.0072% by mass, and a volume average particle diameter of 35.1 μm.

For physical properties of the conductive particles, the conductive particles had a powder specific resistance of 3.2 Ω·cm, and the base material used in Example A-1 was changed to a zirconium oxide having an average primary particle diameter of 0.36 μm.

The obtained carrier 8 and toner 1 were used to prepare a developer in the same manner as in Example A-1, followed by evaluations of the developer. Table 1 shows the evaluation results.

Example A-9

Carrier 9 was prepared in the same manner as in Example A-1 except that the content of the conductive particles 1 was changed to 65%.

The obtained carrier 9 had a 2.3 D/h, a volume resistivity value of 9.8 Log(Ω·cm), a magnetization of 68 $Am^2/kg$, an indium content of 0.0092% by mass, and a volume average particle diameter of 35.5 μm.

The obtained carrier 9 and toner 1 were used to prepare a developer in the same manner as in Example A-1, followed by evaluations of the developer. Table 1 shows the evaluation results.

Example A-10

Carrier 10 was prepared in the same manner as in Example A-3 except that the volume average particle diameter of the core material was changed to 17 μm.

The obtained carrier 10 had a volume average particle diameter of 17.4 μm, a particle content of 50%, a 2.3 D/h, a volume resistivity value of 12.9 Log(Ω·cm), a magnetization of 66 $Am^2/kg$, and an indium content of 0.0073% by mass.

The obtained carrier 10 and toner 1 were used to prepare a developer in the same manner as in Example A-1, followed by evaluations of the developer. Table 1 shows the evaluation results.

Example A-11

Carrier 11 was prepared in the same manner as in Example A-3 except that the volume average particle diameter of the core material was changed to 70 μm.

The obtained carrier 11 had a volume average particle diameter of 70.2 μm, a particle content of 50%, a 2.3 D/h, a volume resistivity value of 11.9 Log(Ω·cm), a magnetization of 69 $Am^2/kg$, and an indium content of 0.0065% by mass.

The obtained carrier 11 and toner 1 were used to prepare a developer in the same manner as in Example A-1, followed by evaluations of the developer. Table 1 shows the evaluation results.

Example A-12

Carrier 12 was prepared in the same manner as in Example A-3 except that the conductive particles were changed to conductive particles 2 which had a base material comprising an aluminum oxide having a particle diameter of 0.12 μm.

The obtained carrier 12 had a particle content of 50%, a 0.8 D/h, a volume resistivity value of 9.1 Log(Ω·cm), a magnetization of 68 $Am^2/kg$, an indium content of 0.0215% by mass, and a volume average particle diameter of 35.2 μm.

For physical properties of the conductive particles, the conductive particles had a particle diameter of 0.12 μm and a powder specific resistance of 1.9 Ω·cm, and the conductive particles had a base material comprising an alumina which had been subjected to a surface treatment, an under coating layer comprising tin dioxide and an upper coating layer comprising an indium oxide containing tin dioxide.

The obtained carrier 12 and toner 1 were used to prepare a developer in the same manner as in Example A-1, followed by evaluations of the developer. Table 1 shows the evaluation results.

Example A-13

Carrier 13 was prepared in the same manner as in Example A-3 except that the particle content was changed to 5%.

The obtained carrier 13 had a 2.3 D/h, a volume resistivity value of 15.4 Log(Ω·cm), a magnetization of 68 $Am^2/kg$, an indium content of 0.0007% by mass, and a volume average particle diameter of 35.6 μm.

The obtained carrier 13 and toner 1 were used to prepare a developer in the same manner as in Example A-1, followed by evaluations of the developer. Table 1 shows the evaluation results.

Example A-14

Carrier 14 was prepared in the same manner as in Example A-3 except that the particle content was changed to 75%.

The obtained carrier 14 had a 2.3 D/h, a volume resistivity value of 10.5 Log(Ω·cm), a magnetization of 68 $Am^2/kg$, an indium content of 0.0113% by mass, and a volume average particle diameter of 35.3 μm.

The obtained carrier 14 and toner 1 were used to prepare a developer in the same manner as in Example A-1, followed by evaluations of the developer. Table 1 shows the evaluation results.

Example A-15

Carrier 15 was prepared in the same manner as in Example A-3 except that a calcined ferrite having a low magnetization and a particle diameter of 35 μm was used to change the magnetization to 35 $Am^2/kg$.

The obtained carrier 15 had a particle content of 50%, a 2.3 D/h, a volume resistivity value of 14.2 Log(Ω·cm), an indium content of 0.0070% by mass, and a volume average particle diameter of 35.7 μm.

The obtained carrier 15 and toner 1 were used to prepare a developer in the same manner as in Example A-1, followed by evaluations of the developer. Table 1 shows the evaluation results.

Example A-16

Carrier 16 was prepared in the same manner as in Example A-3 except that a calcined ferrite having a high magnetization and a particle diameter of 35 μm was used to change the magnetization to 93 $Am^2/kg$.

The obtained carrier 16 had a particle content of 50%, a 2.3 D/h, a volume resistivity value of 11.2 Log(Ω·cm), an indium content of 0.0071% by mass, and a volume average particle diameter of 35.1 μm.

The obtained carrier 16 and toner 1 were used to prepare a developer in the same manner as in Example A-1, followed by evaluations of the developer. Table 1 shows the evaluation results.

Example A-17

Carrier 17 was prepared in the same manner as in Example A-3 except that the conductive particles and a non-conductive particles were used with the composition as follows.

Conductive particles . . . 33.1 parts by mass

Non-conductive particles . . . 33.1 parts by mass

[having a base material comprising an alumina which had not been subjected to a surface treatment; particle diameter: 0.34 μm, and powder specific resistance: 1,014 Ω·cm]

The obtained carrier 17 had a particle content of 50%, a 2.3 D/h, a volume resistivity value of 13.5 Log(Ω·cm), an indium content of 0.0072% by mass, and a volume average particle diameter of 35.6 μm.

The obtained carrier 17 and toner 1 were used to prepare a developer in the same manner as in Example A-1, followed by evaluations of the developer. Table 1 shows the evaluation results.

Comparative Example A-1

Carrier 18 was prepared in the same manner as in Example A-1 except that the conductive particles used in Example A-1 was changed to conductive particles 3, and the particle content was changed to 5%.

The obtained carrier 18 had a 2.3 D/h, a volume resistivity value of 16.3 Log(Ω·cm), a magnetization of 68 $Am^2/kg$, an indium content of 0.00005% by mass, and a volume average particle diameter of 35.6 μm.

The obtained carrier 18 and toner 1 were used to prepare a developer in the same manner as in Example A-1, followed by evaluations of the developer. Table 1 shows the evaluation results.

Comparative Example A-2

Carrier 19 was prepared in the same manner as in Example A-1 except that the conductive particles used in Example A-1 was changed to conductive particles 4, and the particle content was changed to 84%.

The obtained carrier 19 had a 0.8 D/h, a volume resistivity value falling below the lower limit of the measurable range, a magnetization of 68 $Am^2/kg$, an indium content of 0.6% by mass, and a volume average particle diameter of 35.3 μm.

The obtained carrier 19 and toner 1 were used to prepare a developer in the same manner as in Example A-1, followed by evaluations of the developer. Table 1 shows the evaluation results.

Comparative Example A-3

Carrier 20 was prepared in the same manner as in Example A-4 except that the conductive particles used in Example A-4 was changed to a titanium dioxide stated below which was not subjected to a surface treatment.

Physical properties of the titanium dioxide are as follows.

[having a base material comprising a titanium dioxide which was not subjected to a surface treatment; particle diameter: 0.31 μm; powder specific resistance: 2.1 Ω·cm]

The obtained carrier 20 had a particle content of 50%, a 2.1 D/h, a volume resistivity value of 16.2 Log(Ω·cm), a magnetization of 68 $Am^2/kg$, an indium content of zero percent by mass, and a volume average particle diameter of 35.2 μm.

The obtained carrier 20 and toner 1 were used to prepare a developer in the same manner as in Example A-1, followed by evaluations of the developer. Table 1 shows the evaluation results.

TABLE 1

| | Indium Content (% by mass) | Edge Effect | Carrier Adhesion | Image Fineness | Durability: Reduced amount of charge (μC/g) | Durability: Reduced amount of resistance [log (Ω · cm)] |
|---|---|---|---|---|---|---|
| Ex. A-1 | 0.0073 | A | A | A | 5.6 | 2.8 |
| Ex. A-2 | 0.0070 | A | A | A | 1.6 | 0.7 |
| Ex. A-3 | 0.0071 | A | A | A | 1.2 | 0.5 |
| Ex. A-4 | 0.0071 | A | B | A | 3.1 | 0.6 |
| Ex. A-5 | 0.0069 | A | B | A | 3.4 | 0.5 |
| Ex. A-6 | 0.0072 | A | A | A | 2.9 | 0.7 |
| Ex. A-7 | 0.0070 | A | A | A | 3.2 | 1.0 |
| Ex. A-8 | 0.0072 | A | A | A | 3.3 | 0.7 |
| Ex. A-9 | 0.0092 | A | C | B | 3.5 | 0.5 |
| Ex. A-10 | 0.0073 | A | A | A | 6.0 | 1.4 |
| Ex. A-11 | 0.0065 | A | B | C | 2.6 | 1.3 |
| Ex. A-12 | 0.0215 | A | C | B | 3.9 | 0.4 |
| Ex. A-13 | 0.0007 | C | A | A | 9.5 | 2.7 |
| Ex. A-14 | 0.0113 | A | B | B | 3.2 | 1.7 |
| Ex. A-15 | 0.0070 | C | A | A | 3.9 | 1.6 |
| Ex. A-16 | 0.0071 | A | B | C | 5.4 | 2.1 |
| Ex. A-17 | 0.0072 | B | A | A | 1.5 | 0.9 |
| Compara. Ex. A-1 | 0.00005 | D | A | A | 12.1 | 4.5 |
| Compara. Ex. A-2 | 0.6 | A | D | D | 8.2 | — |
| Compara. Ex. A-3 | 0 | D | A | A | 11.4 | 3.3 |

With the developer prepared in Comparative Example A-2, the resistance fell below the lower limit of measurable range of the resist meter, therefore, it was impossible to measure the reduced amount of resistance.

The evaluation results shown in Table 1 exemplified that the developers prepared in Examples A-1 to A-17 respectively had a value within the target value range in all the evaluation items of edge effect, carrier adhesion, image fineness, reduced amount of charge, and reduced amount of resistance and showed excellent results.

On the other hand, with the developer prepared in Comparative Example A-1 having an indium content of 0.00005% by mass, it had excellent values as to carrier adhesion and image fineness both of which were within the target value range, however, it was impossible to obtain sufficient resistance controlling effect, and the developer had a value deviated from the target value of edge effect. With respect to the durability of the developer, it widely deviated from the respective target values of the reduced amount of charge and the reduced amount of resistance, resulting in incapability of practical use.

With the developer prepared in Comparative Example A-2 having an indium content of 0.6% by mass, it had an excellent value as to edge effect, however, the resistance thereof excessively lowered, and it deviated from the target value of carrier adhesion. With respect to the durability, it widely deviated from the respective target values of the reduced amount of charge and the reduced amount of resistance, resulting in incapability of practical use.

Further, with the developer prepared in Comparative Example A-3 in which titanium dioxide that had not been subjected to a surface treatment was used for conductive particles, it had excellent values as to carrier adhesion and image fineness both of which were within the target value range, however, it was impossible to obtain sufficient resistance controlling effect, and the developer had a value deviated from the target value of edge effect. With respect to the durability, it widely deviated from the respective target values of the reduced amount of charge and the reduced amount of resistance, resulting in incapability of practical use.

Example B-1

Production of Conductive Particles 1

To 2.5 L of water, 200 g of aluminum oxide (average primary particle diameter of 0.35 μm) was dispersed to prepare a water suspension. The suspension was heated and kept at a temperature of 80° C. A separately prepared solution in which 75 g of indium chloride ($InCl_3$) was dissolved in 800 mL of 2N hydrochloride, and a 12% ammonia water were dropped to the suspension such that the pH of the suspension was kept at 7 to 8. Upon completion of the dropping, thus treated suspension was filtered, washed, and the obtained cake of pigment was dried at 120° C.

Next, the obtained dry powder was heat-treated at a temperature of 500° C. in a nitrogen gas stream (1 L/minute) for 1.5 hours to thereby obtain a targeted conductive powder.

Production of Carrier

The following composition was dispersed in a homomixer for 10 minutes to prepare a solution for forming a silicone-containing coating layer.

| <Composition> | |
|---|---|
| Silicone resin solution [solid content of 23% (SR2410 manufactured by TORAY DOW CORNING CO., LTD.)] | 132.2 parts by mass |
| Aminosilane [solid content of 100% (SH6020 manufactured by TORAY DOW CORNING CO., LTD.)] | 0.66 parts by mass |
| Conductive particles [having a base material comprising an alumina which had been subjected to a surface treatment with indium oxide; particle diameter: 0.35 μm, oil absorption amount: 25 mL/100 g; powder | 31 parts by mass |

-continued

| <Composition> | |
|---|---|
| specific resistance: 3.9 Ω · cm; a value L* = 93, and a value b* = 0.4] | |
| Toluene | 300 parts by mass |

Next, the solution for forming the coating layer was coated on the surface of the core material of a calcined ferrite powder having an average particle diameter of 35 μm so as to have a thickness of 0.15 μm using Spiracoater (manufactured by Okada Seiko K.K.) with an inside temperature of the coater of 40° C., and dried. The obtained carrier was left in an electric furnace at 300° C. for 1 hour and calcined. After cooling down the calcined carrier, the ferrite bulk powder was sieved through a sieve of 63 μm mesh and grinded to thereby obtain carrier 1. The obtained carrier 1 had a 50% content of conductive particles in the coating layer, a 2.3 D/h, a volume resistivity value of 13.2 Log(Ω·cm), and a magnetization of 68 $Am^2/kg$.

Preparation of Toner

The following materials were mixed in HENSCHEL MIXER, fused and kneaded using two-rollers at 120° C. for 40 minutes, cooled, coarsely crushed by a hammer mill, and then finely pulverized by an air-jet pulverizer. The obtained fine powder was classified to thereby prepare toner base particles having a mass average particle diameter of 5 μm.

| <Composition> | |
|---|---|
| Binder resin [polyester resin, number average molecular mass (Mn) = 3,800, mass average molecular mass (Mw) = 20,000, glass transition temperature (Tg) = 60° C., and softening point = 122° C.] | 100 parts by mass |
| Colorant [Azo yellow pigment, C.I. Pigment Yellow 180] | 5 parts by mass |
| Charge controlling agent (zinc salicylate) | 2 parts by mass |
| Releasing agent (carnauba wax, melting point = 82° C.) | 3 parts by mass |

Next, to 100 parts by mass of the obtained toner base particles, 1 part by mass of silica having a hydrophobized surface and 1 part by mass of titanium oxide having a hydrophobized surface were added and mixed to thereby obtain toner 1.

Preparation of Developer

Next, 7 parts by mass of toner 1 and 93 parts by mass of carrier 1 were mixed and stirred to prepare a developer having a toner concentration of 7%.

Image Formation

The obtained developer was evaluated as to image smear, carrier adhesion, edge effect, fineness of image, and durability (reduced amount of charge, and reduced amount of resistance). Table 2 shows the results.

Example B-2

Production of Conductive Particles 2

To 2.5 L of water, 200 g of aluminum oxide (average primary particle diameter of 0.35 μm) was dispersed to prepare a water suspension. The suspension was heated and kept at a temperature of 80° C. To the suspension, a separately prepared solution in which 25 g of stannic chloride ($SnCl_4.5H_2O$) was dissolved in 200 mL of 2N hydrochloride, and a 12% ammonia water were added such that the pH of the suspension was kept at 7 to 8. Next, a separately prepared solution in which 75 g of indium chloride ($InCl_3$) and 10 g of stannic chloride ($SnCl_4.5H_2O$) were dissolved in 800 mL of 2N hydrochloride, and a 12% ammonia water were dropped to the suspension such that the pH of the suspension was kept at 7 to 8. Upon completion of the dropping, thus treated suspension was filtered, washed, and the obtained cake of pigment was dried at 120° C.

Next, the obtained dry powder was heat-treated at a temperature of 500° C. in a nitrogen gas stream (1 L/minute) for 1.5 hours to thereby obtain a targeted white conductive powder.

Production of Carrier

Carrier 2 was obtained in the same manner as in Example B-1 except that the conductive particles used in the preparation of carrier was changed to those obtained in Production of Conductive Particles 2. The obtained carrier 2 had a 50% content of conductive particles in the coating layer, a 2.3 D/h, a volume resistivity value of 12.5 Log (Ω·cm), and a magnetization of 68 $Am^2/kg$.

| <Composition> | |
|---|---|
| Silicone resin solution [solid content of 23% (SR2410 manufactured by TORAY DOW CORNING CO., LTD.)] | 132.2 parts by mass |
| Aminosilane [solid content of 100% (SH6020 manufactured by TORAY DOW CORNING CO., LTD.)] | 0.66 parts by mass |
| Conductive particles [having a base material comprising an alumina which had been subjected to a surface treatment, an under coating layer comprising tin dioxide; and an upper coating layer comprising indium oxide containing tin dioxide; particle diameter: 0.35 μm; oil absorption amount: 25 mL/100 g, powder specific resistance: 3.5 Ω · cm; and a value L* = 92, and a value b* = 0.5] | 31 parts by mass |
| Toluene | 300 parts by mass |

The obtained carrier 2 and toner 1 were used to prepare a developer in the same manner as in Example B-1, followed by evaluations of the developer. Table 2 shows the evaluation results.

Example B-3

The following composition was dispersed in a homomixer for 10 minutes to prepare a solution for forming an acrylic resin-containing coating layer.

| <Composition> | |
|---|---|
| Acrylic resin solution (solid content of 50%) | 91.3 parts by mass |
| Guanamine solution (solid content of 70%) | 28.3 parts by mass |
| Acidic catalyst (solid content of 40%) | 0.52 parts by mass |
| Conductive particles which were used in Example B-2 | 65.7 parts by mass |
| Toluene | 800 parts by mass |

Next, the solution for forming the coating layer was coated on the surface of the core material of a calcined ferrite powder having an average particle diameter of 35 μm so as to have a thickness of 0.15 μm using Spiracoater (manufactured by Okada Seiko K.K.) with an inside temperature of the coater of 40° C., and dried. The obtained carrier was left in an electric furnace at 150° C. for 1 hour and calcined. After cooling down the calcined carrier, the ferrite bulk powder was sieved through a sieve of 63 μm mesh and grinded to thereby obtain carrier 3. The obtained carrier 3 had a 50% content of conductive particles in the coating layer, a 2.3 D/h, a volume resistivity value of 12.4 Log(Ω·cm), and a magnetization of 68 $Am^2/kg$.

The obtained carrier 3 and toner 1 were used to prepare a developer in the same manner as in Example B-1, followed by evaluations of the developer. Table 2 shows the evaluation results.

Example B-4

The following composition was dispersed in a homomixer for 10 minutes to prepare a solution for forming a coating layer containing silicone resin and acrylic resin.

| <Composition> | |
|---|---|
| Acrylic resin solution (solid content of 50%) | 39.7 parts by mass |
| Guanamine solution (solid content of 70%) | 12.4 parts by mass |
| Acidic catalyst (solid content of 40%) | 0.22 parts by mass |
| Silicone resin solution [solid content of 20% (SR2410 manufactured by TORAY DOW CORNING CO., LTD.)] | 185.8 parts by mass |
| Aminosilane [solid content of 100% (SH6020 manufactured by TORAY DOW CORNING CO., LTD.)] | 0.42 parts by mass |
| Conductive particles used in Example B-2 | 66.2 parts by mass |
| Toluene | 800 parts by mass |

Next, the solution for forming the coating layer was coated on the surface of the core material of a calcined ferrite powder having an average particle diameter of 35 μm so as to have a thickness of 0.15 μm using Spiracoater (manufactured by Okada Seiko K.K.) with an inside temperature of the coater of 40° C., and dried. The obtained carrier was left in an electric furnace at 150° C. for 1 hour and calcined. After cooling down the calcined carrier, the ferrite bulk powder was sieved through a sieve of 63 μm mesh and grinded to thereby obtain carrier 4. The obtained carrier 4 had a 50% content of conductive particles in the coating layer, a 2.3 D/h, a volume resistivity value of 12.5 Log(Ω·cm), and a magnetization of 68 $Am^2/kg$.

The obtained carrier 4 and toner 1 were used to prepare a developer in the same manner as in Example B-1, followed by evaluations of the developer. Table 2 shows the evaluation results.

Example B-5

Carrier 5 was prepared in the same manner as in Example B-4 except that the base material of the conductive particles was changed to titanium oxide. The obtained carrier 5 had a 50% content of conductive particles in the coating layer, a 2.3 D/h, a volume resistivity value of 11.2 Log(Ω·cm), and a magnetization of 68 $Am^2/kg$.

For physical properties of the conductive particles, the conductive particles had an oil absorption amount of 25 mL/100 g, a powder specific resistance of 2.1 Ω·cm, and a value L*=91, and a value b*=0.5, and the base material used in Example B-4 was changed to a titanium oxide having an average primary particle diameter of 0.34 μm.

The obtained carrier 5 and toner 1 were used to prepare a developer in the same manner as in Example B-1, followed by evaluations of the developer. Table 2 shows the evaluation results.

Example B-6

Carrier 6 was prepared in the same manner as in Example B-4 except that the base material of the conductive particles was changed to zinc oxide. The carrier 6 had a 50% content of conductive particles in the coating layer, a 2.1 D/h, a volume resistivity value of 11.6 Log (Ω·cm), and a magnetization of 68 $Am^2/kg$.

For physical properties of the conductive particles, the conductive particles had an oil absorption amount of 25 mL/100 g, a powder specific resistance of 2.3 Ω·cm, and a value L*=92, and a value b*=0.4, and the base material used in Example B-4 was changed to a zinc oxide having an average primary particle diameter of 0.32 μm.

The obtained carrier 6 and toner 1 were used to prepare a developer in the same manner as in Example B-1, followed by evaluations of the developer. Table 2 shows the evaluation results.

Example B-7

Carrier 7 was prepared in the same manner as in Example B-4 except that the base material of the conductive particles was changed to silicon dioxide. The obtained carrier 7 had a 50% content of conductive particles in the coating layer, a 2.1 D/h, a volume resistivity value of 13.5 Log(Ω·cm), and a magnetization of 68 $Am^2/kg$.

For physical properties of the conductive particles, the conductive particles had an oil absorption amount of 25 mL/100 g, a powder specific resistance of 4.1 Ω·cm, and a value L*=92, and a value b*=0.5, and the base material used in Example B-4 was changed to a silicon dioxide having an average primary particle diameter of 0.32 μm.

The obtained carrier 7 and toner 1 were used to prepare a developer in the same manner as in Example B-1, followed by evaluations of the developer. Table 2 shows the evaluation results.

Example B-8

Carrier 8 was prepared in the same manner as in Example B-4 except that the base material of the conductive particles was changed to barium sulfate. The carrier 8 had a 50% content of conductive particles in the coating layer, a 2.1 D/h, a volume resistivity value of 12.8 Log(Ω·cm), and a magnetization of 68 $Am^2/kg$.

For physical properties of the conductive particles, the conductive particles had an oil absorption amount of 25 mL/100 g, a powder specific resistance of 3.7 Ω·cm, and a value L*=91, and a value b*=0.5, and the base material used in Example B-4 was changed to a barium sulfate having an average primary particle diameter of 0.31 μm.

The obtained carrier 8 and toner 1 were used to prepare a developer in the same manner as in Example B-1, followed by evaluations of the developer. Table 2 shows the evaluation results.

Example B-9

Carrier 9 was prepared in the same manner as in Example B-4 except that the base material of the conductive particles was changed to zirconium oxide. The obtained carrier 9 had a 50% content of conductive particles in the coating layer, a 2.4 D/h, a volume resistivity value of 12.1 Log(Ω·cm), and a magnetization of 68 $Am^2/kg$.

For physical properties of the conductive particles, the conductive particles had an oil absorption amount of 25 mL/100 g, a powder specific resistance of 3.1 Ω·cm, a value L*=89, and a value b*=0.6, and the base material used in Example B-4 was changed to a zirconium oxide having an average primary particle diameter of 0.36 μm.

The obtained carrier 9 and toner 1 were used to prepare a developer in the same manner as in Example B-1, followed by evaluations of the developer. Table 2 shows the evaluation results.

Example B-10

Carrier 10 was prepared in the same manner as in Example B-4 except that the conductive particles were changed to those stated below, and the volume resistivity value of carrier was changed to 9.6 Ω·cm in order to reduce the volume resistivity value. The obtained carrier 10 had a 65% content of conductive particles in the coating layer, a 2.3 D/h, and a magnetization of 68 $Am^2/kg$.

For physical properties of the conductive particles, the conductive particles had a particle diameter of 0.35 μm, an oil absorption amount of 25 mL/100 g, a powder specific resistance of 1.2 Ω·cm, and a value L*=92, and a value b*=0.4, and the conductive particles included a base material comprising an alumina which had been subjected to a surface treatment, an under coating layer comprising tin dioxide, and an upper coating layer comprising indium oxide containing tin dioxide.

The obtained carrier 10 and toner 1 were used to prepare a developer in the same manner as in Example B-1, followed by evaluations of the developer. Table 2 shows the evaluation results.

Example B-11

Carrier 11 was prepared in the same manner as in Example B-4 except that the mass average particle diameter of the carrier was changed to 18 μm by changing the average particle diameter of the carrier core material. The carrier 11 had a 50% content of conductive particles in the coating layer, a 2.3 D/h, a volume resistivity value of 12.6 Log(Ω·cm), and a magnetization of 66 $Am^2/kg$.

The obtained carrier 11 and toner 1 were used to prepare a developer in the same manner as in Example B-1, followed by evaluations of the developer. Table 2 shows the evaluation results.

Example B-12

Carrier 12 was prepared in the same manner as in Example B-4 except that the mass average particle diameter of the carrier was changed to 69 μm by changing the average particle diameter of the carrier core material. The obtained carrier 12 had a 50% content of conductive particles in the coating layer, a 2.3 D/h, a volume resistivity value of 12.5 Log(Ω·cm), and a magnetization of 69 $Am^2/kg$.

The obtained carrier 12 and toner 1 were used to prepare a developer in the same manner as in Example B-1, followed by evaluations of the developer. Table 2 shows the evaluation results.

Example B-13

Carrier 13 was prepared in the same manner as in Example B-4 except that the average primary particle diameter of aluminum oxide used for the base material of the conductive particles was changed to 0.12 μm. The obtained carrier 13 had a 50% content of conductive particles in the coating layer, a 0.8 D/h, a volume resistivity value of 11.8 Log(Ω·cm), and a magnetization of 68 $Am^2/kg$.

For physical properties of the conductive particles, the conductive particles had a particle diameter of 0.12 μm, an oil absorption amount of 42 mL/100 g, a powder specific resistance of 2.4 Ω·cm, and a value L*=91, and a value b*=0.5, and the conductive particles included a base material comprising an alumina which had been subjected to a surface treatment, an under coating layer comprising tin dioxide, and an upper coating layer comprising indium oxide containing tin dioxide.

The obtained carrier 13 and toner 1 were used to prepare a developer in the same manner as in Example B-1, followed by evaluations of the developer. Table 2 shows the evaluation results.

Example B-14

Carrier 14 was prepared in the same manner as in Example B-4 except that the oil absorption amount of the conductive particles was changed to 8 mL/100 g. The obtained carrier 14 had a 2.3 D/h, a volume resistivity value of 14.5 Log(Ω·cm), and a magnetization of 68 $Am^2/kg$.

For physical properties of the conductive particles, the conductive particles had a particle diameter of 0.35 μm, an oil absorption amount of 8 mL/100 g, a powder specific resistance of 3.5 Ω·cm, a value L*=93, and a value b*=0.4, and the conductive particles included a base material comprising an alumina which had been subjected to a surface treatment, an under coating layer comprising tin dioxide, and an upper coating layer comprising indium oxide containing tin dioxide.

The obtained carrier 14 and toner 1 were used to prepare a developer in the same manner as in Example B-1, followed by evaluations of the developer. Table 2 shows the evaluation results.

Example B-15

Carrier 15 was prepared in the same manner as in Example B-4 except that the oil absorption amount of the conductive particles was changed to 320 mL/100 g. The obtained carrier 15 had a 2.3 D/h, a volume resistivity value of 10.4 Log (Ω·cm), and a magnetization of 68 $Am^2/kg$.

For physical properties of the conductive particles, the conductive particles had a particle diameter of 0.35 μm, an oil absorption amount of 320 mL/100 g, a powder specific resistance of 3.6 Ω·cm, a value L*=91, and a value b*=0.5, and the conductive particles included a base material comprising an alumina which had been subjected to a surface treatment, an under coating layer comprising tin dioxide, and an upper coating layer comprising indium oxide containing tin dioxide.

The obtained carrier 15 and toner 1 were used to prepare a developer in the same manner as in Example B-1, followed by evaluations of the developer. Table 2 shows the evaluation results.

Example B-16

Carrier 16 was prepared in the same manner as in Example B-4 except that a calcined ferrite having a low magnetization and an average particle diameter of 35 μm was used as the core material, and the magnetization was changed to 35 $Am^2/$ kg. The carrier 16 had a 50% content of conductive particles in the coating layer, a 2.3 D/h, and a volume resistivity value of 14.3 Log(Ω·cm).

The obtained carrier 16 and toner 1 were used to prepare a developer in the same manner as in Example B-1, followed by evaluations of the developer. Table 2 shows the evaluation results.

Example B-17

Carrier 17 was prepared in the same manner as in Example B-4 except that a calcined ferrite having a high magnetization and an average particle diameter of 35 μm was used as the core material, and the magnetization was changed to 93 $Am^2$/kg. The obtained carrier 17 had a 50% content of conductive particles in the coating layer, a 2.3 D/h, and a volume resistivity value of 11.1 Log(Ω·cm).

The obtained carrier 17 and toner 1 were used to prepare a developer in the same manner as in Example B-1, followed by evaluations of the developer. Table 2 shows the evaluation results.

Example B-18

Carrier 18 was prepared in the same manner as in Example B-4 except that conductive particles and non-conductive particles were used in the following composition. The carrier 18 had a 25% content of conductive particles in the coating layer, a 2.3 D/h, and a volume resistivity value of 13.1 Log(Ω·cm).

Conductive particles . . . 33.1 parts by mass

[having a base material comprising an alumina which had been subjected to a surface treatment; an under coating layer comprising tin dioxide, and an upper coating layer comprising indium oxide containing tin oxide; particle diameter: 0.35 μm, oil absorption amount: 25 mL/100 g; and powder specific resistance: 3.5 Ω·cm; a value L*=92, and a value b*=0.5]

Non-conductive particles . . . 33.1 parts by mass

[having a base material comprising an alumina which had not been subjected to a surface treatment; particle diameter: 0.34 μm, and powder specific resistance: 1,014 Ω·cm]

The obtained carrier 18 and toner 1 were used to prepare a developer in the same manner as in Example B-1, followed by evaluations of the developer. Table 2 shows the evaluation results.

Comparative Example B-1

Carrier 19 was prepared in the same manner as in Example B-4 except that the conductive particles as stated below were used. The obtained carrier 19 had a 1.2% content of conductive particles in the coating layer, a 2.3 D/h, a volume resistivity value of 14.9 Log (Ω·cm), and a magnetization of 68 $Am^2$/kg.

Conductive particles . . . 0.8 parts by mass

[having a base material comprising an alumina which had been subjected to a surface treatment; an under coating layer comprising tin dioxide, and an upper coating layer comprising indium oxide containing tin oxide; particle diameter: 0.35 μm, oil absorption amount: 25 mL/100 g; and powder specific resistance: 0.9 Ω·cm; a value L*=90, and a value b*=0.6]

The obtained carrier 19 and toner 1 were used to prepare a developer in the same manner as in Example B-1, followed by evaluations of the developer. Table 2 shows the evaluation results.

Comparative Example B-2

Carrier 20 was prepared in the same manner as in Example B-4 except that the conductive particles as stated below were used. The obtained carrier 20 had a 75.3% content of conductive particles in the coating layer, a 2.4 D/h, a volume resistivity value of 12.1 Log (Ω·cm), and a magnetization of 68 $Am^2$/kg.

Conductive particles . . . 200 parts by mass

[having a base material comprising an alumina which had been subjected to a surface treatment; an under coating layer comprising tin dioxide, and an upper coating layer comprising indium oxide containing tin oxide; particle diameter: 0.35 μm, oil absorption amount: 25 mL/100 g; and powder specific resistance: 210 Ω·cm; a value L*=91, and a value b*=0.5]

The obtained carrier 20 and toner 1 were used to prepare a developer in the same manner as in Example B-1, followed by evaluations of the developer. Table 2 shows the evaluation results.

Comparative Example B-3

Carrier 21 was prepared in the same manner as in Example B-5 except that the base material of the conductive particles was changed to a titanium dioxide which was not subjected to a surface treatment. The obtained carrier 21 had a 50% content of conductive particles in the coating layer, a 2.1 D/h, a volume resistivity value of 15.0 Log(Ω·cm), and a magnetization of 68 $Am^2$/kg.

For physical properties of the conductive particles, the conductive particles had a particle diameter of 0.31 μm, and a powder specific resistance of 2.1 Ω·cm, a value L*=93, and a value b*=0.4, and the conductive particles included a base material comprising a titanium dioxide which was not subjected to a surface treatment.

The obtained carrier 21 and toner 1 were used to prepare a developer in the same manner as in Example B-1, followed by evaluations of the developer. Table 2 shows the evaluation results.

TABLE 2

| | | Volume | | | | Durability | |
|---|---|---|---|---|---|---|---|
| | Indium Content (% by mass) | Resistivity Value [Log (Ω · cm)] | Edge Effect | Carrier Adhesion | Image Fineness | Reduced amount of charge (μC/g) | Reduced amount of resistivity [Log (Ω · cm)] |
| Ex. B-1 | 0.0079 | 13.2 | A | A | A | 1.9 | 1.4 |
| Ex. B-2 | 0.0071 | 12.5 | A | A | A | 1.6 | 0.8 |
| Ex. B-3 | 0.0070 | 12.4 | A | A | A | 1.3 | 0.5 |
| Ex. B-4 | 0.0071 | 12.5 | A | A | A | 1.0 | 0.5 |
| Ex. B-5 | 0.0072 | 11.2 | A | B | A | 3.4 | 0.6 |

TABLE 2-continued

| | Indium Content (% by mass) | Volume Resistivity Value [Log (Ω · cm)] | Edge Effect | Carrier Adhesion | Image Fineness | Durability: Reduced amount of charge (μC/g) | Durability: Reduced amount of resistivity [Log (Ω · cm)] |
|---|---|---|---|---|---|---|---|
| Ex. B-6 | 0.0071 | 11.6 | A | B | A | 3.6 | 0.6 |
| Ex. B-7 | 0.0071 | 13.5 | B | A | B | 7.0 | 0.8 |
| Ex. B-8 | 0.0073 | 12.8 | A | A | A | 3.6 | 0.8 |
| Ex. B-9 | 0.0072 | 12.1 | A | A | A | 3.7 | 0.8 |
| Ex. B-10 | 0.0073 | 9.6 | A | C | A | 3.5 | 0.9 |
| Ex. B-11 | 0.0140 | 12.6 | A | C | B | 5.2 | 1.5 |
| Ex. B-12 | 0.0035 | 12.5 | A | A | B | 2.7 | 1.6 |
| Ex. B-13 | 0.0072 | 11.8 | A | B | A | 7.2 | 2.5 |
| Ex. B-14 | 0.0071 | 14.5 | C | A | A | 8.5 | 2.9 |
| Ex. B-15 | 0.0073 | 10.4 | A | C | A | 7.7 | 2.7 |
| Ex. B-16 | 0.0072 | 14.3 | C | C | C | 4.2 | 1.7 |
| Ex. B-17 | 0.0073 | 11.1 | A | B | C | 5.2 | 1.9 |
| Ex. B-18 | 0.0036 | 13.1 | A | A | A | 1.7 | 1.1 |
| Compara. Ex. B-1 | 0.00008 | 14.9 | A | A | A | These evaluations were cancelled, because the reduced amount of resistance resulted in a value of 3.3 when 50,000 sheets were output. | |
| Compara. Ex. B-2 | 0.51 | 12.1 | A | A | A | These evaluations were cancelled, because the reduced amount of charge resulted in a value of 13 when 70,000 sheets were output. | |
| Compara. Ex. B-3 | 0 | 15.0 | D | Because of the poor result of edge effect, other evaluations were cancelled. | | | |

The evaluation results shown in Table 1 exemplified that the developers prepared in Examples B-1 to B-18 respectively had a value within the target value range in all the evaluation items of edge effect, carrier adhesion, image fineness, reduced amount of charge, and reduced amount of resistance and showed excellent results.

On the other hand, with the developer prepared in Comparative Example B-1 which had an indium content of 0.00008% by mass and a powder specific resistance of the conductive particles of 0.9 Ω·cm, the particle content of the conductive particle which was required in order to obtain the targeted resistance value fell below 10% due to the low value in powder specific resistance, and it was impossible to keep the resistance controlling effect in a long while, and the reduced amount of resistance at the time of running output of 50,000 sheets resulted in a value of 3.4 Log(Ω·cm) which deviated from the target value, resulting in incapability of practical use. For the reason mentioned above, the evaluations of the developer were cancelled.

With the carrier prepared in Comparative Example B-2 which had an indium content of 0.051% by mass and a powder specific resistance of the conductive particles of 210 Ω·cm, the particle content of the conductive particle which was required in order to obtain the targeted resistance value resulted in a value of 75.3% due to the high value in powder specific resistance, and it was impossible to keep the resistance controlling effect in a long while because the proportion of the particles widely exceeded a standard value, and the proportion of the binder resin from which charge was generated was insufficient. Consequently, the reduced amount of charge at the time of running output of 70,000 sheets resulted in a value of 13 μc/g which deviated from the target value, resulting in incapability of practical use. For the reason mentioned above, the evaluations of the developer were cancelled.

Further, with the developer prepared in Comparative Example B-3 containing titanium dioxide which had not been subjected to a surface treatment was used for conductive particles, it was impossible to obtain resistance controlling effect, and it deviated from the target value of edge effect, resulting in incapability of practical use. Because of the rejection, other evaluations of the carrier were not carried out.

Comparative Example B-4

Carrier 22 was prepared in the same manner as in Example B-18 except that the conductive particles stated below were used. Carrier 22 had a particle content of 9%, a 2.0 D/h, a volume resistivity value of 12.5 Log(Ω·cm), and a magnetization of 68 $Am^2/kg$.

| | |
|---|---|
| Conductive particles (Carbon black) | 2.0 parts by mass |
| Non-conductive particles | 28.1 parts by mass |

[having a base material comprising an alumina which was not subjected to a surface treatment; particle diameter: 0.34 μm; and powder specific resistance: $10^{14}$ Ω·cm, L=93, b=0.5]

With respect to carrier 1 obtained in Example B-1 (the conductive particles (conductive particles having a value L*=93, and a value b*=0.4), carrier 2 obtained in Example B-2 (conductive particles having a value L*=92, and a value b*=0.5), carrier 7 obtained in Example B-7 (conductive particles having a value L*=89, and a value b*=0.6), and carrier 22 obtained in Example B-4, each of these carriers were used to respectively prepare a developer in the same manner as in Example B-1, followed by the following test.

<Image Smears>

With respect to image fineness, solid parts of image were output, and image smears were observed using X-Rite. In the evaluation, a developer was set in a commercially available digital full-color printer (IPSiO CX8200, manufactured by Ricoh Co., Ltd.). First, the image immediately after setting the developer was measured by using X-Right (X-Rite 938 D50, manufactured by Am. Tech. Inc.) to obtain a value (E). Next, the image after stirring the developer in the developing unit alone for 1 hour was output, and the image was measured by the X-Rite to thereby obtain a value (E'). Using the values of (E) and (E'), a value ΔE was obtained, and the developer was ranked as follows.

$$\Delta E = E - E'$$

$$E = (L^2 + a^{*2} + b^{*2})^{1/2}$$

(The value when Yellow ID being 1.4 was read)

E=Initial value of the developer

E'=Value after stirring the developer in the developer unit alone for 1 hour

A: ΔE≦2

B: 2<ΔE≦5

C: 5<ΔE

A developer ranked as C was rejected, and a developer ranked as A or B was evaluated as acceptable in practical use.

As a result of the obtained value ΔE, the developers using the carrier prepared in Example B-1, B-2, or B-7 were respectively evaluated as A, and the developer using the carrier prepared in Comparative Example B-4 was evaluated as C.

Example C-1

Production of Conductive Particles

To 2.5 L of water, 200 g of aluminum oxide (average primary particle diameter of 0.40 μm, and absolute specific gravity of 3.9) was dispersed to prepare a water suspension. The suspension was heated and kept at a temperature of 80° C. To the suspension, a separately prepared solution in which 25 g of stannic chloride ($SnCl_4.5H_2O$) was dissolved in 200 mL of 2N hydrochloride, and a 12% ammonia water were added such that the pH of the suspension was kept at 7 to 8. Next, a separately prepared solution in which 75 g of indium chloride ($InCl_3$) and 10 g of stannic chloride ($SnCl_4.5H_2O$) were dissolved in 800 mL of 2N hydrochloride, and a 12% ammonia water were dropped to the suspension such that the pH of the suspension was kept at 7 to 8. Upon completion of the dropping, thus treated suspension was filtered, washed, and the obtained cake of pigment was dried at 120° C.

Next, the obtained dry powder was heat-treated at a temperature of 500° C. in a nitrogen gas stream (1 L/minute) for 1.5 hours. The calcined product was crushed, and a 4% γ-mercaptopropyl trimethoxysilane was added while stirring the crushed product in HENSCHEL MIXER which was heated at 70° C. Further, thus treated product was heat-treated at 100° C. for 1 hour to thereby obtain white and conductive particles A.

Preparation of Carrier

The following composition was dispersed in a homomixer for 10 minutes to prepare a solution for forming a silicone-containing coating layer.

| <Composition> | |
|---|---|
| Silicone resin solution [solid content of 23% (SR2410 manufactured by TORAY DOW CORNING CO., LTD.)] | 132.2 parts by mass |
| Aminosilane [solid content of 100% (SH6020 manufactured by TORAY DOW CORNING CO., LTD.)] | 0.66 parts by mass |
| Conductive particles A [having a base material comprising an alumina which had been subjected to a surface treatment, an under coating layer comprising tin dioxide; and an upper coating layer comprising indium oxide containing tin dioxide; particle diameter: 0.40 μm; and powder specific resistance: 3.7 Ω · cm] | 31 parts by mass |
| Inorganic oxide fine particles A [aluminum oxide; particle diameter: 0.37 μm; absolute specific gravity: 3.9] | 45 parts by mass |
| Toluene | 300 parts by mass |

Next, the solution for forming the coating layer was coated on the surface of the core material of 500 parts by mass of a calcined ferrite powder having an average particle diameter of 35 μm and an absolute specific gravity of 5.5 so as to have a thickness of 0.15 μm using Spiracoater (manufactured by Okada Seiko K.K.) with an inside temperature of the coater of 40° C., and dried. The obtained carrier was left in an electric furnace at 240° C. for 1 hour and calcined. After cooling down the calcined carrier, the ferrite bulk powder was sieved through a sieve of 63 μm mesh and grinded to thereby prepare carrier 1. The obtained carrier 1 had a 2.3 D/h, a volume resistivity value of 13.9 Log(Ω·cm), and a magnetization of 68 $Am^2/kg$. The surface coverage of the conductive particles and the inorganic oxide particles included in the coating layer relative to the used core material was 46%.

<Production of Toner 1>

Synthesis of Toner Binder

In a reaction vessel equipped with a condenser tube, a stirrer, and a nitrogen inlet tube, 724 parts of bisphenol A ethylene oxide dimolar adduct, 276 parts of isophthalic acid, and 2 parts of dibutyl tin oxide were poured, the reaction was performed under normal pressure at 230° C. for 8 hours, the reaction was further performed under a reduced pressure of 10 mmHg to 15 mmHg for 5 hours, and then the reaction product was cooled down to 160° C. To the cooled reaction product, 32 parts of phthalic anhydride were added, and the reaction was performed for 2 hours. Next, the reaction product was cooled down to 80° C., and the reaction product was reacted with 188 parts of isophorone diisocyanate in ethyl acetate for 2 hours to thereby obtain isocyanate-containing prepolymer (1).

Next, 267 parts of prepolymer (1) and 14 parts of isophorone diamine were reacted at 50° C. for 2 hours to thereby obtain urea-modified polyester (1) having a mass average molecular mass of 64,000.

Similar to the above, 724 parts of bisphenol A ethylene oxide dimolar adduct, 276 parts of terephthalic acid were mixed and polymerized under normal pressure at 230° C. for 8 hours, and then the reaction was performed under a reduced pressure of 10 mmHg to 15 mmHg for 5 hours to thereby obtain unmodified polyester (a) having a peak molecular mass of 5,000.

Next, 200 parts of urea-modified polyester (1) and 800 parts of unmodified polyester (a) were dissolved in 2,000 parts of a mixture solvent of ethyl acetate and methyl ethyl ketone (MEK) (1:1) and mixed to obtain a solution of ethyl acetate and methyl ethyl ketone (MEK) of toner binder (1). A part of the solution was dried under a reduced pressure to isolate toner binder (1).

The glass transition temperature (Tg) of toner binder (1) was 62° C.

Preparation of Toner 1

In a beaker, 240 parts of the solution of ethyl acetate and methyl ethyl ketone (MEK) of toner binder (1), and 20 parts of pentaerythritol tetrabehanate (melting point of 81° C. and melting viscosity of 25 cps), and 4 parts of pigment of C.I. Pigment Yellow 154 were poured, stirred at 12,000 rpm in a TK homomixer at 60° C. and uniformly dissolved and dispersed. To the beaker, 706 parts of ion exchange water, 294 parts of a 10% hydroxyapatite suspension (Supertite 10, manufactured by Nippon Chemical Industrial Co., Ltd.), and 0.2 parts of sodium dodecylbenzene sulfonate were poured and dissolved uniformly. Next, the temperature of the suspension was raised to 60° C., and the toner material solution and 0.0018 parts of a fluorine-containing compound (the above-exemplified compound (2)) were poured to the beaker while stirring it using a TK homomixer at 12,000 rpm and stirred for 10 minutes. Then, the mixture solution was transferred to a kolben equipped with a stirrer and a thermometer, the temperature of the mixture solution was raised to 98° C. to remove the solvent, and then washed, and dried to thereby obtain toner base particles 1.

To 100 parts of the obtained toner base particles 1, 1.5 parts of hydrophobic silica and 0.7 parts of hydrophobized titanium oxide were added, mixed 5 times using HENSCHEL MIXER at 2,000 rpm for 30 seconds to thereby obtain toner 1. Toner 1 had a fluorine atom content of 2.4 atomic %.

Preparation of Developer

The obtained toner 1 in an amount of 7 parts and 93 parts of carrier 1 were mixed and stirred to prepare a developer having a toner concentration of 7%.

Image Formation

Thus obtained developer was used in evaluations of developer as to carrier adhesion, edge effect, image fineness, and durability (reduced amount of charge, and reduced amount of resistance). Tables 4 and 5 show the evaluation results.

Example C-2

<Production of Toner 2>

Toner 2 was prepared in the same manner as toner 1 except that the added amount of the fluorine-containing compound (the above-exemplified compound (2)) was changed to 0.0070 parts. Toner 2 had a fluorine atom content of 7.6 atomic %.

Preparation of Conductive Particles

To 2.5 L of water, 200 g of aluminum oxide (average primary particle diameter of 0.40 μm, and absolute specific gravity of 3.9) was dispersed to prepare a water suspension. The suspension was heated and kept at a temperature of 80° C. To the suspension, a separately prepared solution in which 25 g of stannic chloride ($SnCl_4.5H_2O$) was dissolved in 200 mL of 2N hydrochloride, and a 12% ammonia water were added such that the pH of the suspension was kept at 7 to 8.

Next, a separately prepared solution in which 75 g of indium chloride ($InCl_3$) and 10 g of stannic chloride ($SnCl_4.5H_2O$) were dissolved in 800 mL of 2N hydrochloride, and a 12% ammonia water were dropped to the suspension such that the pH of the suspension was kept at 7 to 8. Upon completion of the dropping, thus treated suspension was filtered, washed, and the obtained cake of pigment was dried at 120° C.

Next, the obtained dry powder was heat-treated at a temperature of 500° C. in a nitrogen gas stream (1 L/minute) for 1.5 hours. The calcined product was crushed, and a 3.5% γ-aminopropyl triethoxysilane was added while stirring the crushed product in HENSCHEL MIXER which was heated at 70° C. Further, thus treated product was heat-treated at 100° C. for 1 hour to thereby obtain targeted white and conductive particles B.

Preparation of Carrier

The following composition was dispersed in a homomixer for 10 minutes to prepare a solution for forming a silicone-containing coating layer.

| <Composition> | |
|---|---|
| Silicone resin solution [solid content of 23% (SR2410 manufactured by TORAY DOW CORNING CO., LTD.)] | 132.2 parts by mass |
| Aminosilane [solid content of 100% (SH6020 manufactured by TORAY DOW CORNING CO., LTD.)] | 0.66 parts by mass |
| Conductive particles B [particle diameter: 0.40 μm; and powder specific resistance: 4.7 Ω · cm] | 57 parts by mass |
| Inorganic oxide fine particles A [aluminum oxide; particle diameter: 0.37 μm; absolute specific gravity: 3.9] | 35 parts by mass |
| Toluene | 300 parts by mass |

Next, the solution for forming the coating layer was coated on the surface of the core material of 500 parts by mass of a calcined ferrite powder having an average particle diameter of 35 μm and an absolute specific gravity of 5.5 so as to have a thickness of 0.15 μm using Spiracoater (manufactured by Okada Seiko K.K.) with an inside temperature of the coater of 40° C., and dried. The obtained carrier was left in an electric furnace at 240° C. for 1 hour and calcined. After cooling down the calcined carrier, the ferrite bulk powder was sieved through a sieve of 63 μm mesh and grinded to thereby prepare carrier 2. The obtained carrier 2 had a particle content of 50%, a 2.3 D/h, a volume resistivity value of 12.1 Log(Ω·cm), and a magnetization of 68 $Am^2/kg$. The surface coverage of the conductive particles and the inorganic oxide particles included in the coating layer relative to the used core material was 57%.

The obtained carrier 2 and toner 2 were used to prepare a developer in the same manner as in Example C-1, followed by evaluations of the developer. Tables 4 and 5 show the evaluation results.

Example C-3

Carrier 3 was obtained in the same manner as in Example C-2 except that a mixture of the acrylic resin solution and the silicone resin solution stated below was used in the formation of the coating layer. The obtained carrier 3 had a 2.3 D/h, a volume resistivity value of 12.5 Log(Ω·cm), and a magnetization of 68 $Am^2/kg$. The surface coverage of the conductive particles and the inorganic oxide particles included in the coating layer relative to the used core material was 63%.

| <Composition> | |
|---|---|
| Acrylic resin solution (solid content of 50%) | 39.7 parts by mass |
| Guanamine solution (solid content of 70%) | 12.4 parts by mass |
| Acidic catalyst (solid content of 40%) | 0.22 parts by mass |
| Silicone resin solution [solid content of 20% (SR2410 manufactured by TORAY DOW CORNING CO., LTD.)] | 185.8 parts by mass |
| Aminosilane [solid content of 100% (SH6020 manufactured by TORAY DOW CORNING CO., LTD.)] | 0.42 parts by mass |
| Conductive particles B [having the same particle diameter: 0.40 μm; and the same powder specific resistance: 3.7 Ω · cm as in Example 2] | 66 parts by mass |
| Inorganic oxide fine particles A [aluminum oxide; particle diameter: 0.37 μm; absolute specific gravity: 3.9] | 35 parts by mass |
| Toluene | 800 parts by mass |

The obtained carrier 3 and toner 1 were used to prepare a developer in the same manner as in Example C-1, followed by evaluations of the developer. Tables 4 and 5 show the evaluation results.

Example C-4

Carrier 4 was prepared in the same manner as in Example C-3 except that the base material of the conductive particles was changed to titanium oxide. Carrier 4 had a 2.3 D/h, a volume resistivity value of 11.9 [Log(Ω·cm)], and a magnetization of 68 $Am^2$/kg.

For physical properties of the conductive particles, the base material used in Example C-1 was changed to a titanium oxide having an average primary particle diameter of 0.39 Ω·cm, and the conductive particles had a carbon content of 0.29%, a powder specific resistance of 4.0 Ω·cm, and an absolute specific gravity of 4.2.

The obtained carrier 4 and toner 1 were used to prepare a developer, followed by evaluations of the developer. Tables 4 and 5 show the evaluation results. The surface coverage of the conductive particles and the inorganic oxide particles included in the coating layer relative to the used core material was 59%.

Example C-6

Carrier 5 was prepared in the same manner as in Example C-1 except that the volume resistivity value of the carrier was changed to 10.9 Ω·cm. Carrier 5 had a 2.3 D/h, and a magnetization of 68 $Am^2$/kg. In order to reduce the volume resistivity value, conductive particles were changed to those stated below.

For physical properties of the conductive particles, the conductive particles had a base material comprising an alumina which had been subjected to a surface treatment and an absolute specific gravity of 3.9, and had an under coating layer comprising tin dioxide, and an upper coating layer comprising indium oxide containing tin dioxide; particle diameter of 0.39 μm, and carbon content of 0.33%, and a powder specific resistance of 1.6 Ω·cm.

The obtained carrier 5 and toner 1 were used to prepare a developer, followed by evaluations of the developer. Tables 4 and 5 show the evaluation results. The surface coverage of the conductive particles and the inorganic oxide particles included in the coating layer relative to the used core material was 48%.

Example C-6

Carrier 6 was prepared in the same manner as in Example C-3 except that the mass average particle diameter of the carrier was changed to 18 μm (absolute specific gravity of 5.7), and the added amount of the fine particles was changed. The obtained carrier 6 had a 2.3 D/h, a volume resistivity value of 12.7 Log(Ω·cm), and a magnetization of 66 $Am^2$/kg.

| <Composition> | |
|---|---|
| Acrylic resin solution (solid content of 50%) | 39.7 parts by mass |
| Guanamine solution (solid content of 70%) | 12.4 parts by mass |
| Acidic catalyst (solid content of 40%) | 0.22 parts by mass |
| Silicone resin solution [solid content of 20% (SR2410 manufactured by TORAY DOW CORNING CO., LTD.)] | 185.8 parts by mass |
| Aminosilane [solid content of 100% (SH6020 manufactured by TORAY DOW CORNING CO., LTD.)] | 0.42 parts by mass |
| Conductive particles B [particle diameter: 0.40 μm; absolute specific gravity: 3.9; powder specific resistance: 3.7 Ω · cm] | 86 parts by mass |
| Inorganic oxide fine particles A [aluminum oxide; particle diameter: 0.37 μm; absolute specific gravity: 3.9] | 46 parts by mass |
| Toluene | 800 parts by mass |

The obtained carrier 6 and toner 1 were used to prepare a developer in the same manner as in Example C-1, followed by evaluations of the developer. Tables 4 and 5 show the evaluation results. The surface coverage of the conductive particles and the inorganic oxide particles included in the coating layer relative to the used core material was 45%.

Example C-7

Carrier 7 was prepared in the same manner as in Example C-3 except that the mass average particle diameter of the carrier was changed to 71 μm (absolute specific gravity of 5.3), and the added amount of the fine particles was changed. The obtained carrier 7 had a 2.3 D/h, a volume resistivity value of 12.5 Log(Ω·cm), and a magnetization of 69 $Am^2$/kg.

| <Composition> | |
|---|---|
| Acrylic resin solution (solid content of 50%) | 39.7 parts by mass |
| Guanamine solution (solid content of 70%) | 12.4 parts by mass |
| Acidic catalyst (solid content of 40%) | 0.22 parts by mass |
| Silicone resin solution [solid content of 20% (SR2410 manufactured by TORAY DOW CORNING CO., LTD.)] | 185.8 parts by mass |
| Aminosilane [solid content of 100% (SH6020 manufactured by TORAY DOW CORNING CO., LTD.)] | 0.42 parts by mass |
| Conductive particles B [having the same particle diameter: 0.40 μm; absolute specific gravity: 3.9; and powder specific resistance: 3.7 Ω · cm as shown in Example C-2] | 46 parts by mass |
| Inorganic oxide fine particles A [aluminum oxide; particle diameter: 0.37 μm; absolute specific gravity: 3.9] | 26 parts by mass |
| Toluene | 800 parts by mass |

The obtained carrier 7 and toner 1 were used to prepare a developer in the same manner as in Example C-1, followed by evaluations of the developer. Tables 4 and 5 show the evaluation results. The surface coverage of the conductive particles and the inorganic oxide particles included in the coating layer relative to the used core material was 89%.

Example C-8

Carrier 8 was prepared in the same manner as in Example C-3 except that the average primary particle diameter of the aluminum oxide (absolute specific gravity: 4.2) used for the base material was changed to 0.15 μm, and the added amount of the fine particles was changed. Carrier 8 had a 0.8 D/h, a volume resistivity value of 12.0 Log(Ω·cm), and a magnetization of 68 $Am^2/kg$.

| <Composition> | |
|---|---|
| Acrylic resin solution (solid content of 50%) | 39.7 parts by mass |
| Guanamine solution (solid content of 70%) | 12.4 parts by mass |
| Acidic catalyst (solid content of 40%) | 0.22 parts by mass |
| Silicone resin solution [solid content of 20% (SR2410 manufactured by TORAY DOW CORNING CO., LTD.)] | 185.8 parts by mass |
| Aminosilane [solid content of 100% (SH6020 manufactured by TORAY DOW CORNING CO., LTD.)] | 0.42 parts by mass |
| Conductive particles [having a base material comprising alumina which had been subjected to a surface treatment, an under coating layer comprising tin dioxide, and an upper coating layer of indium oxide containing tin dioxide; particle diameter: 0.15 μm; carbon content: 0.15%; powder specific resistance: 2.4 Ω · cm] | 36 parts by mass |
| Inorganic oxide fine particles [aluminum oxide; particle diameter: 0.15 μm; absolute specific gravity: 4.2] | 16 parts by mass |
| Toluene | 800 parts by mass |

The obtained carrier 8 and toner 1 were used to prepare a developer in the same manner as in Example C-1, followed by evaluations of the developer. Tables 4 and 5 show the evaluation results. The surface coverage of the conductive particles and the inorganic oxide particles included in the coating layer relative to the used core material was 79%.

Example C-9

Carrier 9 was prepared in the same manner as in Example C-3 except that a calcined ferrite (absolute specific gravity: 5.4) having a low magnetization and a particle diameter of 35 μm was used to change the magnetization to 35 $Am^2/kg$. Carrier 9 had a particle content of 50%, a 2.3 D/h, and a volume resistivity value of 13.9 [Log (Ω·cm)].

The obtained carrier 9 and toner 1 were used to prepare a developer in the same manner as in Example C-1, followed by evaluations of the developer. Tables 4 and 5 show the evaluation results. The surface coverage of the conductive particles and the inorganic oxide particles included in the coating layer relative to the used core material was 63%.

Example C-10

Carrier 10 was prepared in the same manner as in Example C-3 except that a calcined ferrite (absolute specific gravity: 5.5) having a high magnetization and a particle diameter of 35 μm was used to change the magnetization to 93 $Am^2/kg$. Carrier 10 had a particle content of 50%, a 2.3 D/h, and a volume resistivity value of 10.9 [Log(Ω·cm)].

The obtained carrier 10 and toner 1 were used to prepare a developer in the same manner as in Example C-1, followed by evaluations of the developer. Tables 4 and 5 show the evaluation results. The surface coverage of the conductive particles and the inorganic oxide particles included in the coating layer relative to the used core material was 63%.

Example C-11

Preparation of Conductive Particles

To 2.5 L of water, 200 g of aluminum oxide (average primary particle diameter of 0.40 μm, and absolute specific gravity of 3.9) was dispersed to prepare a water suspension. The suspension was heated and kept at a temperature of 80° C. To the suspension, a separately prepared solution in which 22 g of stannic chloride ($SnCl_4.5H_2O$) was dissolved in 200 mL of 2N hydrochloride, and a 12% ammonia water were added such that the pH of the suspension was kept at 7 to 8.

Next, a separately prepared solution in which 65 g of indium chloride ($InCl_3$) and 8 g of stannic chloride ($SnCl_4.5H_2O$) were dissolved in 800 mL of 2N hydrochloride, and a 12% ammonia water were dropped to the suspension such that the pH of the suspension was kept at 7 to 8. Upon completion of the dropping, thus treated suspension was filtered, washed, and the obtained cake of pigment was dried at 120° C.

Next, the obtained dry powder was heat-treated at a temperature of 500° C. in a nitrogen gas stream (1 L/minute) for 1.5 hours. The calcined product was crushed, and a 3.5% γ-aminopropyl triethoxysilane was added while stirring the crushed product in HENSCHEL MIXER which was heated at 70° C. Further, thus treated product was heat-treated at 100° C. for 1 hour to thereby obtain targeted white and conductive particles C.

Preparation of Carrier

Carrier 18 was prepared in the same manner as in Example C-3 except that only the following conductive particles were used. Carrier 18 had a 2.3 D/h, and a volume resistivity value of 13.2 [Log (Ω·cm)].

Conductive particles C . . . 78 parts by mass

[particle diameter: 0.40 μm; carbon content: 0.31%; powder specific resistance: 7.7 Ω·cm]

The obtained carrier 11 and toner 1 were used to prepare a developer in the same manner as in Example C-1, followed by evaluations of the developer. Tables 4 and 5 show the evaluation results. The surface coverage of the conductive particles and the inorganic oxide particles included in the coating layer relative to the used core material was 48%.

Comparative Example C-1

Preparation of Toner 3

Toner 3 was prepared in the same manner as toner 1 except that the added amount of the fluorine-containing compound (the above-exemplified compound (2)) was changed to 0.023 parts by mass. Toner 3 had a fluorine atom content of 30.2 atomic %.

On the other hand, carrier 12 was prepared in the same manner as in Example C-1 except that the usage amount of the conductive particles A was changed to 0.4 parts by mass. Carrier 12 had a 2.2 D/h, a volume resistivity value of 14.9 [Log(Ω·cm)], and a magnetization of 68 $Am^2/kg$.

The obtained toner 3 and carrier 12 were used to prepare a developer in the same manner as in Example C-1, followed by evaluations of the developer. Tables 4 and 5 show the evaluation results.

Comparative Example C-2

Preparation of Toner 4

Toner 4 was prepared in the same manner as toner 1 except that the added amount of the fluorine-containing compound (the above-exemplified compound (2)) was changed to 0.0006 parts.

The obtained toner 4 and carrier 12 were used to prepare a developer in the same manner as in Example C-1, followed by evaluations of the developer. Tables 4 and 5 show the evaluation results.

Comparative Example C-3

Carrier 13 was prepared in the same manner as in Example C-11 except that the added amount of the conductive particles was reduced from 78 parts by mass to 0.8 parts by mass. Carrier 13 had a 2.3 D/h, a volume resistivity value of 14.1 [Log(Ω·cm)], and a magnetization of 69 $Am^2/kg$. The surface coverage of the conductive particles and the inorganic oxide particles included in the coating layer relative to the used core material was 0.5%.

The obtained carrier 13 and toner 1 were used to prepare a developer in the same manner as in Example C-1, followed by evaluations of the developer. Table 4 and 5 show the evaluation results.

Comparative Example C-4

Carrier 14 was prepared in the same manner as in Example C-11 except that the added amount of the conductive particles was increased from 78 parts by mass to 200 parts by mass. Carrier 14 had a 2.3 D/h, a volume resistivity value of 11.8 [Log(Ω·cm)], and a magnetization of 69 $Am^2/kg$. The surface coverage of the conductive particles and the inorganic oxide particles included in the coating layer relative to the used core material was 123%.

The obtained carrier 14 and toner 1 were used to prepare a developer in the same manner as in Example C-1, followed by evaluations of the developer. Table 4 and 5 show the evaluation results.

<Evaluation Method of Increase in Counted Ti Additive-Filming>

In the present invention, the increase in counted number of Ti additive-filming means a value obtained by deducting the number of Ti atoms counted in a carrier in a developer before the evaluation of the 100,000 sheet-running output for the purpose of evaluating durability of a developer from the number of Ti atoms counted in the carrier in the developer after the evaluation of the 100,000 sheet-running output, namely, an increased number of Ti atoms. For the method of removing a carrier in a developer, the developer is blown off by using a typical blow-off unit (TB-200, manufactured by Toshiba Chemical Corp.) to remove the toner to thereby take out the carrier.

The number of counted Ti atoms can be measured using a X-ray fluorescence analyzer (ZSX100e, (manufactured by Rigaku Corporation). Specifically, first, a measurement sample of the carrier is made to uniformly adhere on a seal with a pressure sensitive adhesive coated thereon. Then, to remove excess of carrier, the seal is slapped with holding both ends of the seal to send the excessive carrier flying. Two sheets of measurement sample seals are prepared in the same manner, and these measurement samples are respectively set to a measurement sample stand for the measurement of the number of Ti atoms in the carrier. Measurement conditions are as follows:

Measurement atmosphere: in vacuum

Measured diameter: 30 mm

X-ray tube voltage: 50 kV

X-ray tube current: 30 mA

The measurement value fluctuates from day to day. Thus, to eliminate the influence, the fluctuation errors must be corrected. Specifically, a Ti standard sample is prepared, and the Ti standard sample is measured every time. A ratio between the measured value and the standard value of the Ti standard sample is calculated. This ratio is multiplied by the actually measured sample value. The number of Ti atoms is measured in this way twice for each sample, and the average value is taken as the Ti value. Thus obtained value can be represented with a kcps unit.

<Evaluation Method of Exfoliated Amount of Film>

The exfoliated amount of film is a value obtained by deducting the film thickness (he) of carrier in a developer after the evaluation of 100,000 sheet-running output for the purpose of evaluating durability of a developer from the film thickness (hs) of carrier in the developer before the evaluation of the 100,000 sheet-running output, namely, an exfoliated amount of film. For the method of removing a carrier in a developer, the developer is blown off by using a typical blow-off unit (TB-200, manufactured by Toshiba Chemical Corp.) to remove the toner to thereby take out the carrier.

Figure 10:
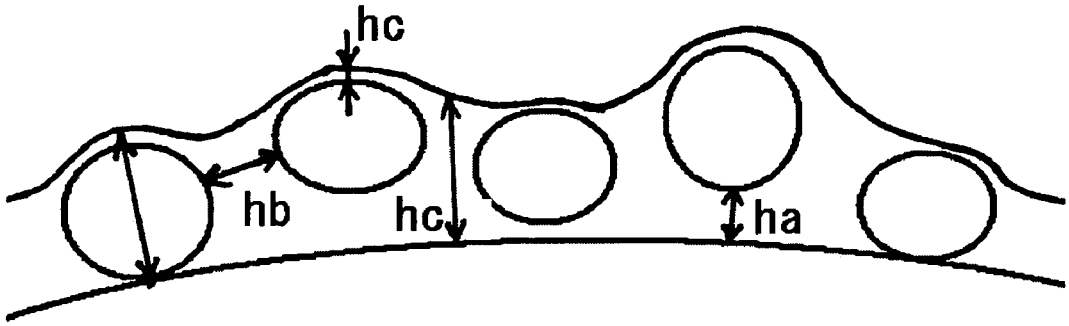
FIG. 10 is an illustration of the evaluation method of exfoliated amount of film of coating layer in carrier used in the present invention.

The film thicknesses or thicknesses of the coating layer (hs) and (he) were measured as follows, and both (hs) and (he) are applied to the following (h):

In the measurement of the thickness of the coating layer (h), a cross-sectional surface of the carrier is observed using a transmission electron microscope (TEM). As shown in FIG. 10, the average value of a thickness (ha) of the resin part residing between the core material surface and a particle, a thickness (hb) of the resin part residing between particles, and a thickness (hc) of the resin part on the core material and particles was taken as a thickness (h) of the coating layer. For the thickness (ha), 50 points of each point per 1 particle along the carrier surface in a cross-sectional surface of the carrier were measured, and the average value of the measured thickness values of the 50 points is taken as a thickness (ha). Herein, the measurement point in each particle of 50 particles is set at a center point of the measured particle when the particle is projected in the direction of the core material surface. For the thickness of (hb), 50 points of each point of a gap between particles were measured along the carrier surface in a cross-sectional surface of the carrier, and the average value of the measured values of the 50 points is taken as a thickness (hb). Herein, the measurement point in the each gap is set at a center point of the gap between particles when the particles are projected in the direction of the core material surface. For the thickness (hc), 50 points along the carrier surface in a cross-sectional surface of the carrier were measured at an interval of 0.2 μm, and the average value of the obtained measurement values of the 50 points is taken as a thickness (hc).

TABLE 3

| | Indium Content (% by mass) | Carrier | Toner | Volume Resistivity Value [Log (Ω · cm)] | Surface Coverage (%) | Fluorine Content (atomic %) |
|---|---|---|---|---|---|---|
| Ex. C-1 | 0.0070 | Carrier 1 | Toner 1 | 13.9 | 46 | 2.4 |
| Ex. C-2 | 0.0129 | Carrier 2 | Toner 2 | 12.1 | 57 | 7.6 |
| Ex. C-3 | 0.0073 | Carrier 3 | Toner 1 | 12.5 | 62 | 2.4 |
| Ex. C-4 | 0.0071 | Carrier 4 | Toner 1 | 11.9 | 59 | 2.4 |
| Ex. C-5 | 0.0072 | Carrier 5 | Toner 1 | 10.9 | 48 | 2.4 |
| Ex. C-6 | 0.0095 | Carrier 6 | Toner 1 | 12.7 | 45 | 2.4 |
| Ex. C-7 | 0.0051 | Carrier 7 | Toner 1 | 12.5 | 89 | 2.4 |
| Ex. C-8 | 0.0040 | Carrier 8 | Toner 1 | 12.0 | 79 | 2.4 |
| Ex. C-9 | 0.0070 | Carrier 9 | Toner 1 | 13.9 | 63 | 2.4 |
| Ex. C-10 | 0.0072 | Carrier 10 | Toner 1 | 10.9 | 63 | 2.4 |
| Ex. C-11 | 0.0086 | Carrier 11 | Toner 1 | 13.2 | 48 | 2.4 |
| Compara. Ex. C-1 | 0.00008 | Carrier 12 | Toner 3 | 14.9 | 28 | 30.2 |
| Compara. Ex. C-2 | 0.00008 | Carrier 12 | Toner 4 | 14.9 | 28 | 0.8 |
| Compara. Ex. C-3 | 0.00009 | Carrier 13 | Toner 1 | 14.1 | 0.5 | 2.4 |
| Compara. Ex. C-4 | 0.52 | Carrier 14 | Toner 1 | 11.8 | 123 | 2.4 |

TABLE 4

| | 25° C., 50% RH | | | 30° C., 90% RH |
|---|---|---|---|---|
| | Edge Effect | Carrier Adhesion in image background | Image Fineness | Carrier Adhesion in solid parts of image |
| Ex. C-1 | A | B | A | A |
| Ex. C-2 | A | A | A | A |
| Ex. C-3 | A | A | A | A |
| Ex. C-4 | A | A | A | A |
| Ex. C-5 | A | A | A | B |
| Ex. C-6 | A | A | A | A |
| Ex. C-7 | A | A | B | A |
| Ex. C-8 | A | A | B | A |
| Ex. C-9 | A | B | B | A |
| Ex. C-10 | B | B | B | B |
| Ex. C-11 | A | A | A | A |
| Compara. Ex. C-1 | A | C | B | B |
| Compara. Ex. C-2 | A | C | B | B |
| Compara. Ex. C-3 | A | C | B | B |
| Compara. Ex. C-4 | C | B | C | C |

TABLE 5

| | Durability (25° C., 50% RH) After outputting 100,000 sheets | | | |
|---|---|---|---|---|
| | Reduced amount of charge (μC/g) | Reduced amount of resistance [Log(Ω · cm)] | Increase in counted Ti additive-filming (kcps) | Exfoliated amount of film (μm) |
| Ex. C-1 | 1.8 | 1.4 | 0.35 | 0.03 |
| Ex. C-2 | 3.2 | 0.8 | 0.16 | 0.02 |
| Ex. C-3 | 1.3 | 1.2 | 0.28 | 0.02 |
| Ex. C-4 | 3.1 | 1.1 | 0.29 | 0.02 |
| Ex. C-5 | 3.4 | 1.3 | 0.31 | 0.03 |
| Ex. C-6 | 3.1 | 1.5 | 0.31 | 0.03 |
| Ex. C-7 | 1.5 | 0.9 | 0.15 | 0.01 |
| Ex. C-8 | 1.9 | 0.8 | 0.18 | 0.01 |
| Ex. C-9 | 2.1 | 1.0 | 0.22 | 0.02 |

TABLE 5-continued

| | Durability (25° C., 50% RH) After outputting 100,000 sheets | | | |
|---|---|---|---|---|
| | Reduced amount of charge (μC/g) | Reduced amount of resistance [Log(Ω · cm)] | Increase in counted Ti additive-filming (kcps) | Exfoliated amount of film (μm) |
| Ex. C-10 | 2.3 | 1.1 | 0.22 | 0.02 |
| Ex. C-11 | 2.9 | 1.2 | 0.33 | 0.03 |
| Compara. Ex. C-1 | Evaluations were cancelled because of a large amount of toner scattering, which was caused by a substantial reduction in charge. | | | |
| Compara. Ex. C-2 | Evaluations were cancelled because of a large amount of toner scattering, which was caused by a substantial reduction in charge. | | | |
| Compara. Ex. C-3 | 17.8 | 3.5 | 0.78 | 0.08 |
| Compara. Ex. C-4 | 16.5 | 3.7 | 0.41 | 0.05 |

The evaluation results shown in Tables 3, 4, and 5 exemplified that the developers prepared in Examples C-1 to C-11 respectively had a value within the target value range in all the evaluation items of edge effect, carrier adhesion, image fineness, reduced amount of charge, and reduced amount of resistance and showed excellent results.

On the other hand, with the carrier prepared in Comparative Examples C-1 and C-2 which had an indium content of 0.00008% by mass and a fluorine atom content being out of range, the reduced amount of charge at the time of running output of 30,000 sheets resulted in a value of 20 μC/g or more, which led to a large amount of toner scattering, and it was impossible to use the developer practically. For the reason mentioned above, the evaluations of developer were cancelled.

Further, with the developer prepared in Comparative Example C-3 which had an indium content of 0.00009% by mass and a 0.5% surface coverage, it resulted in incapability of practical use because of a substantial reduction in resistance and charge. With the developer prepared in Comparative Example C-4 which had an indium content of 0.052% by mass and a 123% surface coverage, it was impossible to practically use the developer, because the resistance was substantially reduced due to exfoliation of the conductive particles, and reduction of charge associated with the change in resistance also occurred.

Since a developer using the carrier for electrophotography of the present invention excels in durability and is capable of forming finely textured images for a long time without substantially causing edge effect, it can be utilized as a developer for copiers and printers based on electrophotographic technology.

What is claimed is:

1. A carrier for electrophotography comprising:

a core material, and a coating layer, wherein the coating layer comprises conductive particles on a surface of the core material, and the carrier for electrophotography comprises indium (In) in an amount of 0.0001% by mass to 0.5% by mass, wherein the conductive particles comprise base particles each having a coating layer thereon, and the coating layer comprises a tin dioxide layer, and an indium oxide layer containing tin dioxide on the tin dioxide layer.

2. The carrier for electrophotography according to claim 1, the base particles comprise one or more selected from aluminum oxides, titanium dioxides, zinc oxides, silicon dioxides, barium sulfates, and zirconium oxides.

3. The carrier for electrophotography according to claim 1, wherein the conductive particles have a powder specific resistance of 200 Ω·cm or less.

4. The carrier for electrophotography according to claim 1, the conductive particles have an oil absorption amount of 10 (mL/100 g) to 300 (mL/100 g).

5. The carrier for electrophotography according to claim 1, wherein the conductive particles are white in color, and the white conductive particles have a value L* being 70 or more and a value b* being −10 to 10 in the color specification system of the CIE L*a*b*.

6. The carrier for electrophotography according to claim 1, wherein a particle diameter (D) of the particles included in the coating layer and a thickness (h) of the coating layer satisfy the following relation:

$$1<[D/h]<10.$$

7. The carrier for electrophotography according to claim 1, wherein the content of the particles in the coating layer is 10% by mass to 70% by mass.

8. The carrier for electrophotography according to claim 1, wherein the surface coverage relative to the particle core material is 30% to 90%.

9. The carrier for electrophotography according to claim 1, wherein the coating layer comprises a binder resin, and the binder resin is at least any one of a silicone resin and an acrylic resin.

10. The carrier for electrophotography according to claim 1 having a volume resistivity value of 10 [Log(Ω·cm)] to 16 [Log(Ω·cm)].

11. The carrier for electrophotography according to claim 1 having a volume average particle diameter of 20 μm to 65 μm.

12. The carrier for electrophotography according to claim 1 having a magnetic moment at 1,000 ($10^3/4\pi\cdot A/m$) of the carrier being 40 ($Am^2/kg$) to 90 ($Am^2/kg$).

13. A developer comprising:

a toner, the carrier for electrophotography according to claim 1, wherein the toner comprises a binder resin and a colorant, the carrier for electrophotography comprises a core material, a coating layer comprising particles on a surface of the core material, and indium (In) in an amount of 0.0001% by mass to 0.5% by mass.

14. The developer according to claim 13, wherein the toner comprises toner base particles, the surfaces of the toner base particles are fluorinated with a fluorine-containing compound, and the content of fluorine atom derived from the fluorine-containing compound determined by X-ray photoelectron spectroscopy is 2 atomic % to 30 atomic %.

15. The developer according to claim 13, wherein the toner is a color toner.

16. A developer container comprising:

a developer, wherein the developer comprises a toner and a carrier for electrophotography, according to claim 1, the toner comprises a binder resin and a colorant, the carrier for electrophotography comprises a core material, a coating layer comprising particles on a surface of the core material, and indium (In) in an amount of 0.0001% by mass to 0.5% by mass.

* * * * *